US007048067B1

(12) United States Patent
Cook et al.

(10) Patent No.: US 7,048,067 B1
(45) Date of Patent: May 23, 2006

(54) WELLBORE CASING REPAIR

(75) Inventors: Robert Lance Cook, Katy, TX (US); David P. Brisco, Duncan, OK (US); R. Bruce Stewart, The Hague (NL); Reece E. Wyant, Houston, TX (US); Lev Ring, Houston, TX (US); James Jang Woo Nahm, Las Vegas, NV (US); Richard Haut, Sugar Land, TX (US); Robert D. Mack, Katy, TX (US); Alan B. Duell, Duncan, OK (US); Andrei Gregory Filippov, Katy, TX (US); Kenneth Michael Cowan, Sugar Land, TX (US); William Joseph Dean, Katy, TX (US)

(73) Assignee: Shell Oil Company, Houston, TX (US)

( * ) Notice: Subject to any disclaimer, the term of this patent is extended or adjusted under 35 U.S.C. 154(b) by 53 days.

(21) Appl. No.: 10/111,982

(22) PCT Filed: Oct. 31, 2000

(86) PCT No.: PCT/US00/30022

§ 371 (c)(1),
(2), (4) Date: Sep. 25, 2002

(87) PCT Pub. No.: WO01/33037

PCT Pub. Date: May 10, 2001

Related U.S. Application Data

(60) Provisional application No. 60/162,671, filed on Nov. 1, 1999.

(51) Int. Cl.
*E21B 23/02* (2006.01)

(52) U.S. Cl. ..... 166/390; 166/384; 166/277; 166/207

(58) Field of Classification Search ..... 166/380, 166/384, 207, 277, 217
See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Philips |
| 806,156 | A | 12/1905 | Marshall |

(Continued)

FOREIGN PATENT DOCUMENTS

AU 767364 2/2004

(Continued)

OTHER PUBLICATIONS

Search Report to Application No. GB 0003251.6, Claims Searched 1-5, Jul. 13, 2000.

(Continued)

*Primary Examiner*—William Neuder
(74) *Attorney, Agent, or Firm*—Haynes and Boone LLP; Todd Mattingly

(57) ABSTRACT

An apparatus and method for repairing a wellbore casing (100). An opening (115) in a wellbore casing (100) is located using a logging tool (310). An expandable tubular member (370) is then positioned in opposition to the opening (115) in the wellbore casing (100). The expandable tubular member (370) is then radially expanded into intimate contact with the wellbore casing (100).

98 Claims, 30 Drawing Sheets

U.S. PATENT DOCUMENTS

| | | | | |
|---|---|---|---|---|
| 958,517 | A | | 5/1910 | Mettler |
| 984,449 | A | | 2/1911 | Stewart |
| 1,166,040 | A | | 12/1915 | Burlingham |
| 1,233,888 | A | | 7/1917 | Leonard |
| 1,494,128 | A | | 5/1924 | Primrose |
| 1,589,781 | A | | 6/1926 | Anderson |
| 1,590,357 | A | | 6/1926 | Feisthamel |
| 1,597,212 | A | | 8/1926 | Spengler |
| 1,613,461 | A | | 1/1927 | Johnson |
| 1,880,218 | A | | 10/1932 | Simmons |
| 1,981,525 | A | | 11/1934 | Price |
| 2,046,870 | A | | 7/1936 | Clasen et al. |
| 2,087,185 | A | | 7/1937 | Dillom |
| 2,122,757 | A | | 7/1938 | Scott |
| 2,145,165 | A | | 1/1939 | Flagg |
| 2,160,263 | A | | 5/1939 | Fletcher |
| 2,187,275 | A | | 1/1940 | McLennan |
| 2,204,586 | A | | 6/1940 | Grau |
| 2,214,226 | A | | 9/1940 | English |
| 2,226,804 | A | | 12/1940 | Carroll |
| 2,273,017 | A | | 2/1942 | Boynton |
| 2,301,495 | A | | 11/1942 | Abegg |
| 2,371,840 | A | | 3/1945 | Otis |
| 2,447,629 | A | | 8/1948 | Beissinger et al. |
| 2,500,276 | A | | 3/1950 | Church |
| 2,546,295 | A | | 3/1951 | Boice |
| 2,583,316 | A | | 1/1952 | Bannister |
| 2,647,847 | A | | 8/1953 | Black, et al. |
| 2,734,580 | A | | 2/1956 | Layne |
| 2,796,134 | A | | 6/1957 | Binkley |
| 2,812,025 | A | | 11/1957 | Teague et al. |
| 2,907,589 | A | | 10/1959 | Knox |
| 2,929,741 | A | | 1/1960 | Strock, et al. |
| 3,015,362 | A | | 1/1962 | Moosman |
| 3,015,500 | A | | 1/1962 | Barnett |
| 3,018,547 | A | | 1/1962 | Marskell |
| 3,039,530 | A | | 6/1962 | Condra |
| 3,067,819 | A | | 12/1962 | Gore |
| 3,068,563 | A | | 12/1962 | Reverman |
| 3,104,703 | A | | 9/1963 | Rike et al. |
| 3,111,991 | A | | 11/1963 | O'Neal |
| 3,167,122 | A | | 1/1965 | Lang |
| 3,175,618 | A | * | 3/1965 | Lang ..... 166/63 |
| 3,179,168 | A | | 4/1965 | Vincent |
| 3,188,816 | A | | 6/1965 | Koch |
| 3,191,677 | A | | 6/1965 | Kinley |
| 3,191,680 | A | | 6/1965 | Vincent |
| 3,203,451 | A | | 8/1965 | Vincent |
| 3,203,483 | A | | 8/1965 | Vincent |
| 3,209,546 | A | | 10/1965 | Lawton |
| 3,210,102 | A | | 10/1965 | Joslin |
| 3,233,315 | A | | 2/1966 | Levake |
| 3,245,471 | A | | 4/1966 | Howard |
| 3,270,817 | A | | 9/1966 | Papaila |
| 3,297,092 | A | | 1/1967 | Jennings |
| 3,326,293 | A | | 6/1967 | Skipper |
| 3,343,252 | A | | 9/1967 | Reesor |
| 3,353,599 | A | | 11/1967 | Swift |
| 3,354,955 | A | | 11/1967 | Berry |
| 3,358,760 | A | | 12/1967 | Blagg |
| 3,358,769 | A | | 12/1967 | Berry |
| 3,364,993 | A | | 1/1968 | Skipper |
| 3,371,717 | A | | 3/1968 | Chenoweth |
| 3,412,565 | A | * | 11/1968 | Lindsey et. al. ..... 405/231 |
| 3,419,080 | A | | 12/1968 | Lebourg |
| 3,424,244 | A | | 1/1969 | Kinley |
| 3,427,707 | A | | 2/1969 | Nowosadko |
| 3,477,506 | A | | 11/1969 | Malone |
| 3,489,220 | A | | 1/1970 | Kinley |
| 3,498,376 | A | | 3/1970 | Sizer et al. |
| 3,504,515 | A | | 4/1970 | Reardon |
| 3,520,049 | A | | 7/1970 | Lysenko, et al. |
| 3,528,498 | A | | 9/1970 | Carothers |
| 3,568,773 | A | | 3/1971 | Chancellor |
| 3,578,081 | A | | 5/1971 | Bodine |
| 3,579,805 | A | | 5/1971 | Kast |
| 3,605,887 | A | | 9/1971 | Lambie |
| 3,631,926 | A | | 1/1972 | Young |
| 3,665,591 | A | | 5/1972 | Kowal |
| 3,667,547 | A | | 6/1972 | Ahlstone |
| 3,669,190 | A | | 6/1972 | Sizer et al. |
| 3,682,256 | A | | 8/1972 | Stuart |
| 3,687,196 | A | | 8/1972 | Mullins |
| 3,691,624 | A | | 9/1972 | Kinley |
| 3,693,717 | A | | 9/1972 | Wuenschel |
| 3,704,730 | A | | 12/1972 | Witzig |
| 3,709,306 | A | | 1/1973 | Curington |
| 3,711,123 | A | | 1/1973 | Arnold |
| 3,712,376 | A | | 1/1973 | Owen et al. |
| 3,746,068 | A | | 7/1973 | Deckert et al. |
| 3,746,091 | A | | 7/1973 | Owen et al. |
| 3,746,092 | A | | 7/1973 | Land |
| 3,764,168 | A | | 10/1973 | Kisling, III et al. |
| 3,776,307 | A | | 12/1973 | Young |
| 3,779,025 | A | | 12/1973 | Godley, et al. |
| 3,780,562 | A | | 12/1973 | Kinley |
| 3,781,966 | A | | 1/1974 | Lieberman |
| 3,785,193 | A | | 1/1974 | Kinley et al. |
| 3,797,259 | A | | 3/1974 | Kammerer, Jr. |
| 3,812,912 | A | | 5/1974 | Wuenschel |
| 3,818,734 | A | | 6/1974 | Bateman |
| 3,834,742 | A | | 9/1974 | McPhillips |
| 3,866,954 | A | | 2/1975 | Slator et al. |
| 3,885,298 | A | | 5/1975 | Pogonowski |
| 3,887,006 | A | | 6/1975 | Pitts |
| 3,893,718 | A | | 7/1975 | Powell |
| 3,898,163 | A | | 8/1975 | Mott |
| 3,915,478 | A | | 10/1975 | Al et al. |
| 3,935,910 | A | | 2/1976 | Gaudy et al. |
| 3,942,824 | A | | 3/1976 | Sable |
| 3,945,444 | A | | 3/1976 | Knudson |
| 3,948,321 | A | | 4/1976 | Owen et al. |
| 3,970,336 | A | | 7/1976 | O'Sickey et al. |
| 3,977,473 | A | | 8/1976 | Page, Jr. |
| 3,989,280 | A | | 11/1976 | Schwarz |
| 3,997,193 | A | | 12/1976 | Tsuda et al. |
| 4,011,652 | A | | 3/1977 | Black |
| 4,019,579 | A | | 4/1977 | Thuse |
| 4,026,583 | A | | 5/1977 | Gottlieb |
| 4,053,247 | A | | 10/1977 | Marsh |
| 4,069,573 | A | | 1/1978 | Rogers, Jr. et al. |
| 4,076,287 | A | | 2/1978 | Bill et al. |
| 4,096,913 | A | | 6/1978 | Kenneday et al. |
| 4,098,334 | A | | 7/1978 | Crowe |
| 4,125,937 | A | | 11/1978 | Brown et al. |
| 4,152,821 | A | | 5/1979 | Scott |
| 4,168,747 | A | | 9/1979 | Youmans |
| 4,190,108 | A | | 2/1980 | Webber |
| 4,205,422 | A | | 6/1980 | Hardwick |
| 4,253,687 | A | | 3/1981 | Maples |
| 4,274,665 | A | | 6/1981 | Marsh, Jr. |
| RE30,802 | E | | 11/1981 | Rogers, Jr. |
| 4,304,428 | A | | 12/1981 | Grigorian et al. |
| 4,328,983 | A | | 5/1982 | Gibson |
| 4,359,889 | A | | 11/1982 | Kelly |
| 4,363,358 | A | | 12/1982 | Ellis |
| 4,366,971 | A | | 1/1983 | Lula |
| 4,368,571 | A | | 1/1983 | Cooper, Jr. |
| 4,379,471 | A | | 4/1983 | Kuenzel |
| 4,380,347 | A | | 4/1983 | Sable |
| 4,384,625 | A | | 5/1983 | Roper et al. |
| 4,388,752 | A | | 6/1983 | Vinciguerra et al. |
| 4,391,325 | A | | 7/1983 | Baker et al. |
| 4,393,931 | A | | 7/1983 | Muse et al. |

4,396,061 A 8/1983 Tamplen et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,429,741 A 2/1984 Hyland
4,440,233 A 4/1984 Baugh et al.
4,444,250 A 4/1984 Keithahn et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,501,327 A 2/1985 Retz
4,505,017 A 3/1985 Schukei
4,505,987 A 3/1985 Yamada et al.
4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,541,655 A 9/1985 Hunter
4,550,782 A 11/1985 Lawson
4,553,776 A 11/1985 Dodd
4,573,248 A 3/1986 Hackett
4,576,386 A 3/1986 Benson et al.
4,581,817 A 4/1986 Kelly
4,590,227 A 5/1986 Nakamura et al.
4,590,995 A 5/1986 Evans
4,592,577 A 6/1986 Ayres et al.
4,595,063 A 6/1986 Jennings et al.
4,601,343 A 7/1986 Lindsey, et al.
4,605,063 A 8/1986 Ross
4,611,662 A 9/1986 Harrington
4,614,233 A 9/1986 Menard
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,758,025 A 7/1988 Frick
4,776,394 A 10/1988 Lynde et al.
4,778,088 A 10/1988 Miller
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,836,579 A 6/1989 Wester et al.
4,842,082 A 6/1989 Springer
4,848,459 A 7/1989 Blackwell, et al.
4,856,592 A 8/1989 Van Bilderbeek et al.
4,865,127 A 9/1989 Koster
4,871,199 A 10/1989 Ridenour, et al.
4,872,253 A 10/1989 Carstensen
4,887,646 A 12/1989 Groves
4,892,337 A 1/1990 Gunderson
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,064,004 A 11/1991 Lundell
5,079,837 A 1/1992 Vanselow
5,083,608 A 1/1992 Abdrakhmanov et al.
5,093,015 A 3/1992 Oldiges
5,095,991 A 3/1992 Milberger
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,197,553 A 3/1993 Leturno
5,209,600 A 5/1993 Koster
5,226,492 A 7/1993 Solaeche P. et al.
5,242,017 A 9/1993 Hailey
5,275,242 A 1/1994 Payne
5,282,508 A 2/1994 Ellingsen et al.
5,286,393 A 2/1994 Oldiges et al.
5,309,621 A 5/1994 ODonnell, et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.

5,326,137 A 7/1994 Lorenz et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,413,180 A 5/1995 Ross et al.
5,425,559 A 6/1995 Nobileau
5,426,130 A 6/1995 Thurber et al.
5,431,831 A 7/1995 Vincent
5,435,395 A 7/1995 Connell
5,439,320 A 8/1995 Abrams
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,449 A 12/1997 Hennig et al.
5,718,288 A 2/1998 Bertet et al.
5,743,335 A 4/1998 Bussear
5,749,419 A 5/1998 Coronado et al.
5,749,585 A 5/1998 Lembcke
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.
5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Wood et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,692 A 6/2000 Wood et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,158,963 A 12/2000 Hollis
6,167,970 B1 1/2001 Stout
6,182,775 B1 2/2001 Hipp
6,196,336 B1 3/2001 Fincher et al.
6,226,855 B1 5/2001 Maine
6,231,086 B1 5/2001 Tierling
6,250,385 B1 6/2001 Montaron
6,263,966 B1 7/2001 Haut et al.

6,263,968 B1 7/2001 Freeman et al.
6,263,972 B1 7/2001 Richard et al.
6,267,181 B1 7/2001 Rhein Knudson et al.
6,275,556 B1 8/2001 Kinney et al.
6,283,211 B1 9/2001 Vloedman
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,343,495 B1 2/2002 Cheppe et al.
6,343,657 B1 2/2002 Baugh et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,724 B1 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B1 10/2002 Cook et al.
6,470,996 B1 10/2002 Kyle et al.
6,478,092 B1 11/2002 Voll et al.
6,491,108 B1 12/2002 Slup et al.
6,497,289 B1 12/2002 Cook et al.
6,516,887 B1 2/2003 Nguyen et al.
6,517,126 B1 2/2003 Peterson et al.
6,527,049 B1 3/2003 Metcalfe et al.
6,543,545 B1 4/2003 Chatterji et al.
6,543,552 B1 4/2003 Metcalfe et al.
6,550,539 B1 4/2003 Maguire et al.
6,550,821 B1 4/2003 DeLange et al.
6,557,640 B1 5/2003 Cook et al.
6,561,227 B1 5/2003 Cook et al.
6,561,279 B1 5/2003 MacKenzie et al.
6,564,875 B1 5/2003 Bullock
6,568,471 B1 5/2003 Cook et al.
6,568,488 B1 5/2003 Wentworth et al.
6,575,240 B1 6/2003 Cook et al.
6,578,630 B1 6/2003 Simpson et al.
6,585,053 B1 7/2003 Coon
6,591,905 B1 7/2003 Coon
6,598,677 B1 7/2003 Baugh et al.
6,598,678 B1 7/2003 Simpson
6,604,763 B1 8/2003 Cook et al.
6,607,220 B1 8/2003 Sivley
6,619,696 B1 9/2003 Baugh et al.
6,629,567 B1 10/2003 Lauritzen et al.
6,631,759 B1 10/2003 Cook et al.
6,631,760 B1 10/2003 Cook et al.
6,631,765 B1 10/2003 Baugh et al.
6,631,769 B1 10/2003 Cook et al.
6,634,431 B1 10/2003 Cook et al.
6,640,895 B1 11/2003 Murray
6,640,903 B1 11/2003 Cook et al.
6,648,075 B1 11/2003 Badrak et al.
6,668,937 B1 12/2003 Murray
6,672,759 B1 1/2004 Feger
6,679,328 B1 1/2004 Davis et al.
6,681,862 B1 1/2004 Freeman
6,684,947 B1 2/2004 Cook et al.
6,688,397 B1 2/2004 McClurkin et al.
6,695,012 B1 2/2004 Ring et al.
6,695,065 B1 2/2004 Simpson et al.
6,698,517 B1 3/2004 Simpson
6,705,395 B1 3/2004 Cook et al.
6,712,154 B1 3/2004 Cook et al.
6,719,064 B1 4/2004 Price-Smith et al.
6,722,427 B1 4/2004 Gano et al.
6,722,437 B1 4/2004 Vercaemer et al.
6,725,919 B1 4/2004 Cook et al.
6,725,934 B1 4/2004 Coronado et al.
6,725,939 B1 4/2004 Richard
6,732,806 B1 5/2004 Mauldin et al.
6,739,392 B1 5/2004 Cook et al.
6,745,845 B1 6/2004 Cook et al.
6,758,278 B1 7/2004 Cook et al.
6,796,380 B1 9/2004 Xu
6,814,147 B1 11/2004 Baugh
6,820,690 B1 11/2004 Vercaemer et al.
6,823,937 B1 11/2004 Cook et al.
6,832,649 B1 12/2004 Bode et al.
6,834,725 B1 12/2004 Whanger et al.
6,857,473 B1 2/2005 Cook et al.
2001/0002626 A1 6/2001 Frank et al.
2001/0020532 A1 9/2001 Baugh et al.
2001/0045284 A1 11/2001 Simpson et al.
2001/0047870 A1 12/2001 Cook et al.
2002/0011339 A1 1/2002 Murray
2002/0020524 A1 2/2002 Gano
2002/0020531 A1 2/2002 Ohmer
2002/0033261 A1 3/2002 Metcalfe
2002/0062956 A1 5/2002 Murray et al.
2002/0066576 A1 6/2002 Cook et al.
2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075338 A1 4/2003 Sivley
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0116325 A1 6/2003 Cook et al.
2003/0121550 A1 7/2003 Cook et al.
2003/0121669 A1 7/2003 Cook et al.
2003/0173090 A1 9/2003 Cook et al.
2003/0192705 A1 10/2003 Cook et al.
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0060706 A1 4/2004 Stephenson

| | | | |
|---|---|---|---|
| 2004/0065466 | A1 | 4/2004 | Tran et al. |
| 2004/0069499 | A1 | 4/2004 | Cook et al. |
| 2004/0112589 | A1 | 6/2004 | Cook et al. |
| 2004/0112606 | A1 | 6/2004 | Lewis et al. |
| 2004/0118574 | A1 | 6/2004 | Cook et al. |
| 2004/0123983 | A1 | 7/2004 | Cook et al. |
| 2004/0123988 | A1 | 7/2004 | Cook et al. |
| 2004/0188099 | A1 | 9/2004 | Cook et al. |
| 2004/0216873 | A1 | 11/2004 | Frost et al. |
| 2004/0231855 | A1 | 11/2004 | Cook et al. |
| 2004/0238181 | A1 | 12/2004 | Cook et al. |
| 2004/0244968 | A1 | 12/2004 | Cook et al. |
| 2005/0028988 | A1 | 2/2005 | Cook et al. |
| 2005/0039928 | A1 | 2/2005 | Cook et al. |
| 2005/0045324 | A1 | 3/2005 | Cook et al. |
| 2005/0045341 | A1 | 3/2005 | Cook et al. |
| 2005/0056433 | A1 | 3/2005 | Watson et al. |
| 2005/0056434 | A1 | 3/2005 | Ring et al. |
| 2005/0077051 | A1 | 4/2005 | Cook et al. |
| 2005/0081358 | A1 | 4/2005 | Cook et al. |
| 2005/0087337 | A1 | 4/2005 | Brisco et al. |

FOREIGN PATENT DOCUMENTS

| | | | |
|---|---|---|---|
| AU | 770008 | | 7/2004 |
| AU | 770359 | | 7/2004 |
| AU | 771884 | | 8/2004 |
| CA | 736288 | | 6/1966 |
| CA | 771462 | | 11/1967 |
| CA | 1171310 | | 7/1984 |
| DE | 174521 | | 4/1953 |
| DE | 2458188 | | 6/1975 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0 553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1152120 | A2 | 11/2001 |
| EP | 1152120 | A3 | 11/2001 |
| FR | 1325596 | | 4/1963 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 557823 | | 12/1973 |
| GB | 1448304 | | 9/1976 |
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211537 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374622 | B | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2344606 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |

| | | | |
|---|---|---|---|
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2390628 | B | 3/2004 |
| GB | 2391033 | B | 3/2004 |
| GB | 2392686 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2392932 | B | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2382367 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401136 | B | 12/2004 |
| GB | 2401137 | B | 12/2004 |
| GB | 2401138 | B | 12/2004 |
| GB | 2400624 | B | 2/2005 |
| GB | 2404676 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| JP | 208458 | | 10/1985 |
| JP | 6475715 | | 3/1989 |
| JP | 102875 | | 4/1995 |
| JP | 11-169975 | | 6/1999 |
| JP | 94068 | | 4/2000 |
| JP | 107870 | | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324772 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |

| | | | |
|---|---|---|---|
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1295799 | A1 | 2/1995 |
| WO | 8100132 | | 1/1981 |
| WO | 9005598 | | 3/1990 |
| WO | 9201859 | | 2/1992 |
| WO | 9208875 | | 5/1992 |
| WO | 9325799 | | 12/1993 |
| WO | 9325800 | | 12/1993 |
| WO | 9421887 | | 9/1994 |
| WO | 9425655 | | 11/1994 |
| WO | 9503476 | | 2/1995 |
| WO | 9601937 | | 1/1996 |
| WO | 9621083 | | 7/1996 |
| WO | 9626350 | | 8/1996 |
| WO | 9637681 | | 11/1996 |
| WO | 9706346 | | 2/1997 |
| WO | 9711306 | | 3/1997 |
| WO | 9717524 | | 5/1997 |
| WO | 9717526 | | 5/1997 |
| WO | 9717527 | | 5/1997 |
| WO | 9720130 | | 6/1997 |
| WO | 9721901 | | 6/1997 |
| WO | WO97/35084 | | 9/1997 |
| WO | 9800626 | | 1/1998 |
| WO | 9807957 | | 2/1998 |
| WO | 9809053 | | 3/1998 |
| WO | 9822690 | | 5/1998 |
| WO | 9826152 | | 6/1998 |
| WO | 9842947 | | 10/1998 |
| WO | 9849423 | | 11/1998 |
| WO | 9902818 | | 1/1999 |
| WO | 9904135 | | 1/1999 |
| WO | 9906670 | | 2/1999 |
| WO | 9908827 | | 2/1999 |
| WO | 9908828 | | 2/1999 |
| WO | 9918328 | | 4/1999 |
| WO | 9923354 | | 5/1999 |
| WO | 9925524 | | 5/1999 |
| WO | 9925951 | | 5/1999 |
| WO | 9935368 | | 7/1999 |
| WO | 9943923 | | 9/1999 |
| WO | 0001926 | | 1/2000 |
| WO | 0004271 | | 1/2000 |
| WO | 0008301 | | 2/2000 |
| WO | 0026500 | | 5/2000 |
| WO | 0026501 | | 5/2000 |
| WO | 0026502 | | 5/2000 |
| WO | 0031375 | | 6/2000 |
| WO | 0037767 | | 6/2000 |
| WO | 0037768 | | 6/2000 |
| WO | 0037771 | | 6/2000 |
| WO | 0037772 | | 6/2000 |
| WO | WO03/37766 | | 6/2000 |
| WO | 0039432 | | 7/2000 |
| WO | 0046484 | | 8/2000 |
| WO | 0050727 | | 8/2000 |
| WO | 0050732 | | 8/2000 |
| WO | 0050733 | | 8/2000 |
| WO | 0077431 | A2 | 12/2000 |
| WO | WO01/04520 | A1 | 1/2001 |
| WO | WO01/04535 | | 1/2001 |
| WO | WO01/18354 | A1 | 3/2001 |
| WO | WO01/33037 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/095181 | A1 | 5/2002 |
| WO | WO02/053867 | A2 | 7/2002 |
| WO | WO02/053867 | A3 | 7/2002 |
| WO | WO02/066783 | A1 | 8/2002 |
| WO | WO02/068792 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | | 12/2002 |
| WO | WO03/004819 | A2 | 1/2003 |
| WO | WO03/004819 | A3 | 1/2003 |
| WO | WO03/004820 | A3 | 1/2003 |
| WO | WO03/008756 | A1 | 1/2003 |
| WO | WO03004820 | A2 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO04/003337 | A1 | 1/2004 |
| WO | WO04/009950 | A1 | 1/2004 |
| WO | WO04/010039 | A2 | 1/2004 |
| WO | WO04/010039 | A3 | 1/2004 |
| WO | WO04/011776 | A2 | 2/2004 |
| WO | WO04/011776 | A3 | 2/2004 |
| WO | WO04/018823 | A3 | 3/2004 |
| WO | WO04/018824 | A2 | 3/2004 |
| WO | WO04/018824 | A3 | 3/2004 |
| WO | WO04/020895 | A2 | 3/2004 |
| WO | WO04/020895 | A3 | 3/2004 |

| | | | |
|---|---|---|---|
| WO | WO04/023014 | A2 | 3/2004 |
| WO | WOO4/023014 | A3 | 3/2004 |
| WO | WO04/026017 | A2 | 4/2004 |
| WO | WO04/026017 | A3 | 4/2004 |
| WO | WO04/026073 | A2 | 4/2004 |
| WO | WO04/026073 | A3 | 4/2004 |
| WO | WO04/026500 | A2 | 4/2004 |
| WO | WO04/026500 | A3 | 4/2004 |
| WO | WO04/027200 | A2 | 4/2004 |
| WO | WO04/027200 | A3 | 4/2004 |
| WO | WO04/027204 | A2 | 4/2004 |
| WO | WO04/027204 | A3 | 4/2004 |
| WO | WO04/027205 | A2 | 4/2004 |
| WO | WO04/027205 | A3 | 4/2004 |
| WO | WO04/027392 | A1 | 4/2004 |
| WO | WO04/027786 | A2 | 4/2004 |
| WO | WO04/027786 | A3 | 4/2004 |
| WO | WO04/053434 | A2 | 6/2004 |
| WO | WO04/053434 | A3 | 6/2004 |
| WO | WO04/057715 | A2 | 7/2004 |
| WO | WO04/057715 | A3 | 7/2004 |
| WO | WO04/067961 | A2 | 8/2004 |
| WO | WO04/067961 | A3 | 8/2004 |
| WO | WO04/074622 | A2 | 9/2004 |
| WO | WO04/074622 | A3 | 9/2004 |
| WO | WO04/076798 | A2 | 9/2004 |
| WO | WO04/076798 | A3 | 9/2004 |
| WO | WO04/081346 | A2 | 9/2004 |
| WO | WO04/083591 | A2 | 9/2004 |
| WO | WO04/083591 | A3 | 9/2004 |
| WO | WO04/083592 | A2 | 9/2004 |
| WO | WO04/083593 | A2 | 9/2004 |
| WO | WO04/083594 | A2 | 9/2004 |
| WO | WO04/085790 | A2 | 10/2004 |
| WO | WO04/089608 | A2 | 10/2004 |
| WO | WO04/092527 | A2 | 10/2004 |
| WO | WO04/092528 | A2 | 10/2004 |
| WO | WO04/092530 | A2 | 10/2004 |
| WO | WO04/092530 | A3 | 10/2004 |
| WO | WO04/094766 | A2 | 11/2004 |
| WO | WO05/017303 | A2 | 2/2005 |
| WO | WO05/021921 | A2 | 3/2005 |
| WO | WO05/021922 | A2 | 3/2005 |
| WO | WO05/024170 | A2 | 3/2005 |
| WO | WO05/024171 | A2 | 3/2005 |
| WO | WO05/028803 | A2 | 3/2005 |

OTHER PUBLICATIONS

Search Report to Application No. GB 0004285.3, Claims Search 2-3, 8-9, 13-16, Jan. 17, 2001.
Search Report to Application No. GB 0005399.1, Claims Searched 25-29, Feb. 15, 2001.
Search Report to Application No. GB 9930398.4, Claims Searched 1-35, Jun. 27, 2000.
International Search Report, Application No. PCT/US00/30022, Oct. 31, 2000.
International Search Report, Application No. PCT/US01/19014, Jun. 12, 2001.
Halliburton Energy Services, "Halliburton Completion Products" 1996, Page Packers 5-37, United States of America.
Turcotte and Schubert, Geodynamics (1982) John Wiley & Sons, Inc., pp 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
International Search Report, Application PCT/US01/04753, Jul. 3, 2001.
International Search Report, Application PCT/IL00/00245, Sep. 18, 2000.
International Search Report, Application PCT/US00/18635, Nov. 24. 2000.
International Search Report, Application PCT/US00/30022, Mar. 27, 2001.
International Search Report, Application PCT/US00/27645, Dec. 29, 2000.
International Search Report, Application PCT/US01/19014, Nov. 23, 2001.
International Search Report, Application PCT/US01/41446, Oct. 30, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US02/04353, Jun. 24, 2002.
International Search Report, Application PCT/US02/00677, Jul. 17, 2002.
International Search Report, Application PCT/US02/00093, Aug. 6, 2002.
International Search Report, Application PCT/US02/29856, Dec. 16, 2002.
International Search Report, Application PCT/US02/20256, Jan 3, 2003.
International Search Report, Application PCT/US02/39418, Mar. 24, 2003.
International Search Report, Application PCT/US03/15020; Jul. 30, 2003.
Search Report to Application No. GB 9926450.9, Feb. 28, 2000.
Search Report to Application No. GB 9926449.1, Mar. 27, 2000.
Search Report to Application No. GB 9930398.4, Jun. 27, 2000.
Search Report to Application No. GB 0004285.3, Jul. 12, 2000.
Search Report to Application No. GB 0003251.6, Jul. 13, 2000.
Search Report to Application No. GB. 0004282.0, Jul. 31, 2000.
Search Report to Application No. GB 0013661.4, Oct. 20, 2000.
Search Report to Application No. GB 0004282.0 Jan. 15, 2001.
Search Report to Application No. GB 0004285.3, Jan. 17, 2001.
Search Report to Application No. GB 0005399.1, Feb. 15, 2001.
Search Report to Application No. GB 0013661.4, Apr. 17, 2001.

Examination Report to Application No. GB 9926450.9, May 15, 2002.
Search Report to Application No. GB 9926449.1 Jul. 4, 2001.
Search Report to Application No. GB 9926449.1 Sep. 5, 2001.
Search Report to Application No. 1999 5593, Aug. 20, 2002.
Search Report to Application No. GB 0004285.3 Aug. 28, 2002.
Examination Report to Application No. GB 9926450.9, Nov. 22, 2002.
Search Report to Application No. GB 0219757.2, Nov. 25, 2002.
Search Report to Application No. GB 0220872.6, Dec. 5, 2002.
Search Report to Application No. GB 0219757.2, Jan. 20, 2003.
Search Report to Application No. GB 0013661.4, Feb. 19, 2003.
Search Report to Application No. GB 0225505.7, Mar. 5, 2003.
Search Report to Application No. GB 0220872.6 Mar. 13, 2003.
Examination Report to Application No. 0004285.3, Mar. 28, 2003.
Examination Report to Application No. GB 0208367.3, Apr. 4, 2003.
Examination Report to Application No. GB 0212443.6, Apr. 10, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308295.5 Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308303.7, Jun. 2, 2003.
Search and Examination Report to Application No. GB 0308290.6, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0310757.0, Jun. 12, 2003.
Search and Examination Report to Application No. GB 0310836.2, Jun. 12, 2003.
Search and Examination Report to Application No. GB 0310785.1, Jun. 12, 2003.
Search and Examination Report to Application No. GB 0310759.6, Jun. 12, 2003.
Search and Examination Report to Application No. GB 0310801.6, Jun. 12, 2003.
Search and Examination Report to Application No. GB 0310772.9, Jun. 12, 2003.
Search and Examination Report to Application No. GB 0310795.0, Jun. 12, 2003.
Search and Examination Report to Application No. GB 0310833.9, Jun. 12, 2003.
Search and Examination Report to Application No. GB 0310799.2, Jun. 12, 2003.
Search and Examination Report to Application No. GB 0310797.6, Jun. 12, 2003.
Search and Examination Report to Application No. GB 0310770.3, Jun. 12, 2003.
Search and Examination Report to Application No. GB 0310099.7, Jun. 24, 2003.
Search and Examination Report to Application No. GB 0310104.5, Jun. 24, 2003.
Search and Examination Report to Application No. GB 0310101.1, Jun. 24, 2003.
Search and Examination Report to Application No. GB 0310118.5, Jun. 24, 2003.
Search and Examination Report to Application No. GB 0310090.6, Jun. 24, 2003.
Search and Examination Report to Application No. GB 0225505.7, Jul. 1, 2003.
Examination Report to Application No. GB 0310836.2, Aug. 7, 2003.
Power Ultrasonics, "Design and Optimisation of an Ultrasonic Die System For Form" Chris Cheers (1999, 2000).
Research Area- Sheet Metal Forming- Superposition of Vibra; Fraunhofer IWU (2001).
Research Projects; "Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including . . " (2004).
www.tribtech.com. "Trib-gel A Chemical Cold Welding Agent" G R Linzell (Sep. 14, 1999).
www/spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automative Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/US02/00677, Feb. 24, 2004.
International Search Report, Application PCT/US02/20477; Oct. 31, 2003.

International Search Report, Application PCT/US02/20477; Apr. 6, 2004.
International Search Report, Application PCT/US02/24399; Feb. 27, 2004.
International Search Report, Application PCT/US02/25608; May 24, 2004.
International Search Report, Application PCT/US02/25727; Feb. 19, 2004.
Internatioal Search Report, Application PCT/US02/36157; Sep. 29, 2003.
International Search Report, Application PCT/US02/36157; Apr. 14, 2004.
International Search Report, Application PCT/US02/36267; May 21, 2004.
International Search Report, Application PCT/US02/39425; May 28, 2004.
International Search Report, Application PCT/US03/00609, May 20 2004.
International Search Report, Application PCT/US03/04837, May 28, 2004.
International Search Report, Application PCT/US03/06544, Jun. 9, 2004.
International Search Report, Application PCT/US03/10144; Oct. 31, 2003.
International Search Report, Application PCT/US03/11765; Nov. 13, 2003.
International Search Report, Application PCT/US03/13787; May 28, 2004.
International Search Report, Application PCT/US03/14153; May 28, 2004.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Search Report, Application PCT/US03/25677; May 21, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29858; Jun. 30, 2003.
International Search Report, Application PCT/US03/29859; May 21, 2004.
International Search Report, Application PCT/US03/38550; Jun. 15, 2004.
Search and Examination Report to Application No. GB 0004282.0, Jun. 3, 2003.
Search Report to Application No. GB 0004285:3, Jan. 19, 2001.
Examination Report to Application No. GB 0005399.1; Jul. 24, 2000.
Examination Report to Application No. GB 0005399.1; Oct. 14, 2002.
Examination Report to Application No. GB 0013661.4, Nov. 25, 2003.
Search Report to Application No. GB 0013661.4, Oct 20, 2003.
Examination Report to Application No. GB 0208367.3, Nov. 4, 2004.
Examination Report to Application No. GB 0208367.3, Nov. 17, 2003.
Examination Report to Application No. GB 0208367.3, Jan. 30, 2004.
Examination Report to Application No. GB 0216409.3, Feb. 9, 2004.
Examination Report to Application No. GB 0219757.2 May 10, 2004.
Examination Report to Application No. GB 0300085.8, Nov. 28, 2003.
Examination Report to Application No. GB 030086.6, Dec. 1, 2003.
Examination Report to Application No. GB 0314846.7, Jul. 15, 2004.
Search and Examination Report to Application No. GB 0308293.0, Jul. 14, 2003.
Search and Examination Report to Application No. GB 0308294.8, Jul. 14, 2003.
Search and Examination Report to Application No. GB 0308295.5, Jul. 14, 2003.
Search and Examination Report to Application No. GB 0308296.3, Jul. 14, 2003.
Search and Examination Report to Application No. GB 0308297.1, Jul. 2003.
Search and Examination Report to Application No. GB 0308303.7, Jul. 14, 2003.
Examination Report to Application No. 0311596.1, May 18, 2004.
Search and Examination Report to Application No. GB 0313406.1, Sep. 3, 2003.
Search and Examination Report to Application No. GB 0316883.8, Nov. 25, 2003.
Search and Examination Report to Application No. GB 0316886.1, Nov. 25, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.

Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0404796.5; May 20, 2004.
Search and Examination Report to Application No. GB 0404826.0, Apr. 21, 2004.
Search and Examination Report to Application No. GB 0404828.6; Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4 May 20, 2004.
Examination Report to Application No. 0408672.4, Jul. 12, 2004.
Search and Examination Report to Application No. GB 0411894.9 Jun. 30, 2004.
Search Report to Application No. GB 9926449.1, Jul. 4, 2001.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25727; May 17, 2004.
Written Opinion to Application No. PCT/US02/39418; Jun. 9, 2004.
Written Opinion to Application No. PCT/US03/11765 May 11, 2004.
International Examination Report, Application PCT/US02/24399, Aug. 6, 2004.
Examination Report, Application PCT/US02/25727; Jul. 7, 2004.
Examination Report, Application PCT/US03/10144; Jul. 7, 2004.
International Examination Report, Application PCT/US03/11765; Dec. 10, 2004.
International Search Report, Application PCT/US03/20870; Sep. 30, 2004.
International Examination Report, Application PCT/US03/25676, Aug. 17, 2004.
International Examination Report, Application PCT/US03/25677, Aug. 17, 2004.
International Search Report, Application PCT/US03/25742; Dec. 20, 2004.
International Examination Report, Application PCT/US03/29460; Dec. 8, 2004.
International Examination Report, Application PCT/US03/29859, Aug. 16, 2004.
Examination Report to Application GB 0220872.6, Oct. 29, 2004.
Examination Report to Application No. GB 0225505.7, Oct. 27, 2004.
Examination Report to Application No. GB 0306046.4 Sep. 10, 2004.
Examination Report to Application No. GB 0400018.8; Oct. 29, 2004.
Examination Report to Application No. GB 0400019.6; Oct. 29, 2004.
Search and Examination Report to Application No. GB 0404833.6, Aug. 19, 2004.
Examination Report to Application No. GB 0404837.7, Jul. 12, 2004.
Examination Report to Application No. GB 0408672.4, Jul. 12, 2004.
Examination Report to Application No. GB 0404830.2, Aug. 17, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search Report to Application No. GB 0415835.8, Dec. 2, 2004.
Search and Examination Report to Application No. GB 0416834.0 Aug. 11, 2004.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.

Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US01/19014; Dec. 10, 2002.
International Examination Report, Application PCT/US03/13787; Mar. 2, 2005.
Search Report to Application No. EP 02806451.7; Feb. 9, 2005.
Examination Report to Application No. GB 0403891.5 Feb. 14, 2005.
Examination Report to Application No. GB 0403894.9 Feb. 15, 2005.
Examination Report to Application No. GB 0403921.0, Feb. 15, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
International Examination Report, Application PCT/US03/13787; Apr. 7, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
Examination Report to Application No. GB 0403893.1, Feb. 14, 2005.
Examination Report to Application No. GB 0403920.2 Feb. 15, 2005.
Examination Report to Application No. GB 0408672.4 Mar. 21, 2005.
Examination Report to Application No. GB 0411892.3, Feb. 21, 2005.
Search Report to Application No. GB 0415835.8; Mar. 10, 2005.
Search and Examination Report to Application No. GB 0503470.7 Mar. 21, 2005.
Written Opinion to Application No. PCT/US02/25675 Nov. 24, 2004.
Written Opinion to Application No. PCT/US02/39425; Nov. 22, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Written Opinion to Application No. PCT/US03/38550 Dec. 10, 2004.
Combined Search Report and Written Opinion to Application No. PCT/US04/08030 Jan. 6, 2005.
Combined Search Report and Written Opinion to Application No. PCT/US04/02122 Feb. 24, 2005.
Combined Search Report and Written Opinion to Application No. PCT/US04/08073 Mar. 4, 2005.
Combined Search Report and Written Opinion to Application No. PCT/US04/28438 Mar. 14, 2005.
Combined Search Report and Written Opinion to Application No. PCT/US04/00631; Mar. 28, 2005.
Written Opinion to Application No. PCT/US02/39425; Apr. 11, 2005.
Written Opinion to Application No. PCT/US04/08171 May 5, 2005.
Letter From Baker Oil Tools to William Norvell in Regards to Enventure's Claims of Baker Infringement Of Enventure's Expandable Patents Apr. 1, 2005.

* cited by examiner

WELLBORE CASING REPAIR

CROSS REFERENCE TO RELATED APPLICATIONS

This application is related to the following co-pending U.S. patent applications:

| Provisional patent application Ser. No. | Attorney Docket No. | Filing Date |
|---|---|---|
| 60/108,558 | 25791.9 | Nov. 16, 1998 |
| 60/111,293 | 25791.3 | Dec. 7, 1998 |
| 60/119,611 | 25791.8 | Feb. 11, 1999 |
| 60/121,702 | 25791.7 | Feb. 25, 1999 |
| 60/121,841 | 25791.12 | Feb. 26, 1999 |
| 60/121,907 | 25791.16 | Feb. 26, 1999 |
| 60/124,042 | 25791.11 | Mar. 11, 1999 |
| 60/131,106 | 25791.23 | Apr. 26, 1999 |
| 60/137,998 | 25791.17 | Jun. 7, 1999 |
| 60/143,039 | 25791.26 | Jul. 9, 1999 |
| 60/146,203 | 25791.25 | Jul. 29, 1999 |
| 60/154,047 | 25791.29 | Sep. 16, 1999 |
| 60/159,082 | 25791.34 | Oct. 12, 1999 |
| 60/159,039 | 25791.36 | Oct. 12, 1999 |
| 60/159,033 | 25791.37 | Oct. 12, 1999 |

Applicants incorporate by reference the disclosures of these applications.

This application is a National Phase of the International Application No. PCT/US00/30022 based on U.S. Provisional application Ser. No. 60/162,671, filed on Nov. 1, 1999.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

Conventionally, when an opening is formed in the sidewalls of an existing wellbore casing, whether through damage to the casing or because of an intentional perforation of the casing to facilitate production or a fracturing operation, it is often necessary to seal off the opening in the existing wellbore casing. Conventional methods of sealing off such openings are expensive and unreliable.

The present invention is directed to overcoming one or more of the limitations of the existing procedures for forming and repairing wellbores.

SUMMARY OF THE INVENTION

According to one aspect of the present invention, a method of repairing an opening in a tubular member is provided that includes positioning an expandable tubular, an expansion cone, and a pump within the tubular member, positioning the expandable tubular in opposition to the opening in the tubular member, pressurizing an interior portion of the expandable tubular using the pump, and radially expanding the expandable tubular into intimate contact with the tubular member using the expansion cone.

According to another aspect of the present invention, an apparatus for repairing a tubular member is provided that includes a support member, an expandable tubular member removably coupled to the support member, an expansion cone movably coupled to the support member and a pump coupled to the support member adapted to pressurize a portion of the interior of the expandable tubular member.

According to another aspect of the present invention, a method of coupling a first tubular member to a second tubular member, wherein the outside diameter of the first tubular member is less than the inside diameter of the second tubular member, is provided that includes positioning at least a portion of the first tubular member within the second tubular member, pressurizing a portion of the interior of the first tubular member by pumping fluidic materials proximate the first tubular member into the portion of the interior of the first tubular member, and displacing an expansion cone within the interior of the first tubular member.

DETAILED DESCRIPTION OF THE ILLUSTRATIVE EMBODIMENT

An apparatus and method for repairing a wellbore casing within a subterranean formation is provided. The apparatus and method permits a wellbore casing to be repaired in a subterranean formation by placing a tubular member, an expansion cone, and a pump in an existing section of a wellbore, and then extruding the tubular member off of the expansion cone by pressurizing an interior portion of the tubular member using the pump. The apparatus and method further permits adjacent tubular members in the wellbore to be joined using an overlapping joint that prevents fluid and or gas passage. The apparatus and method further permits a new tubular member to be supported by an existing tubular member by expanding the new tubular member into engagement with the existing tubular member. The apparatus and method further minimizes the reduction in the hole size of the wellbore casing necessitated by the addition of new sections of wellbore casing. The apparatus and method provide an efficient and reliable method for forming and repairing wellbore casings, pipelines, and structural supports.

The apparatus and method preferably further includes a lubrication and self-cleaning system for the expansion cone. In a preferred implementation, the expansion cone includes one or more circumferential grooves and one or more axial grooves for providing a supply of lubricating fluid to the trailing edge portion of the interface between the expansion cone and a tubular member during the radial expansion process. In this manner, the frictional forces created during the radial expansion process are reduced which results in a reduction in the required operating pressures for radially expanding the tubular member. Furthermore, the supply of lubricating fluid preferably removes loose material from tapered end of the expansion cone that is formed during the radial expansion process.

The apparatus and method preferably further includes an expandable tubular member that includes pre-expanded ends. In this manner, the subsequent radial expansion of the expandable tubular member is optimized.

The apparatus and method preferably further includes an expansion cone for expanding the tubular member includes a first outer surface having a first angle of attack and a second outer surface having a second angle of attack less than the first angle of attack. In this manner, the expansion of tubular members is optimally provided.

In several alternative embodiments, the apparatus and methods are used to form and/or repair wellbore casings, pipelines, and/or structural supports.

Figure 1:
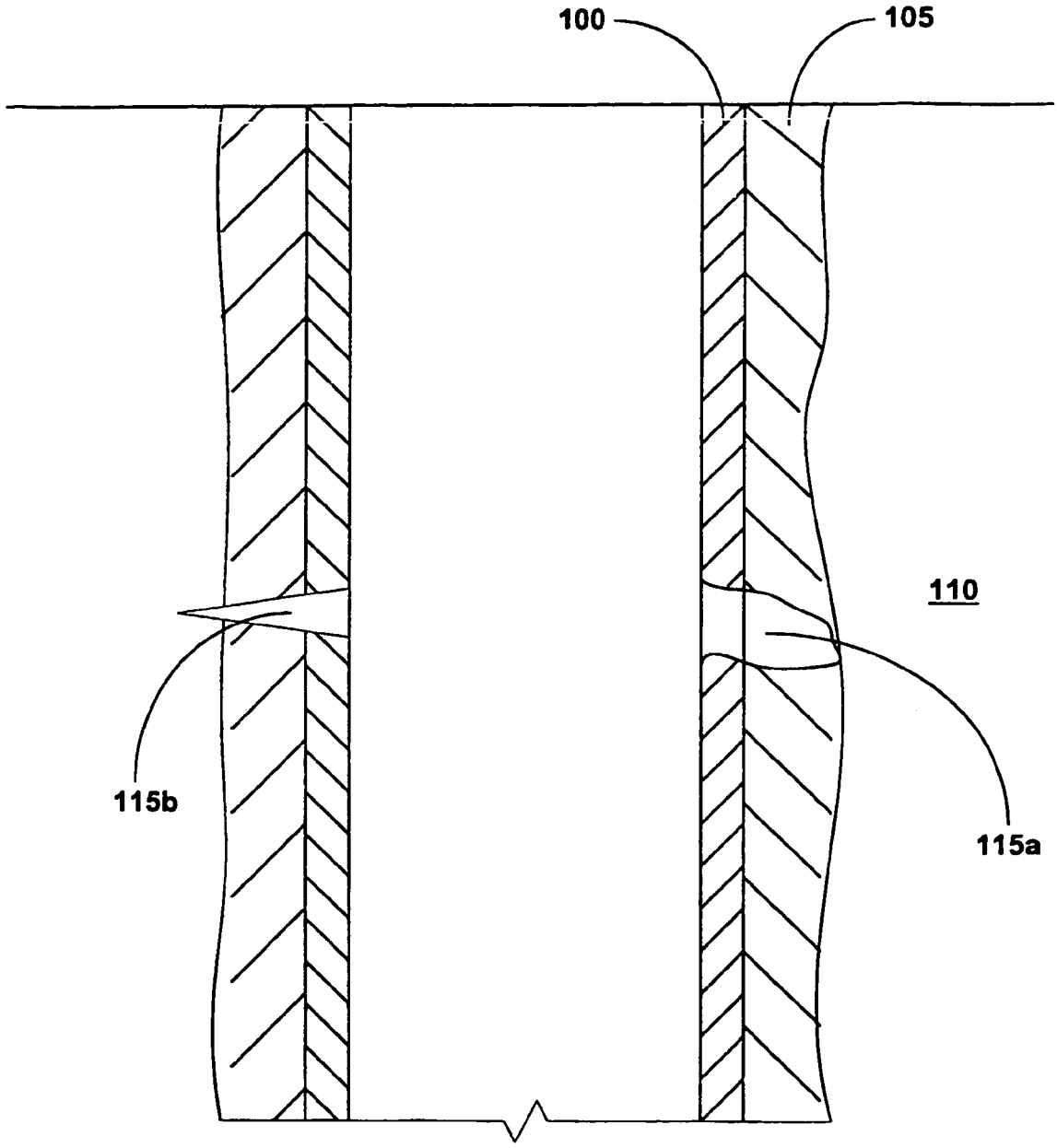
FIG. 1 is a fragmentary cross-sectional view of a wellbore casing including one or more openings.

Referring initially to FIG. 1, a wellbore casing 100 having an outer annular layer 105 of a sealing material is positioned within a subterranean formation 110. The wellbore casing 100 may be positioned in any orientation from vertical to horizontal. The wellbore casing 100 further includes one or more openings 115*a* and 115*b*. The openings 115 may, for example, be the result of: defects in the wellbore casing 100, intentional perforations of the casing to facilitate production, thin walled sections of casing caused by drilling and/or wireline wear, or fracturing operations. As will be recognized by persons having ordinary skill in the art, such openings 115 in a wellbore 100 can seriously adversely impact the subsequent production of oil and gas from the subterranean formation 110 unless they are sealed off. More generally, the wellbore casing 115 may include thin walled sections that need cladding in order to prevent a catastrophic failure.

Figure 2:
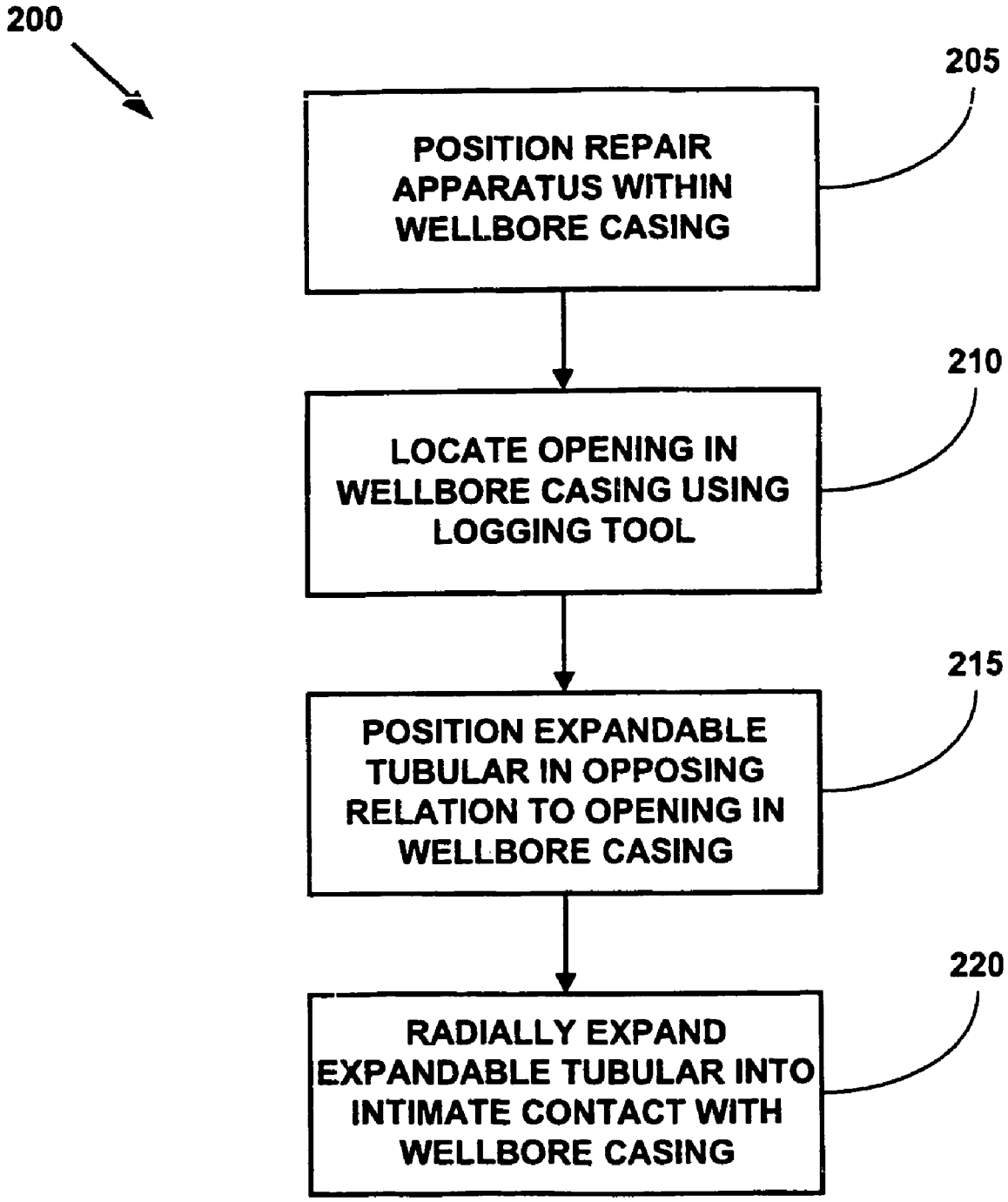
FIG. 2 is a flow chart illustration of an embodiment of a method for repairing the wellbore casing of FIG. 1.

Referring to FIG. 2, a preferred embodiment of a method 200 for repairing a defect in a wellbore casing using a repair apparatus having a logging tool, a pump, an expansion cone, and an expandable tubular member includes the steps of: (1) positioning the repair apparatus within the wellbore casing in step 205; (2) locating the defect in the wellbore casing using the logging tool of the repair apparatus in step 210; (3) positioning the expandable tubular member in opposition to the defect in the wellbore casing in step 215; and (4) radially expanding the expandable tubular member into intimate contact with the wellbore casing by pressurizing a portion of the expandable tubular member using the pump and extruding the expandable tubular member off of the expansion cone in step 220. In this manner, defects in a wellbore casing are repaired by a compact and self-contained repair apparatus that is positioned downhole. More generally, the repair apparatus is used to repair defects in wellbore casings, pipelines, and structural supports.

Figure 3A:
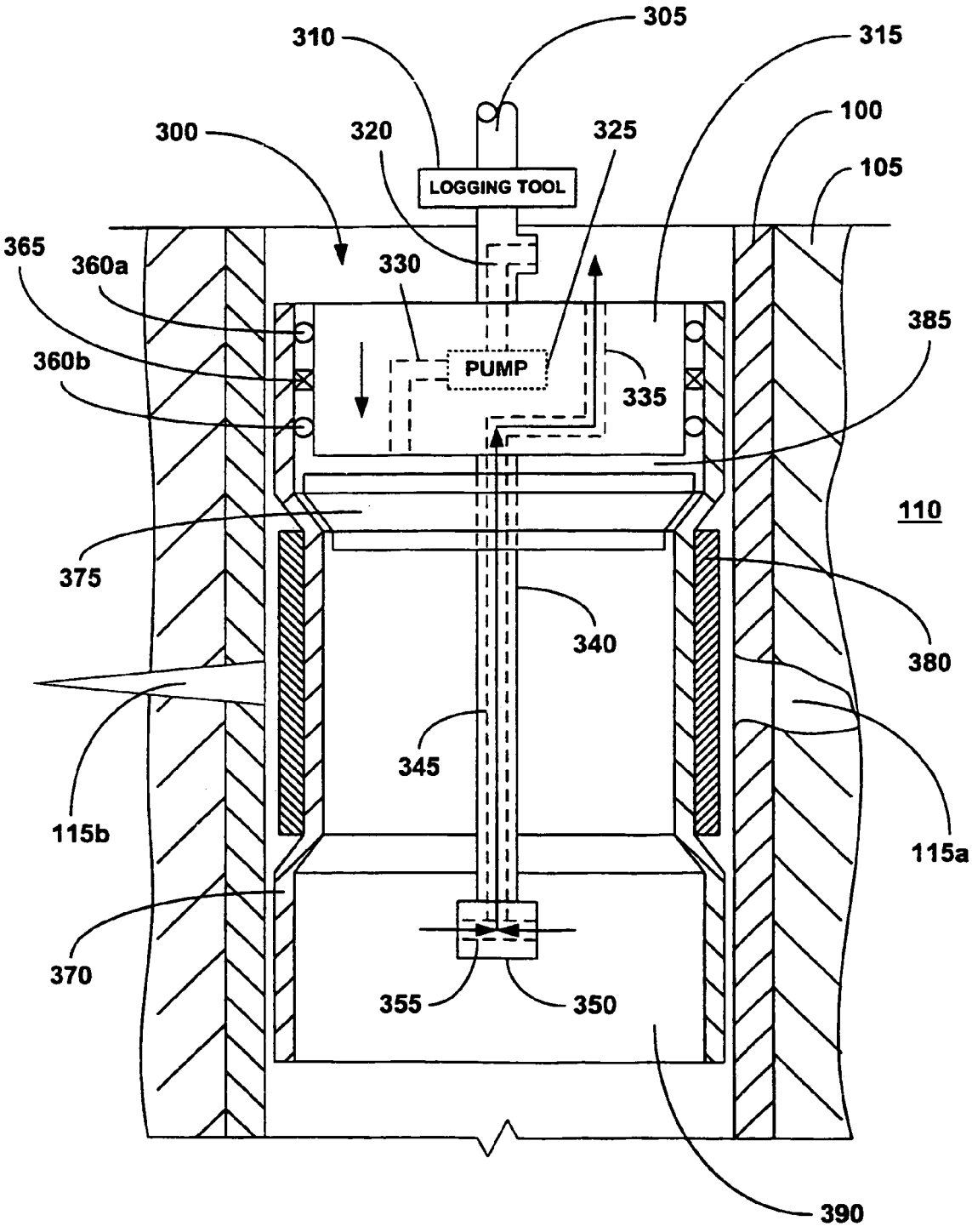
FIG. 3*a* is a fragmentary cross-sectional view of the placement of an embodiment of a repair apparatus within the wellbore casing of FIG. 1 wherein the expandable tubular member of the apparatus is positioned opposite the openings in the wellbore casing.

As illustrated in FIG. 3*a*, in a preferred embodiment, in step 205, a repair apparatus 300 is positioned within the wellbore casing 100.

In a preferred embodiment, the repair apparatus 300 includes a first support member 305, a logging tool 310, a housing 315, a first fluid conduit 320, a pump 325, a second fluid conduit 330, a third fluid conduit 335, a second support member 340, a fourth fluid conduit 345, a third support member 350, a fifth fluid conduit 355, sealing members 360, a locking member 365, an expandable tubular 370, an expansion cone 375, and a sealing member 380.

The first support member 305 is preferably coupled to the logging tool 310 and the housing 315. The first support member 305 is preferably adapted to be coupled to and supported by a conventional support member such as, for example, a wireline, coiled tubing, or a drill string. The first support member 305 preferably has a substantially annular cross section in order to provide one or more conduits for conveying fluidic materials from the repair apparatus 300. The first support member 305 is further preferably adapted to convey electrical power and communication signals to the logging tool 310, the pump 325, and the locking member 365.

The logging tool 310 is preferably coupled to the first support member 305. The logging tool 310 is preferably adapted to detect defects in the wellbore casing 100. The logging tool 310 may be any number of conventional commercially available logging tools suitable for detecting defects in wellbore casings, pipelines, or structural supports. In a preferred embodiment, the logging tool 310 is a CAST logging tool, available from Halliburton Energy Services in order to optimally provide detection of defects in the wellbore casing 100. In a preferred embodiment, the logging tool 310 is contained within the housing 315 in order to provide an repair apparatus 300 that is rugged and compact.

The housing 315 is preferably coupled to the first support member 305, the second support member 340, the sealing members 360, and the locking member 365. The housing 315 is preferably releasably coupled to the tubular member 370. The housing 315 is further preferably adapted to contain and/or support the logging tool 310 and the pump 325.

The first fluid conduit 320 is preferably fluidicly coupled to the inlet of the pump 325 and the exterior region above the housing 315. The first fluid conduit 320 may be contained within the first support member 305 and the housing 315. The first fluid conduit 320 is preferably adapted to convey fluidic materials such as, for example, drilling muds, water, and lubricants at operating pressures and flow rates ranging from about 0 to 12,000 psi and 0 to 500 gallons/minute in order to optimally propagate the expansion cone 375.

The pump 325 is fluidicly coupled to the first fluid conduit 320 and the second fluid conduit 330. The pump 325 is further preferably contained within and supported by the housing 315. Alternatively, the pump 325 may be positioned above the housing 315. The pump 325 is preferably adapted to convey fluidic materials from the first fluid conduit 320 to the second fluid conduit 330 at operating pressures and flow rates ranging from about 0 to 12,000 psi and 0 to 500 gallons/minute in order to optimally provide the operating pressure for propagating the expansion cone 375. The pump 325 may be any number of conventional commercially available pumps. In a preferred embodiment, the pump 325 is a flow control pump out section for dirty fluids, available from Halliburton Energy Services in order to optimally provide the operating pressures and flow rates for propagating the expansion cone 375. The pump 325 is preferably adapted to pressurize an interior portion 385 of the expandable tubular member 370 to operating pressures ranging from about 0 to 12,000 psi.

The second fluid conduit 330 is fluidicly coupled to the outlet of the pump 325 and the interior portion 385 of the expandable tubular member 370. The second fluid conduit 330 is further preferably contained within the housing 315. The second fluid conduit 330 is preferably adapted to convey fluidic materials such as, for example, drilling muds, water, and lubricants at operating pressures and flow rates ranging from about 0 to 12,000 psi and 0 to 500 gallons/minute in order to optimally propagate the expansion cone 375.

The third fluid conduit 335 is fluidicly coupled to the exterior region above the housing 315 and the interior portion 385 of the expandable tubular member 370. The third fluid conduit 335 is further preferably contained within the housing 315. The third fluid conduit 330 is preferably adapted to convey fluidic materials such as, for example, drilling muds, water, and lubricants at operating pressures and flow rates ranging from about 0 to 12,000 psi and 0 to 500 gallons/minute in order to optimally propagate the expansion cone 375.

The second support member 340 is coupled to the housing 315 and the third support member 350. The second support member 340 is further preferably movably and sealingly coupled to the expansion cone 375. The second support member 340 preferably has a substantially annular cross section in order to provide one or more conduits for conveying fluidic materials. In a preferred embodiment, the second support member 340 is centrally positioned within the expandable tubular member 370.

The fourth fluid conduit 345 is fluidicly coupled to the third fluid conduit 335 and the fifth fluid conduit 355. The fourth fluid conduit 345 is further preferably contained within the second support member 340. The fourth fluid conduit 345 is preferably adapted to convey fluidic materials such as, for example, drilling muds, water, and lubricants at operating pressures and flow rates ranging from about 0 to 12,000 psi and 0 to 500 gallons/minute in order to optimally propagate the expansion cone 375.

The third support member 350 is coupled to the second support member 340. The third support member 350 is further preferably adapted to support the expansion cone 375. The third support member 350 preferably has a substantially annular cross section in order to provide one or more conduits for conveying fluidic materials.

The fifth fluid conduit 355 is fluidicly coupled to the fourth fluid conduit 345 and a portion 390 of the expandable tubular member 375 below the expansion cone 375. The fifth fluid conduit 355 is further preferably contained within the third support member 350. The fifth fluid conduit 355 is preferably adapted to convey fluidic materials such as, for example, drilling muds, water, and lubricants at operating pressures and flow rates ranging from about 0 to 12,000 psi and 0 to 500 gallons/minute in order to optimally propagate the expansion cone 375.

The sealing members 360 are preferably coupled to the housing 315. The sealing members 360 are preferably adapted to seal the interface between the exterior surface of the housing 315 and the interior surface of the expandable tubular member 370. In this manner, the interior portion 385 of the expandable tubular member 375 is fluidicly isolated from the exterior region above the housing 315. The sealing members 360 may be any number of conventional commercially available sealing members. In a preferred embodiment, the sealing members 360 are conventional O-ring sealing members available from various commercial suppliers in order to optimally provide a high pressure seal.

The locking member 365 is preferably coupled to the housing 315. The locking member 365 is further preferably releasably coupled to the expandable tubular member 370. In this manner, the housing 365 is controllably coupled to the expandable tubular member 370. In this manner, the housing 365 is preferably released from the expandable tubular member 370 upon the completion of the radial expansion of the expandable tubular member 370. The locking member 365 may be any number of conventional commercially available releasable locking members. In a preferred embodiment, the locking member 365 is an electrically releasable locking member in order to optimally provide an easily retrievable running expansion system.

In an alternative embodiment, the locking member 365 is replaced by or supplemented by one or more conventional shear pins in order to provide an alternative means of controllably releasing the housing 315 from the expandable tubular member 370.

The expandable tubular member 370 is releasably coupled to the locking member 365. The expandable tubular member 370 is preferably adapted to be radially expanded by the axial displacement of the expansion cone 375.

Figure 4:
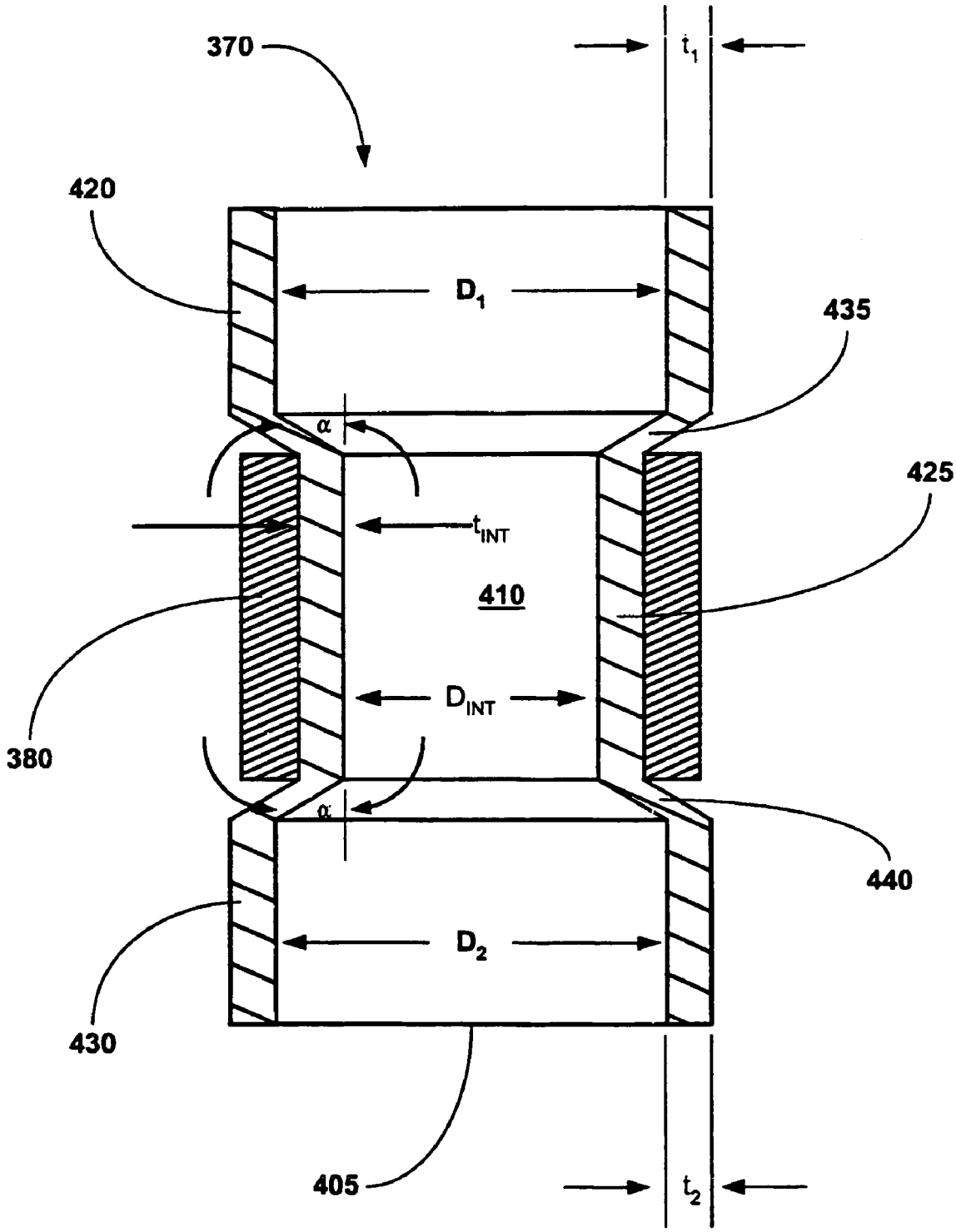
FIG. 4 is a cross-sectional illustration of an embodiment of the expandable tubular of the apparatus of FIG. 3*a*

In a preferred embodiment, as illustrated in FIG. 4, the expandable tubular member 370 includes a tubular body 405 having an interior region 410, an exterior surface 415, a first end 420, an intermediate portion 425, and a second end 430. The tubular member 370 further preferably includes the sealing member 380.

The tubular body 405 of the tubular member 370 preferably has a substantially annular cross section. The tubular body 405 may be fabricated from any number of conventional commercially available materials such as, for example, Oilfield Country Tubular Goods (OCTG), 13 chromium steel, 4140 steel, or automotive grade steel tubing/casing, or L83, J55, or P110 API casing. In a preferred embodiment, the tubular body 405 of the tubular member 370 is further provided substantially as disclosed in one or more of the following co-pending U.S. patent applications:

| Provisional patent application Ser. No. | Attorney Docket No. | Filing Date |
|---|---|---|
| 60/108,558 | 25791.9 | Nov. 16, 1998 |
| 60/111,293 | 25791.3 | Dec. 7, 1998 |
| 60/119,611 | 25791.8 | Feb. 11, 1999 |
| 60/121,702 | 25791.7 | Feb. 25, 1999 |
| 60/121,841 | 25791.12 | Feb. 26, 1999 |
| 60/121,907 | 25791.16 | Feb. 26, 1999 |
| 60/124,042 | 25791.11 | Mar. 11, 1999 |
| 60/131,106 | 25791.23 | Apr. 26, 1999 |
| 60/137,998 | 25791.17 | Jun. 7, 1999 |
| 60/143,039 | 25791.26 | Jul. 9, 1999 |
| 60/146,203 | 25791.25 | Jul. 29, 1999 |
| 60/154,047 | 25791.29 | Sep. 16, 1999 |
| 60/159,082 | 25791.34 | Oct. 12, 1999 |
| 60/159,039 | 25791.36 | Oct. 12, 1999 |
| 60/159,033 | 25791.37 | Oct. 12, 1999 |

Applicants incorporate by reference the disclosures of these applications.

The interior region 410 of the tubular body 405 preferably has a substantially circular cross section. The interior region 410 of the tubular body 405 preferably includes a first inside diameter $D_1$, an intermediate inside diameter $D_{INT}$, and a second inside diameter $D_2$. In a preferred embodiment, the first and second inside diameters, $D_1$ and $D_2$, are substantially equal. In a preferred embodiment, the first and second inside diameters, $D_1$ and $D_2$; are greater than the intermediate inside diameter $D_{INT}$.

The first end 420 of the tubular body 405 is coupled to the intermediate portion 425 of the tubular body 405. The exterior surface of the first end 420 of the tubular body 405 preferably further includes a protective coating fabricated from tungsten carbide, or other similar wear resistant materials in order to protect the first end 420 of the tubular body 405 during placement of the repair apparatus 300 within the wellbore casing 100. In a preferred embodiment, the outside diameter of the first end 420 of the tubular body 405 is greater than the outside diameter of the intermediate portion 425 of the tubular body 405. In this manner, the sealing member 380 is optimally protected during placement of the tubular member 370 within the wellbore casing 100. In a preferred embodiment, the outside diameter of the first end 420 of the tubular body 405 is substantially equal to the outside diameter of the second end 430 of the tubular body 405. In this manner, the sealing member 380 is optimally protected during placement of the tubular member 370 within the wellbore casing 100. In a preferred embodiment, the outside diameter of the first end 420 of the tubular member 370 is adapted to permit insertion of the tubular member 370 into the typical range of wellbore casings. The first end 420 of the tubular member 370 includes a wall thickness $t_1$.

The intermediate portion 425 of the tubular body 405 is coupled to the first end 420 of the tubular body 405 and the second end 430 of the tubular body 405. The intermediate portion 425 of the tubular body 405 preferably includes the sealing member 380. In a preferred embodiment, the outside diameter of the intermediate portion 425 of the tubular body 405 is less than the outside diameter of the first and second ends, 420 and 430, of the tubular body 405. In this manner, the sealing member 380 is optimally protected during placement of the tubular member 370 within the wellbore casing 100. In a preferred embodiment, the outside diameter of the intermediate portion 425 of the tubular body 405 ranges from about 75% to 98% of the outside diameters of the first and second ends, 420 and 430, in order to optimally protect the sealing member 380 during placement of the tubular member 370 within the wellbore casing 100. The intermediate portion 425 of the tubular body 405 includes a wall thickness $t_{INT}$.

The second end 430 of the tubular body 405 is coupled to the intermediate portion 425 of the tubular body 405. The exterior surface of the second end 430 of the tubular body 405 preferably further includes a protective coating fabricated from a wear resistant material such as, for example, tungsten carbide in order to protect the second end 430 of the tubular body 405 during placement of the repair apparatus 300 within the wellbore casing 100. In a preferred embodiment, the outside diameter of the second end 430 of the tubular body 405 is greater than the outside diameter of the intermediate portion 425 of the tubular body 405. In this manner, the sealing member 380 is optimally protected during placement of the tubular member 370 within a wellbore casing 100. In a preferred embodiment, the outside diameter of the second end 430 of the tubular body 405 is substantially equal to the outside diameter of the first end 420 of the tubular body 405. In this manner, the sealing member 380 is optimally protected during placement of the tubular member 370 within the wellbore casing 100. In a preferred embodiment, the outside diameter of the second end 430 of the tubular member 370 is adapted to permit insertion of the tubular member 370 into the typical range of wellbore casings. The second end 430 of the tubular member 370 includes a wall thickness $t_2$.

In a preferred embodiment, the wall thicknesses $t_1$ and $t_2$ are substantially equal in order to provide substantially equal burst strength for the first and second ends, 420 and 430, of the tubular member 370. In a preferred embodiment, the wall thicknesses $t_1$ and $t_2$ are both greater than the wall thickness $t_{INT}$ in order to optimally match the burst strength of the first and second ends, 420 and 430, of the tubular member 370 with the intermediate portion 425 of the tubular member 370.

The sealing member 380 is preferably coupled to the outer surface of the intermediate portion 425 of the tubular body 405. The sealing member 380 preferably seals the interface between the intermediate portion 425 of the tubular body 405 and interior surface of the wellbore casing 100 after radial expansion of the intermediate portion 425 of the tubular body 405. The sealing member 380 preferably has a substantially annular cross section. The outside diameter of the sealing member 380 is preferably selected to be less than the outside diameters of the first and second ends, 420 and 430, of the tubular body 405 in order to optimally protect the sealing member 380 during placement of the tubular member 370 within the typical range of wellborn casings 100. The sealing member 380 may be fabricated from any number of conventional commercially available materials such as, for example, thermoset or thermoplastic polymers. In a preferred embodiment, the sealing member 380 is fabricated from thermoset polymers in order to optimally seal the interface between the radially expanded intermediate portion 425 of the tubular body 405 and the wellbore casing 100.

During placement of the tubular member 370 within the wellbore casing 100, the protective coatings provided on the exterior surfaces of the first and second ends, 420 and 430, of the tubular body 405 prevent abrasion with the interior surface of the wellbore casing 100. In a preferred embodiment, after radial expansion of the tubular body 405, the sealing member 380 seals the interface between the outside surface of the intermediate portions 425 of the tubular body 405 of the tubular member 370 and the inside surface of the wellbore casing 100. During placement of the tubular member 370 within the wellbore casing 100, the sealing member 380 is preferably protected from contact with the interior walls of the wellbore casing 100 by the recessed outer surface profile of the tubular member 370.

In a preferred embodiment, the tubular body 405 of the tubular member 370 further includes first and second transition portions, 435 and 440, coupled between the first and second ends, 420 and 430, and the intermediate portion 425 of the tubular body 405. In a preferred embodiment, the first and second transition portions, 435 and 440, are inclined at an angle, $\alpha$, relative to the longitudinal direction ranging from about 0 to 30 degrees in order to optimally facilitate the radial expansion of the tubular member 370. In a preferred embodiment, the first and second transition portions, 435 and 440, provide a smooth transition between the first and second ends, 420 and 440, and the intermediate portion 425, of the tubular body 405 of the tubular member 370 in order to minimize stress concentrations.

Figure 5:
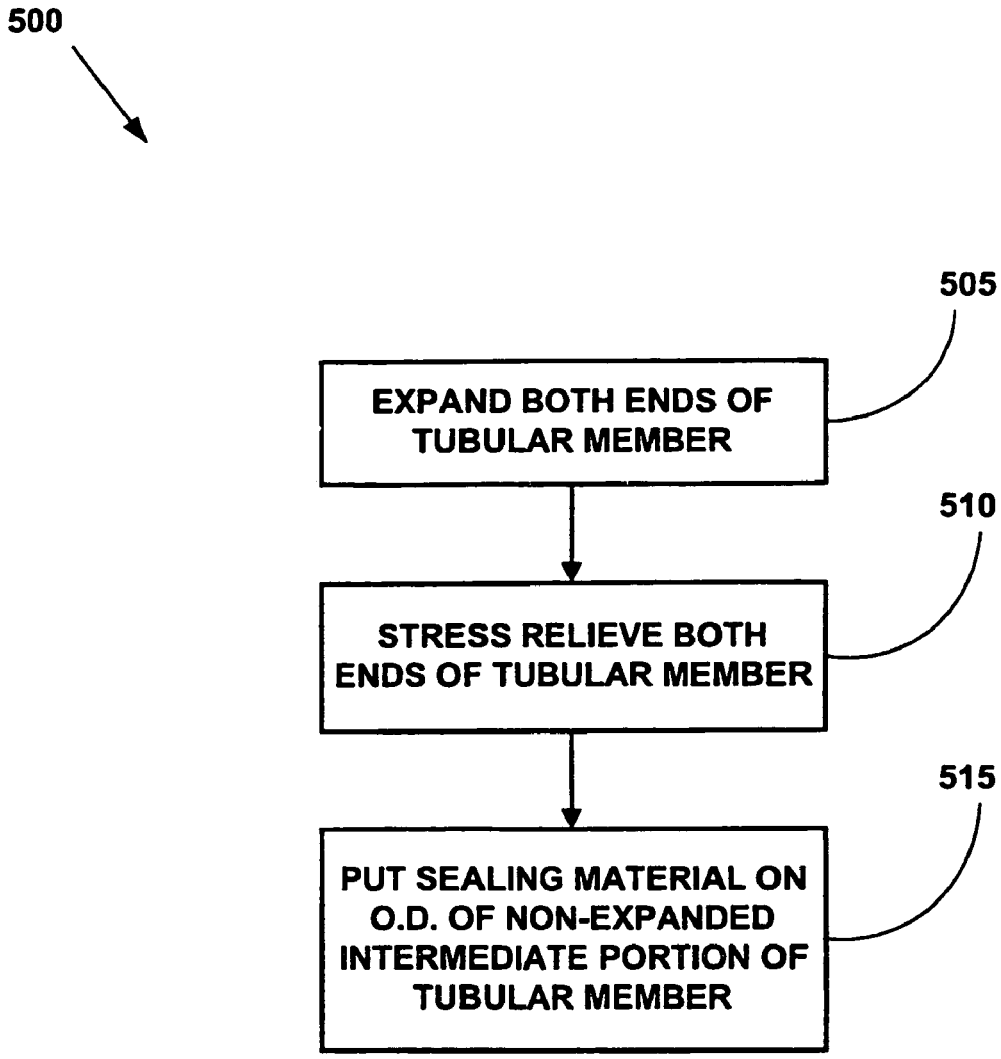
FIG. 5 is a flow chart illustration of an embodiment of a method for fabricating the expandable tubular of the apparatus of FIG. 3*a*.

Referring to FIG. 5, in a preferred embodiment, the tubular member 370 is formed by a process 500 that includes the steps of: (1) expanding both ends of the tubular body 405 in step 505; (2) stress relieving both radially expanded ends of the tubular body 405 in step 510; and (3) putting a sealing material on the outside diameter of the non-expanded intermediate portion 425 of the tubular body 405 in step 515. In an alternative embodiment, the process 500 further includes the step of putting layers of protective coatings onto the exterior surfaces of the radially expanded ends, 420 and 430, of the tubular body 405.

In a preferred embodiment, in steps 505 and 510, both ends, 420 and 430, of the tubular body 405 are radially expanded using conventional radial expansion methods, and then both ends, 420 and 430, of the tubular body 405 are stress relieved. The radially expanded ends, 420 and 430, of the tubular body 405 include interior diameters $D_1$ and $D_2$. In a preferred embodiment, the interior diameters $D_1$ and $D_2$ are substantially equal in order to provide a burst strength that is substantially equal. In a preferred embodiment, the ratio of the interior diameters $D_1$ and $D_2$ to the interior diameter $D_{INT}$ of the tubular body 405 ranges from about 100% to 120% in order to optimally provide a tubular member for subsequent radial expansion.

In a preferred embodiment, the relationship between the wall thicknesses $t_1$, $t_2$, and $t_{INT}$ of the tubular body 405; the inside diameters $D_1$, $D_2$ and $D_{INT}$ of the tubular body 405; the inside diameter $D_{wellbore}$ of the wellbore casing 100 that the tubular body 405 will be inserted into; and the outside diameter $D_{cone}$ of the expansion cone 375 that will be used to radially expand the tubular body 405 within the wellbore casing 100 is given by the following expression:

$$Dwellbore - 2 * t_1 \geq D_1 \geq \frac{1}{t_1}[(t_1 - t_{INT}) * D_{cone} + t_{INT} * D_{INT}] \quad (1)$$

where $t_1 = t_2$; and $D_1 = D_2$.

By satisfying the relationship given in equation (1), the expansion forces placed upon the tubular body 405 during the subsequent radial expansion process are substantially equalized. More generally, the relationship given in equation (1) may be used to calculate the optimal geometry for the tubular body 405 for subsequent radial expansion of the tubular body 405 for fabricating and/or repairing a wellbore casing, a pipeline, or a structural support.

In a preferred embodiment, in step 515, the sealing member 380 is then applied onto the outside diameter of the non-expanded intermediate portion 425 of the tubular body 405. The sealing member 380 may be applied to the outside diameter of the non-expanded intermediate portion 425 of the tubular body 405 using any number of conventional commercially available methods. In a preferred embodiment, the sealing member 380 is applied to the outside diameter of the intermediate portion 425 of the tubular body 405 using commercially available chemical and temperature resistant adhesive bonding.

Figure 6:
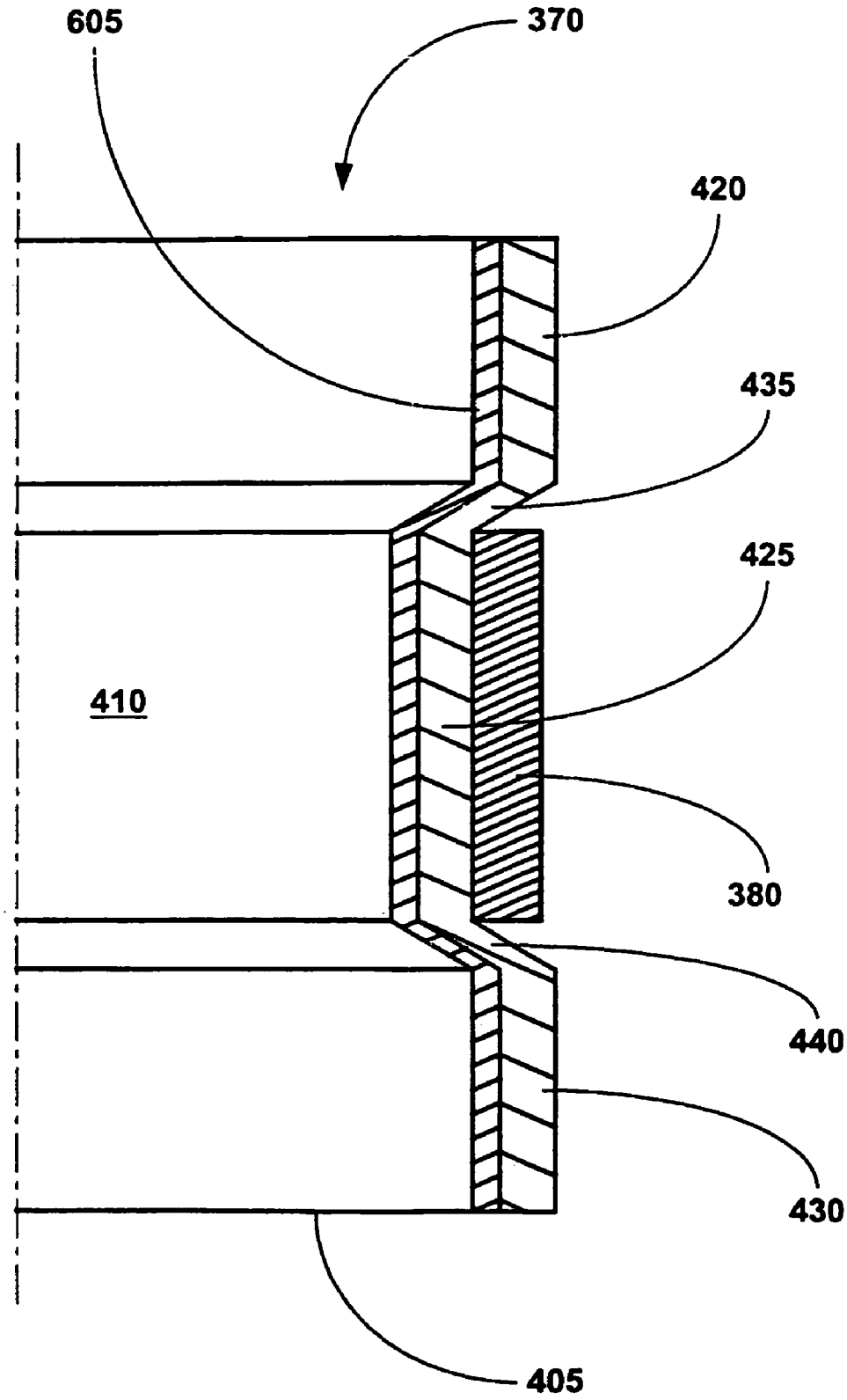
FIG. 6 is a fragmentary cross-sectional illustration of a preferred embodiment of the expandable tubular of FIG. 4.

In a preferred embodiment, as illustrated in FIG. 6, the interior surface of the tubular body 405 of the tubular member 370 further includes a coating 605 of a lubricant. The coating 605 of lubricant may be applied using any number of conventional methods such as, for example, dipping, spraying, sputter coating or electrostatic deposition. In a preferred embodiment, the coating 605 of lubricant is chemically, mechanically, and/or adhesively bonded to the interior surface of the tubular body 405 of the tubular member 370 in order to optimally provide a durable and consistent lubricating effect. In a preferred embodiment, the force that bonds the lubricant to the interior surface of the tubular body 405 of the tubular member 370 is greater than the shear force applied during the radial expansion process.

In a preferred embodiment, the coating 605 of lubricant is applied to the interior surface of the tubular body 405 of the tubular member 370 by first applying a phenolic primer to the interior surface of the tubular body 405 of the tubular member 370, and then bonding the coating 605 of lubricant to the phenolic primer using an antifriction paste including the coating 605 of lubricant carried within an epoxy resin. In a preferred embodiment, the antifriction paste includes, by weight, 40–80% epoxy resin, 15–30% molybdenum disulfide, 10–15% graphite, 5–10% aluminum, 5–10% copper, 8–15% alumisilicate, and 5–10% polyethylenepolyamine. In a preferred embodiment, the antifriction paste is provided substantially as disclosed in U.S. Pat. No. 4,329,238, the disclosure of which is incorporate herein by reference.

The coating 605 of lubricant may be any number of conventional commercially available lubricants such as, for example, metallic soaps or zinc phosphates. In a preferred embodiment, the coating 605 of lubricant includes C-Lube-10, C-Phos-52, C-Phos-58-M, and/or C-Phos-58-R in order to optimally provide a coating of lubricant. In a preferred embodiment, the coating 605 of lubricant provides a sliding coefficient of friction less than about 0.20 in order to optimally reduce the force required to radially expand the tubular member 370 using the expansion cone 375.

In an alternative embodiment, the coating 605 includes a first part of a lubricant. In a preferred embodiment, the first part of the lubricant forms a first part of a metallic soap. In an preferred embodiment, the first part of the lubricant coating includes zinc phosphate. In a preferred embodiment, the second part of the lubricant is circulated within a fluidic carrier that is circulated into contact with the coating 605 of the first part of the lubricant during the radial expansion of the tubular member 370. In a preferred embodiment, the first and second parts of the lubricant react to form a lubricating layer between the interior surface of the tubular body 405 of the tubular member 370 and the exterior surface of the expansion cone 375 during the radial expansion process. In this manner, a lubricating layer is optimally provided in the exact concentration, exactly when and where it is needed. Furthermore, because the second part of the lubricant is circulated in a carrier fluid, the dynamic interface between the interior surface of the tubular body 405 of the tubular members 370 and the exterior surface of the expansion cone 375 is also preferably provided with hydrodynamic lubrication. In a preferred embodiment, the first and second parts of the lubricant react to form a metallic soap. In a preferred embodiment, the second part of the lubricant is sodium stearate.

The expansion cone 375 is movably coupled to the second support member 340. The expansion cone 375 is preferably adapted to be axially displaced upon the pressurization of the interior region 385 of the expandable tubular member 370. The expansion cone 375 is further preferably adapted to radially expand the expandable tubular member 370.

Figure 7:
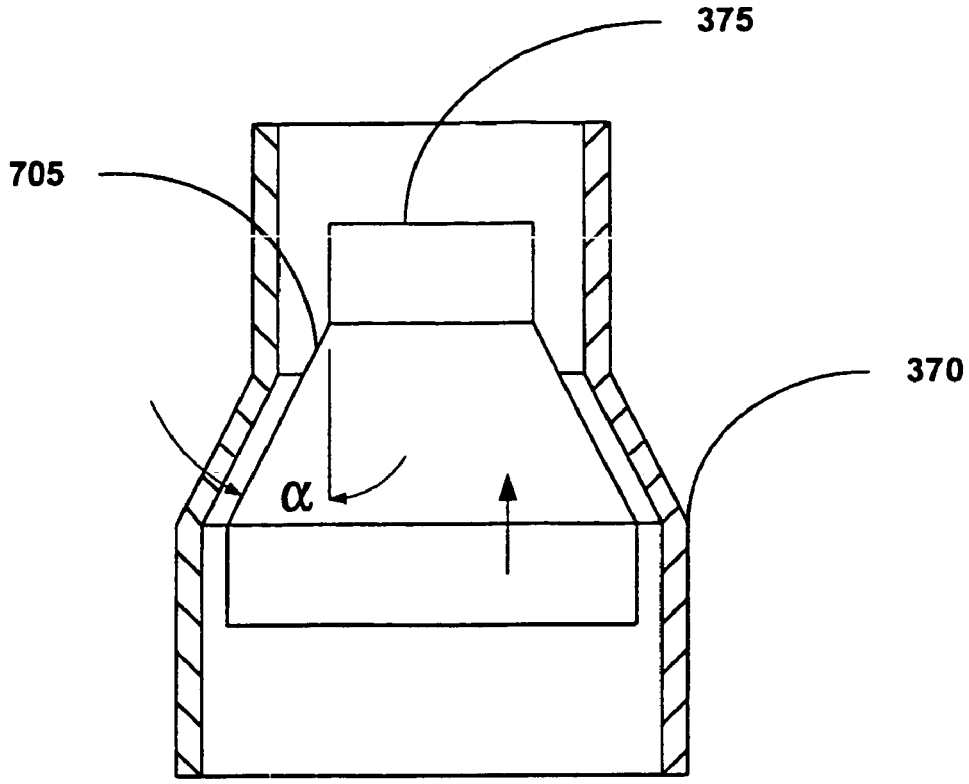
FIG. 7 is a fragmentary cross-sectional illustration of an expansion cone expanding a tubular member.
Figure 8:
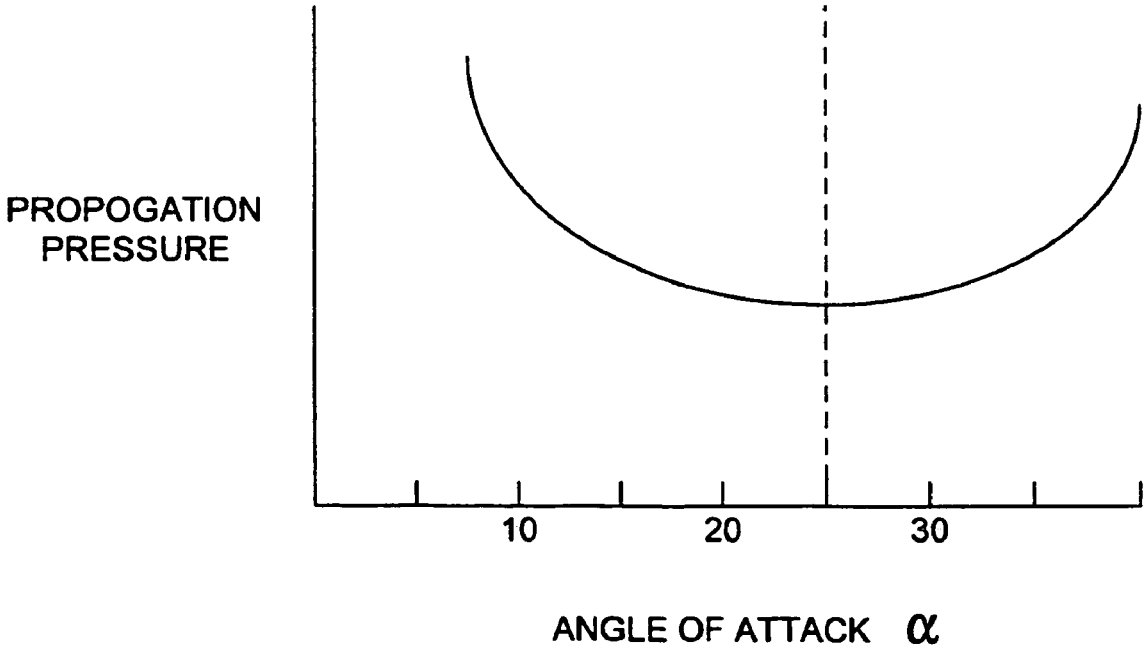
FIG. 8 is a graphical illustration of the relationship between propagation pressure and the angle of attack of the expansion cone.

In a preferred embodiment, as illustrated in FIG. 7, the expansion cone 375 includes a conical outer surface 705 for radially expanding the tubular member 370 having an angle of attack $\alpha$. In a preferred embodiment, as illustrated in FIG. 8, the angle of attack $\alpha$ ranges from about 10 to 40 degrees in order to minimize the required operating pressure of the interior portion 385 during the radial expansion process.

Figure 9:
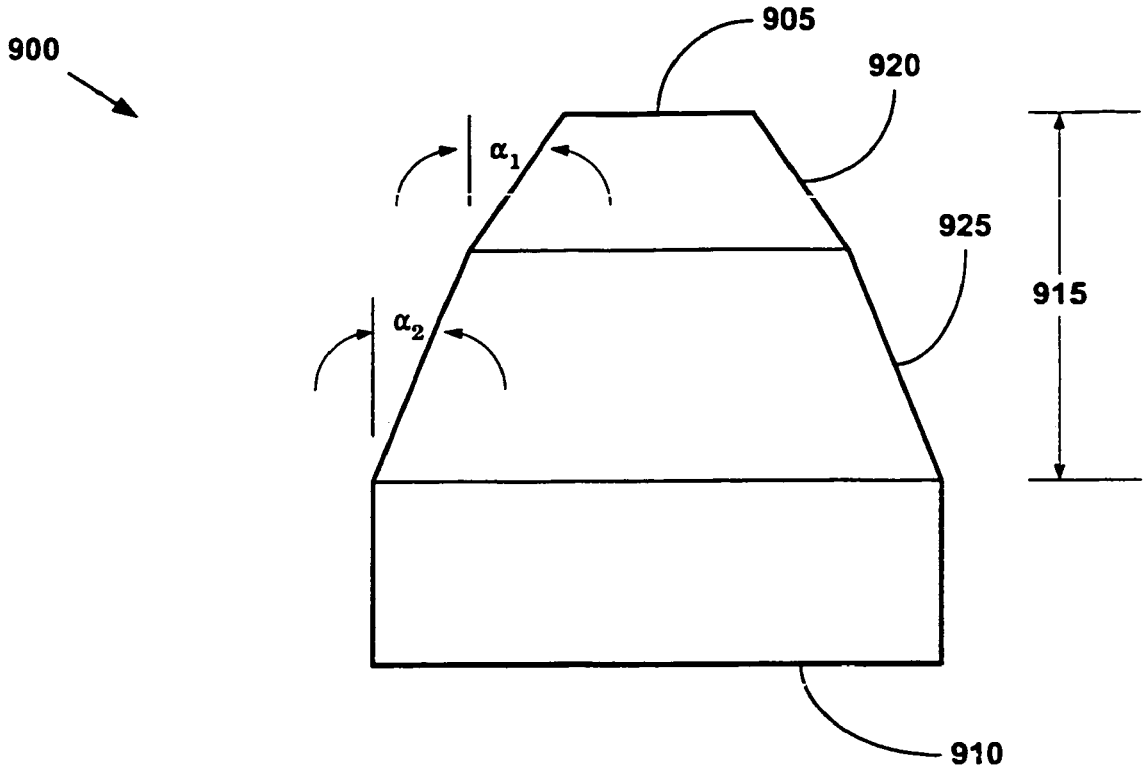
FIG. 9 is an illustration of an embodiment of an expansion cone optimally adapted to radially expand the expandable tubular member of FIG. 4.

Referring to FIG. 9, an alternative preferred embodiment of an expansion cone 900 for use in the repair apparatus 300 includes a front end 905, a rear end 910, and a radial expansion section 915. In a preferred embodiment, when the expansion cone 900 is displaced in the longitudinal direction relative to the tubular member 370, the interaction of the exterior surface of the radial expansion section 915 with the interior surface of the tubular member 370 causes the tubular member 370 to expand in the radial direction.

The radial expansion section 915 preferably includes a leading radial expansion section 920 and a trailing radial expansion section 925. In a preferred embodiment, the leading and trailing radial expansion sections, 920 and 925, have substantially conical outer surfaces. In a preferred embodiment, the leading and trailing radial expansion sections, 920 and 925, have corresponding angles of attack, $\alpha_1$ and $\alpha_2$. In a preferred embodiment, the angle of attack $\alpha_1$ of the leading radial expansion section 920 is greater than the angle of attack $\alpha_2$ of the trailing radial expansion section 925 in order to optimize the radial expansion of the tubular member 370. More generally, the radial expansion section 915 may include one or more intermediate radial expansion sections positioned between the leading and trailing radial expansion sections, 920 and 925, wherein the corresponding angles of attack $\alpha$ increase in stepwise fashion from the leading radial expansion section 920 to the trailing radial expansion section 925.

Figure 10:
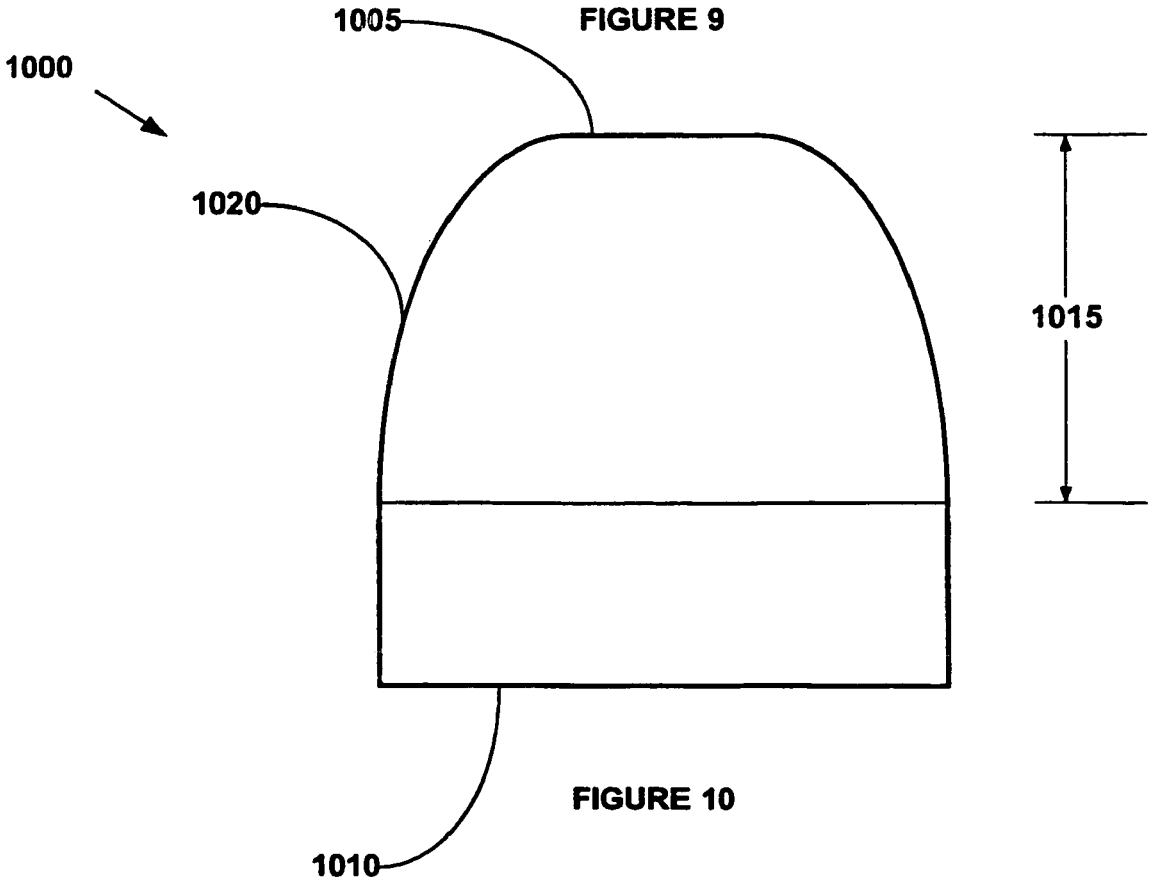
FIG. 10 is an illustration of another embodiment of an expansion cone optimally adapted to radially expand the expandable tubular member of FIG. 4.

Referring to FIG. 10, another alternative preferred embodiment of an expansion cone 1000 for use in the repair apparatus 300 includes a front end 1005, a rear end 1010, and a radial expansion section 1015. In a preferred embodiment, when the expansion cone 1000 is displaced in the longitudinal direction relative to the tubular member 370, the interaction of the exterior surface of the radial expansion section 1015 with the interior surface of the tubular member 370 causes the tubular member 370 to expand in the radial direction.

The radial expansion section 1015 preferably includes an outer surface 1020 having a substantially parabolic outer profile. In this manner, the outer surface 1020 provides an angle of attack that constantly decreases from a maximum at the front end 1005 of the expansion cone 1000 to a minimum at the rear end 1010 of the expansion cone 1000. The parabolic outer profile of the outer surface 1020 may be formed using a plurality of adjacent discrete conical sections and/or using a continuous curved surface. In this manner, the area of the outer surface 1020 adjacent to the front end 1005 of the expansion cone 1000 optimally radially overexpands the intermediate portion 425 of the tubular body 405 of the tubular members 370, while the area of the outer surface 1020 adjacent to the rear end 1010 of the expansion cone 1000 optimally radially overexpands the pre-expanded first and second ends, 420 and 430, of the tubular body 405 of the tubular member 370. In a preferred embodiment, the parabolic profile of the outer surface 1020 is selected to provide an angle of attack that ranges from about 8 to 20 degrees in the vicinity of the front end 1005 of the expansion cone 1000 and an angle of attack in the vicinity of the rear end 1010 of the expansion cone 1000 from about 4 to 15 degrees.

Figure 11:
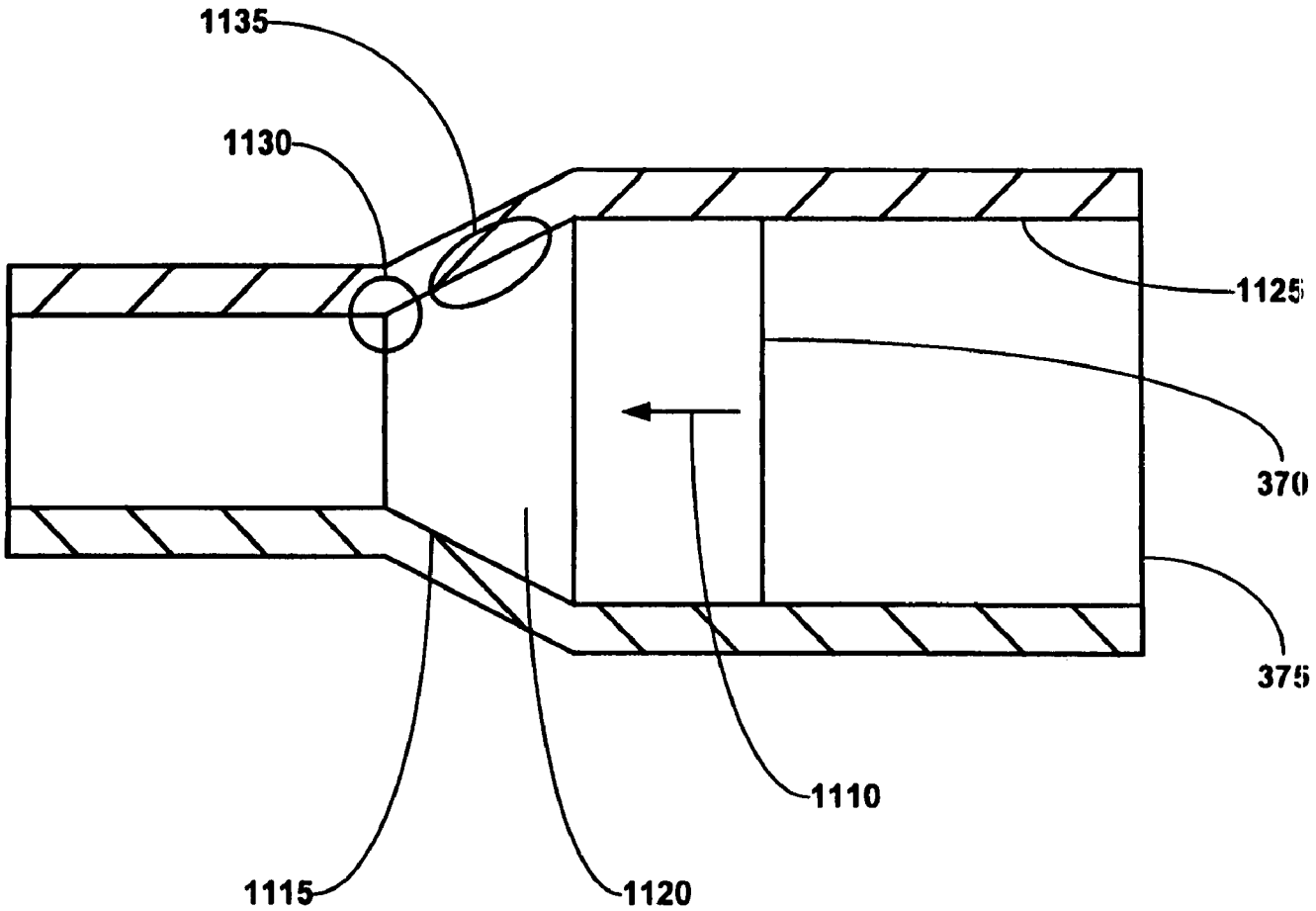
FIG. 11 is a fragmentary cross-sectional illustration of the lubrication of the interface between an expansion cone and a tubular member during the radial expansion process.

Referring to FIG. 11, the lubrication of the interface between the expansion cone 370 and the tubular member 375 during the radial expansion process will now be described. As illustrated in FIG. 31, during the radial expansion process, an expansion cone 370 radially expands the tubular member 375 by moving in an axial direction 1110 relative to the tubular member 375. The interface between the outer surface 1115 of the tapered conical portion 1120 of the expansion cone 370 and the inner surface 1125 of the tubular member 375 includes a leading edge portion 1130 and a trailing edge portion 1135.

During the radial expansion process, the leading and trailing edge portions, 1130 and 1135, are preferably lubricated by the presence of the coating 605 of lubricant. In a preferred embodiment, during the radial expansion process, the leading edge portion 5025 is further lubricated by the presence of lubricating fluids provided ahead of the expansion cone 370. However, because the radial clearance between the expansion cone 370 and the tubular member 375 in the trailing edge portion 1135 during the radial expansion process is typically extremely small, and the operating contact pressures between the tubular member 375 and the expansion cone 370 are extremely high, the quantity of lubricating fluid provided to the trailing edge portion 1135 is typically greatly reduced. In typical radial expansion operations, this reduction in the flow of lubricating fluids in the trailing edge portion 1135 increases the forces required to radially expand the tubular member 375.

Figure 12:
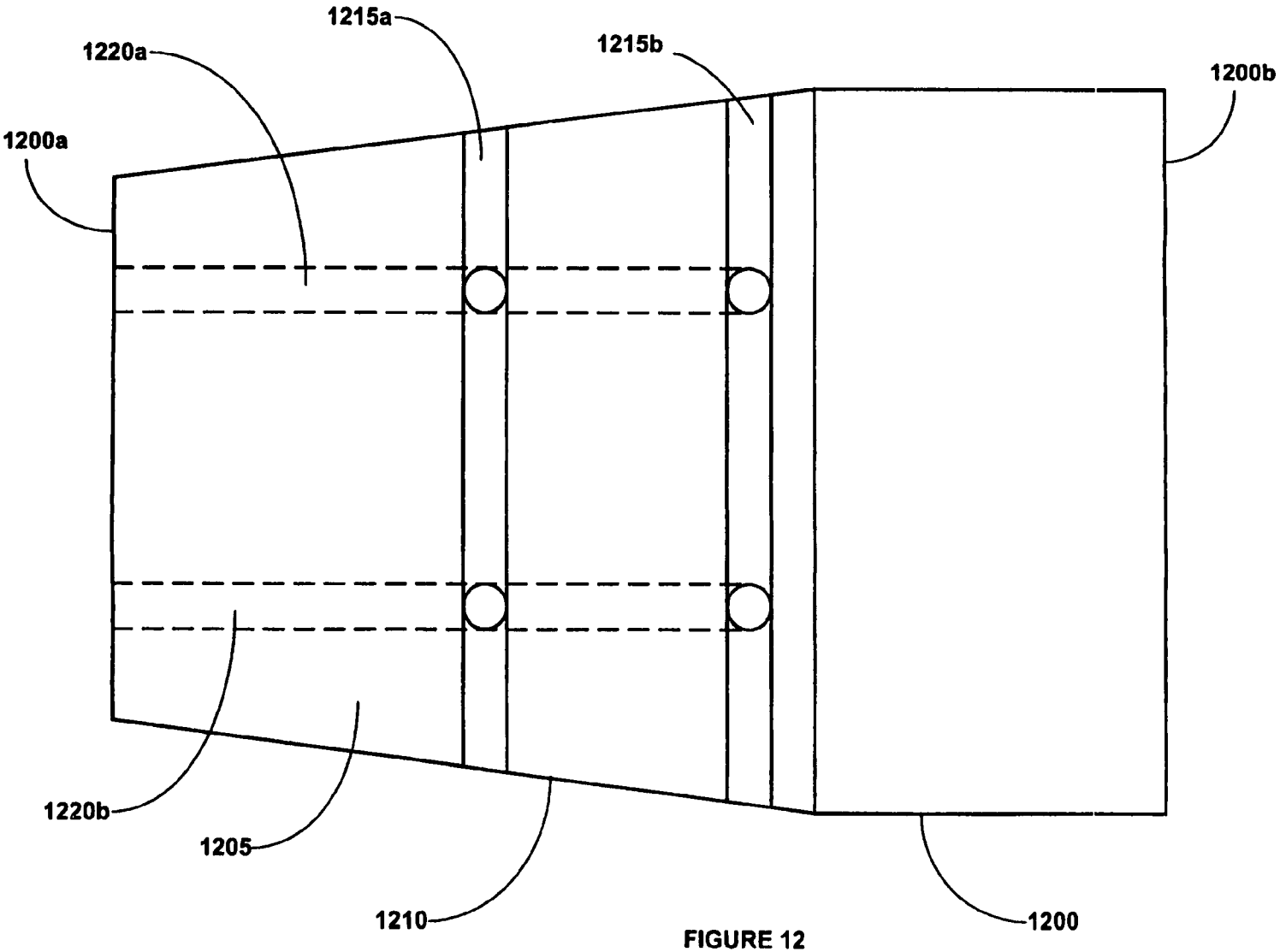
FIG. 12 is an illustration of an embodiment of an expansion cone including a system for lubricating the interface between the expansion cone and a tubular member during the radial expansion of the tubular member.

Referring to FIG. 12, in a preferred embodiment, an expansion cone 1200 is used in the repair apparatus 300 that includes a front end 1200*a*, a rear end 1200*b*, a tapered portion 1205 having an outer surface 1210, one or more circumferential grooves 1215*a* and 1215*b*, and one more internal flow passages 1220*a* and 1220*b*.

In a preferred embodiment, the circumferential grooves 1215 are fluidicly coupled to the internal flow passages 1220. In this manner, during the radial expansion process, lubricating fluids are transmitted from the area ahead of the front 1200*a* of the expansion cone 1200 into the circumferential grooves 1215. Thus, the trailing edge portion of the interface between the expansion cone 1200 and the tubular member 370 is provided with an increased supply of lubricant, thereby reducing the amount of force required to radially expand the tubular member 370. In a preferred embodiment, the lubricating fluids are injected into the internal flow passages 1220 using a fluid conduit that is coupled to the tapered end 1205 of the expansion cone 1200. Alternatively, lubricating fluids are provided for the internal flow passages 1220 using a supply of lubricating fluids provided adjacent to the front 1200*a* of the expansion cone 1200.

In a preferred embodiment, the expansion cone 1200 includes a plurality of circumferential grooves 1215. In a preferred embodiment, the cross sectional area of the circumferential grooves 1215 range from about $2\times10^{-4}$ in$^2$ to $5\times10^{-2}$ in$^2$ in order to optimally provide lubrication to the trailing edge portion of the interface between the expansion cone 1200 and the tubular member 370 during the radial expansion process. In a preferred embodiment, the expansion cone 1200 includes circumferential grooves 1215 concentrated about the axial midpoint of the tapered portion 1205 in order to optimally provide lubrication to the trailing edge portion of the interface between the expansion cone 1200 and a tubular member during the radial expansion process. In a preferred embodiment, the circumferential grooves 1215 are equally spaced along the trailing edge portion of the expansion cone 1200 in order to optimally provide lubrication to the trailing edge portion of the interface between the expansion cone 1200 and the tubular member 370 during the radial expansion process.

In a preferred embodiment, the expansion cone 1200 includes a plurality of flow passages 1220 coupled to each of the circumferential grooves 1215. In a preferred embodiment, the cross-sectional area of the flow passages 1220 ranges from about $2\times10^{-4}$ in$^2$ to $5\times10^{-2}$ in$^2$ in order to optimally provide lubrication to the trailing edge portion of the interface between the expansion cone 1200 and the tubular member 370 during the radial expansion process. In a preferred embodiment, the cross sectional area of the circumferential grooves 1215 is greater than the cross sectional area of the flow passage 1220 in order to minimize resistance to fluid flow.

Figure 13:
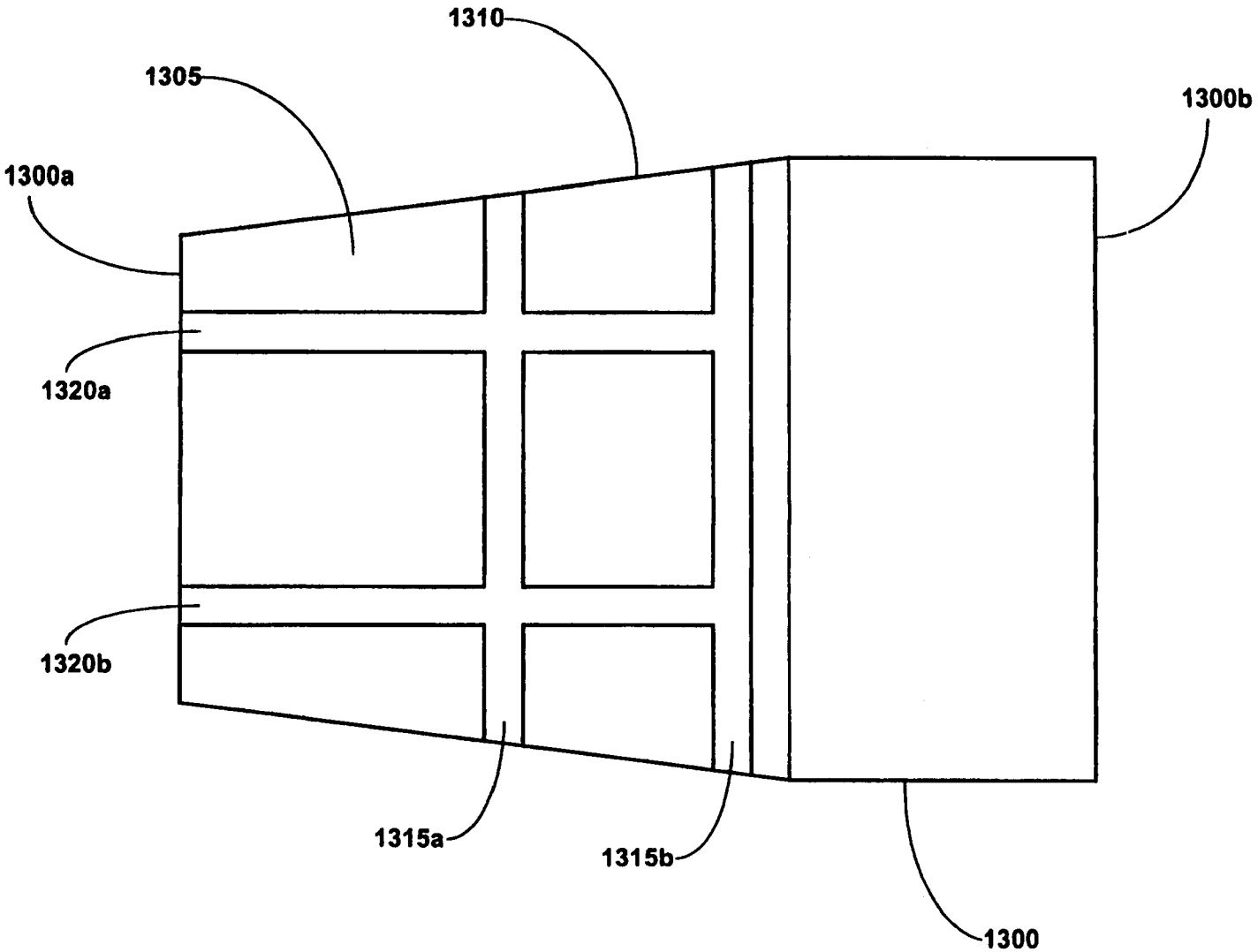
FIG. 13 is an illustration of another embodiment of an expansion cone including a system for lubricating the interface between the expansion cone and a tubular member during the radial expansion of the tubular member.

Referring to FIG. 13, in an alternative embodiment, an expansion cone 1300 is used in the repair apparatus 300 that includes a front end 1300*a* and a rear end 1300*b*, includes a tapered portion 1305 having an outer surface 1310, one or more circumferential grooves 1315*a* and 1315*b*, and one or more axial grooves 1320*a* and 1320*b*.

In a preferred embodiment, the circumferential grooves 1315 are fluidicly coupled to the axial groves 1320. In this manner, during the radial expansion process, lubricating fluids are transmitted from the area ahead of the front 1300*a* of the expansion cone 1300 into the circumferential grooves 1315. Thus, the trailing edge portion of the interface between the expansion cone 1300 and the tubular member 370 is provided with an increased supply of lubricant, thereby reducing the amount of force required to radially expand the tubular member 370. In a preferred embodiment, the axial grooves 1320 are provided with lubricating fluid using a supply of lubricating fluid positioned proximate the front end 1300*a* of the expansion cone 1300. In a preferred embodiment, the circumferential grooves 1315 are concentrated about the axial midpoint of the tapered portion 1305 of the expansion cone 1300 in order to optimally provide lubrication to the trailing edge portion of the interface between the expansion cone 1300 and the tubular member 370 during the radial expansion process. In a preferred embodiment, the circumferential grooves 1315 are equally spaced along the trailing edge portion of the expansion cone 1300 in order to optimally provide lubrication to the trailing edge portion of the interface between the expansion cone 1300 and the tubular member 370 during the radial expansion process.

In a preferred embodiment, the expansion cone 1300 includes a plurality of circumferential grooves 1315. In a preferred embodiment, the cross sectional area of the circumferential grooves 1315 range from about $2\times10^{-4}$ in$^2$ to $5\times10^{-2}$ in$^2$ in order to optimally provide lubrication to the trailing edge portion of the interface between the expansion cone 1300 and the tubular member 370 during the radial expansion process.

In a preferred embodiment, the expansion cone 1300 includes a plurality of axial grooves 1320 coupled to each of the circumferential grooves 1315. In a preferred embodiment, the cross sectional area of the axial grooves 1320 ranges from about $2\times10^{-4}$ in$^2$ to $5\times10^{-2}$ in$^2$ in order to optimally provide lubrication to the trailing edge portion of the interface between the expansion cone 1300 and the tubular member 370 during the radial expansion process. In a preferred embodiment, the cross sectional area of the circumferential grooves 1315 is greater than the cross sectional area of the axial grooves 1320 in order to minimize resistance to fluid flow. In a preferred embodiment, the axial groves 1320 are spaced apart in the circumferential direction by at least about 3 inches in order to optimally provide lubrication during the radial expansion process.

Figure 14:
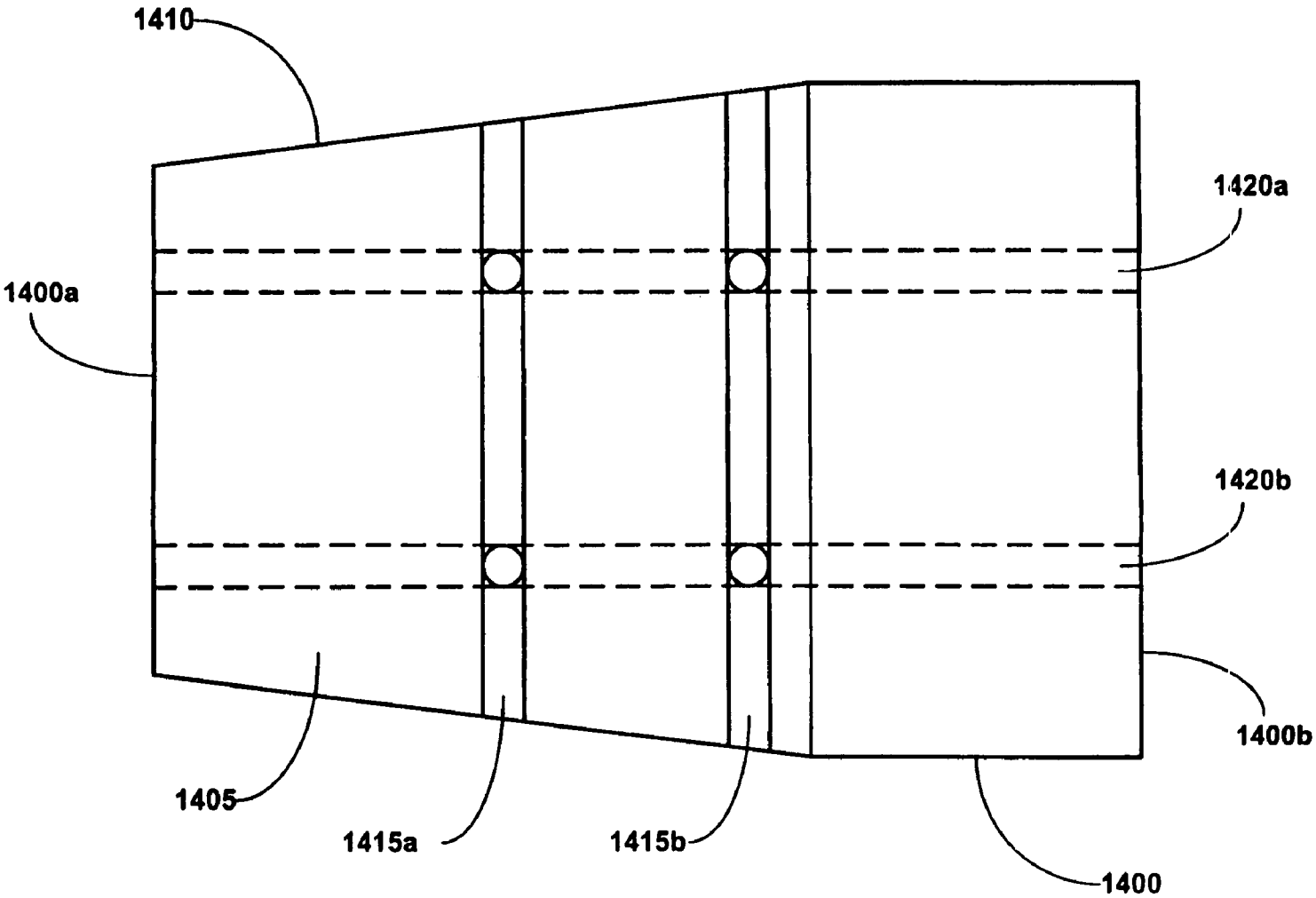
FIG. 14 is an illustration of another embodiment of an expansion cone including a system for lubricating the interface between the expansion cone and a tubular member during the radial expansion of the tubular member.

Referring to FIG. 14, in an alternative embodiment, an expansion cone 1400 is used in the repair apparatus 300 that includes a front end 1400*a* and a rear end 1400*b*, includes a tapered portion 1405 having an outer surface 1410, one or more circumferential grooves 1415*a* and 1415*b*, and one or more internal flow passages 1420*a* and 1420*b*.

In a preferred embodiment, the circumferential grooves 1415 are fluidicly coupled to the internal flow passages 1420. In this manner, during the radial expansion process, lubricating fluids are transmitted from the areas in front of the front 1400*a* and/or behind the rear 1400*b* of the expansion cone 1400 into the circumferential grooves 1415. Thus, the trailing edge portion of the interface between the expansion cone 1400 and the tubular member 370 is provided with an increased supply of lubricant, thereby reducing the amount of force required to radially expand the tubular member 370. Furthermore, the lubricating fluids also preferably pass to the area in front of the expansion cone 1400. In this manner, the area adjacent to the front 1400*a* of the expansion cone 1400 is cleaned of foreign materials. In a preferred embodiment, the lubricating fluids are injected into the internal flow passages 1420 by pressurizing the area behind the rear 1400*b* of the expansion cone 1400 during the radial expansion process.

In a preferred embodiment, the expansion cone 1400 includes a plurality of circumferential grooves 1415. In a preferred embodiment, the cross sectional area of the circumferential grooves 1415 ranges from about $2\times10^{-4}$ in$^2$ to $5\times10^{-2}$ in$^2$ respectively, in order to optimally provide lubrication to the trailing edge portion of the interface between the expansion cone 1400 and the tubular member 370 during the radial expansion process. In a preferred embodiment, the expansion cone 1400 includes circumferential grooves 1415 that are concentrated about the axial midpoint of the tapered portion 1405 in order to optimally provide lubrication to the trailing edge portion of the interface between the expansion cone 1400 and the tubular member 370 during the radial expansion process. In a preferred embodiment, the circumferential grooves 1415 are equally spaced along the trailing edge portion of the expansion cone 1400 in order to optimally provide lubrication to the trailing edge portion of the interface between the expansion cone 1400 and the tubular member 370 during the radial expansion process.

In a preferred embodiment, the expansion cone 1400 includes a plurality of flow passages 1420 coupled to each of the circumferential grooves 1415. In a preferred embodiment, the flow passages 1420 fluidicly couple the front end 1400*a* and the rear end 1400*b* of the expansion cone 1400. In a preferred embodiment, the cross-sectional area of the flow passages 1420 ranges from about $2\times10^{-4}$ in$^2$ to $5\times10^{-2}$ in$^2$ in order to optimally provide lubrication to the trailing edge portion of the interface between the expansion cone 1400 and the tubular member 370 during the radial expansion process. In a preferred embodiment, the cross sectional area of the circumferential grooves 1415 is greater than the cross-sectional area of the flow passages 1420 in order to minimize resistance to fluid flow.

Figure 15:
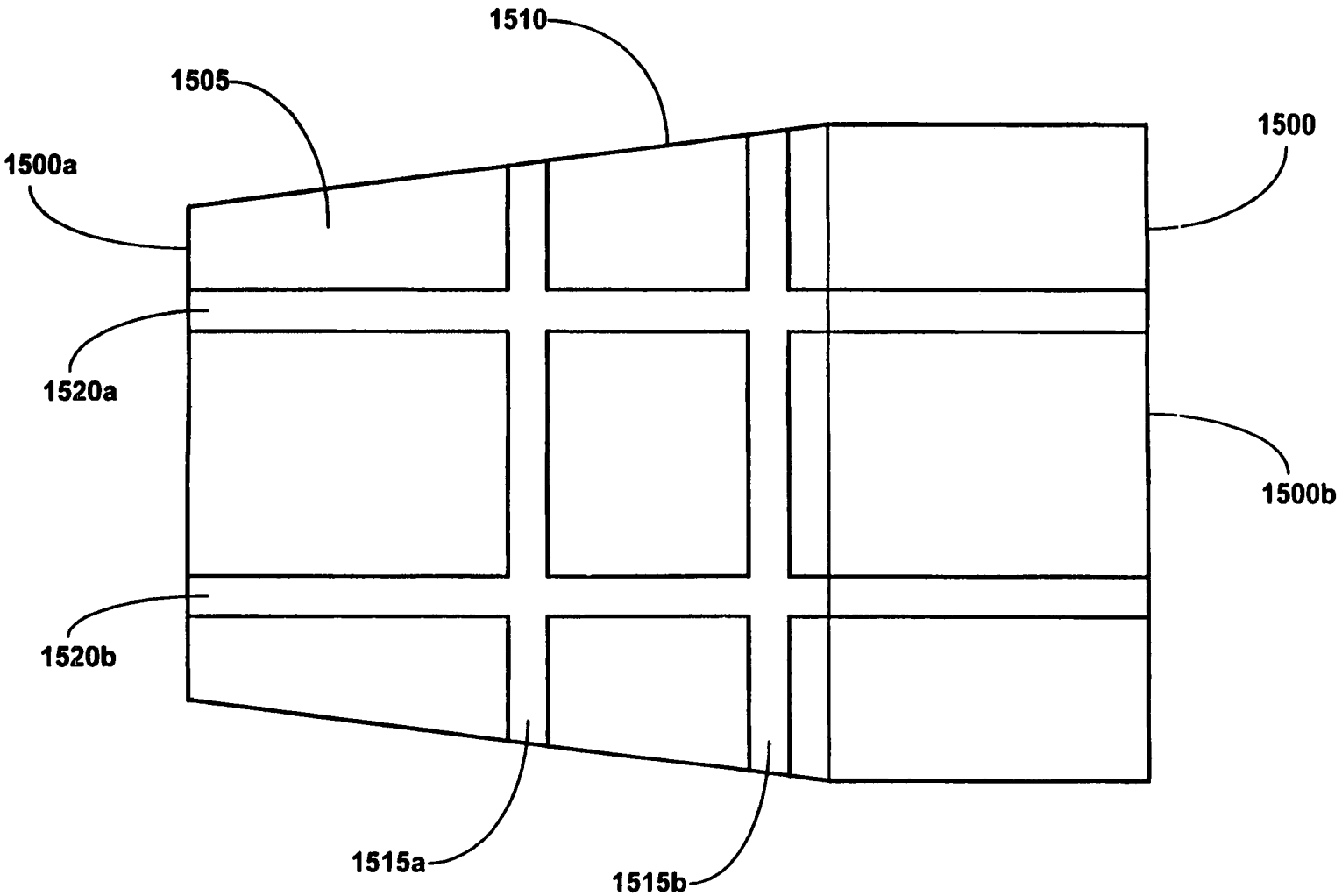
FIG. 15 is an illustration of another embodiment of an expansion cone including a system for lubricating the interface between the expansion cone and a tubular member during the radial expansion of the tubular member.

Referring to FIG. 15, an alternative embodiment of an expansion cone 1500 is used in the apparatus that includes a front end 1500*a* and a rear end 1500*b*, includes a tapered portion 1505 having an outer surface 1510, one or more circumferential grooves 1515*a* and 1515*b*, and one or more axial grooves 1520*a* and 1520*b*.

In a preferred embodiment, the circumferential grooves 1515 are fluidicly coupled to the axial grooves 1520. In this manner, during the radial expansion process, lubricating fluids are transmitted from the areas in front of the front 1500*a* and/or behind the rear 1500*b* of the expansion cone 1500 into the circumferential grooves 1515. Thus, the trailing edge portion of the interface between the expansion cone 1500 and the tubular member 370 is provided with an increased supply of lubricant, thereby reducing the amount of force required to radially expand the tubular member 370. Furthermore, in a preferred embodiment, pressurized lubricating fluids pass from the fluid passages 1520 to the area in front of the front 1500*a* of the expansion cone 1500. In this manner, the area adjacent to the front 1500*a* of the expansion cone 1500 is cleaned of foreign materials. In a preferred embodiment, the lubricating fluids are injected into the internal flow passages 1520 by pressurizing the area behind the rear 1500*b* expansion cone 1500 during the radial expansion process.

In a preferred embodiment, the expansion cone 1500 includes a plurality of circumferential grooves 1515. In a preferred embodiment, the cross sectional area of the circumferential grooves 1515 range from about $2\times10^{-4}$ in$^2$ to $5\times10^{-2}$ in$^2$ in order to optimally provide lubrication to the trailing edge portion of the interface between the expansion cone 1500 and the tubular member 370 during the radial expansion process. In a preferred embodiment, the expansion cone 1500 includes circumferential grooves 1515 that are concentrated about the axial midpoint of the tapered portion 1505 in order to optimally provide lubrication to the trailing edge portion of the interface between the expansion cone 1500 and the tubular member 370 during the radial expansion process. In a preferred embodiment, the circumferential grooves 1515 are equally spaced along the trailing edge portion of the expansion cone 1500 in order to optimally provide lubrication to the trailing edge portion of the interface between the expansion cone 1500 and the tubular member 370 during the radial expansion process.

In a preferred embodiment, the expansion cone 1500 includes a plurality of axial grooves 1520 coupled to each of the circumferential grooves 1515. In a preferred embodiment, the axial grooves 1520 fluidicly couple the front end and the rear end of the expansion cone 1500. In a preferred embodiment, the cross sectional area of the axial grooves 1520 range from about $2\times10^{-4}$ in$^2$ to $5\times10^{-2}$ in$^2$, respectively, in order to optimally provide lubrication to the trailing edge portion of the interface between the expansion cone 1500 and the tubular member 370 during the radial expansion process. In a preferred embodiment, the cross sectional area of the circumferential grooves 1515 is greater than the cross sectional areas of the axial grooves 1520 in order to minimize resistance to fluid flow. In a preferred embodiment, the axial grooves 1520 are spaced apart in the circumferential direction by at least about 3 inches in order to optimally provide lubrication during the radial expansion process.

Figure 16:
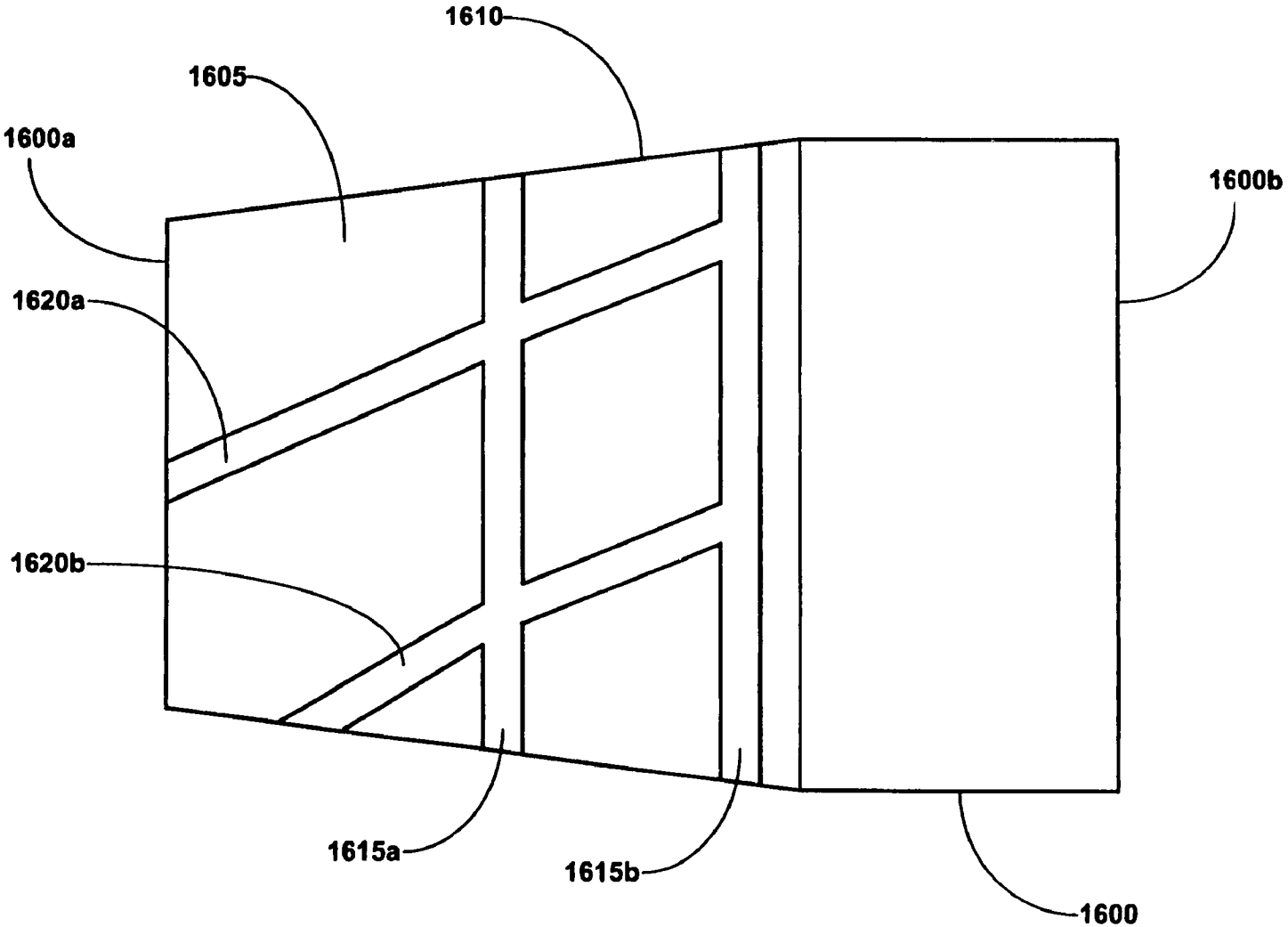
FIG. 16 is an illustration of another embodiment of an expansion cone including a system for lubricating the interface between the expansion cone and a tubular member during the radial expansion of the tubular member.

Referring to FIG. 16, in an alternative embodiment, an expansion cone 1600 is used in the repair apparatus 300 that includes a front end 1600*a* and a rear end 1600*b*, includes a tapered portion 1605 having an outer surface 1610, one or more circumferential grooves 1615*a* and 1615*b*, and one or more axial grooves 1620*a* and 1620*b*.

In a preferred embodiment, the circumferential grooves 1615 are fluidicly coupled to the axial grooves 1620. In this manner, during the radial expansion process, lubricating fluids are transmitted from the area ahead of the front 1600*a* of the expansion cone 1600 into the circumferential grooves 1615. Thus, the trailing edge portion of the interface between the expansion cone 1600 and a tubular member is provided with an increased supply of lubricant, thereby reducing the amount of force required to radially expand the tubular member 370. In a preferred embodiment, the lubricating fluids are injected into the axial grooves 1620 using a fluid conduit that is coupled to the tapered end 3205 of the expansion cone 1600.

In a preferred embodiment, the expansion cone 1600 includes a plurality of circumferential grooves 1615. In a preferred embodiment, the cross sectional area of the circumferential grooves 1615 ranges from about $2\times10^{-4}$ in$^2$ to $5\times10^{-2}$ in$^2$ in order to optimally provide lubrication to the trailing edge portion of the interface between the expansion cone 1600 and the tubular member 370 during the radial expansion process. In a preferred embodiment, the expansion cone 1600 includes circumferential grooves 1615 that are concentrated about the axial midpoint of the tapered portion 1605 in order to optimally provide lubrication to the trailing edge portion of the interface between the expansion cone 1600 and the tubular member 370 during the radial expansion process. In a preferred embodiment, the circumferential grooves 1615 are equally spaced along the trailing edge portion of the expansion cone 1600 in order to optimally provide lubrication to the trailing edge portion of the interface between the expansion cone 1600 and the tubular member 370 during the radial expansion process.

In a preferred embodiment, the expansion cone 1600 includes a plurality of axial grooves 1620 coupled to each of the circumferential grooves 1615. In a preferred embodiment, the axial grooves 1620 intersect each of the circumferential groves 1615 at an acute angle. In a preferred embodiment, the cross sectional area of the axial grooves 1620 ranges from about $2\times10^{-4}$ in$^2$ to $5\times10^{-2}$ in$^2$ in order to optimally provide lubrication to the trailing edge portion of the interface between the expansion cone 1600 and the tubular member 370 during the radial expansion process. In a preferred embodiment, the cross sectional area of the circumferential grooves 1615 is greater than the cross sectional area of the axial grooves 1620. In a preferred embodiment, the axial grooves 1620 are spaced apart in the circumferential direction by at least about 3 inches in order to optimally provide lubrication during the radial expansion process. In a preferred embodiment, the axial grooves 1620 intersect the longitudinal axis of the expansion cone 1600 at a larger angle than the angle of attack of the tapered portion 1605 in order to optimally provide lubrication during the radial expansion process.

Figure 17:
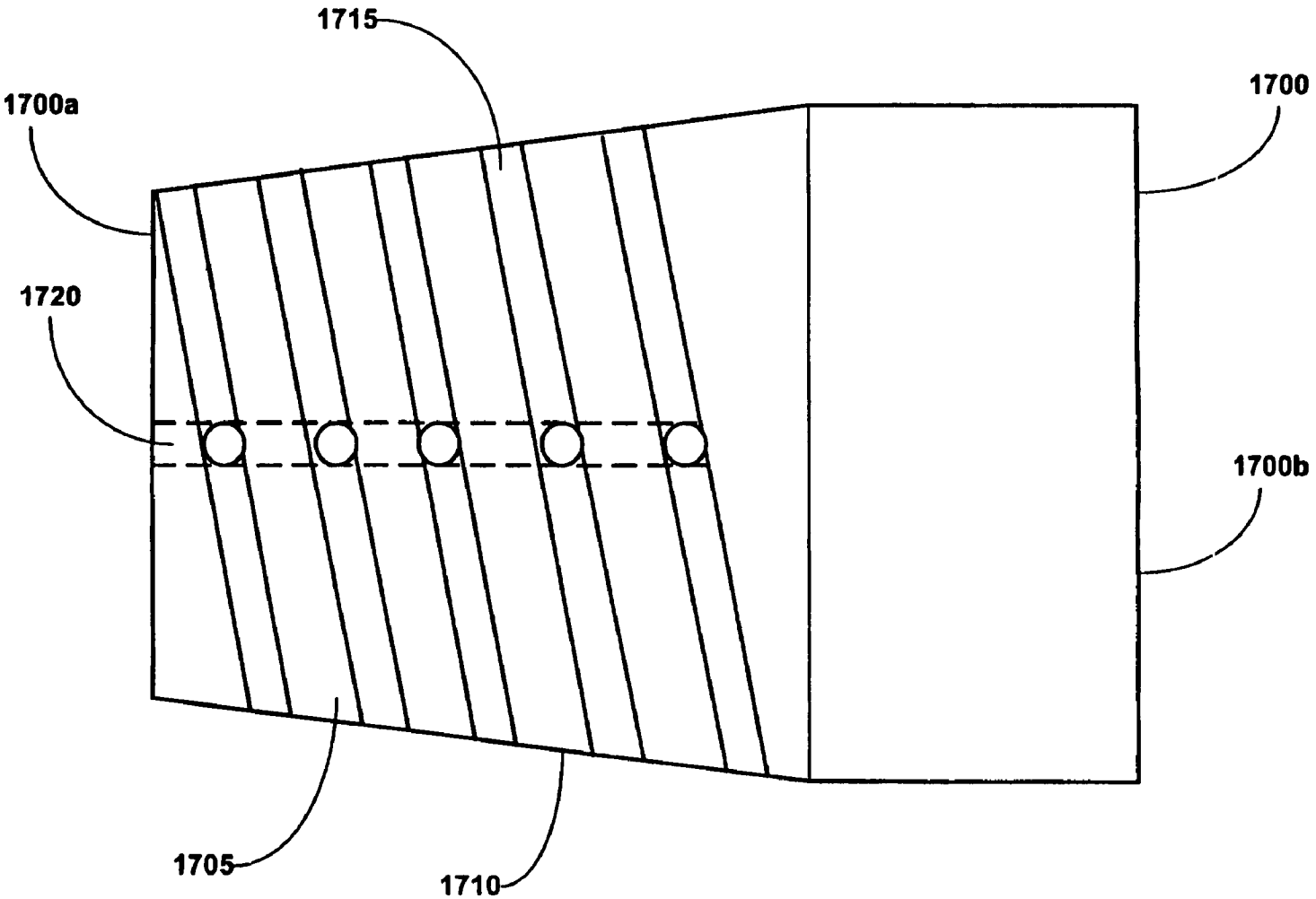
FIG. 17 is an illustration of another embodiment of an expansion cone including a system for lubricating the interface between the expansion cone and a tubular member during the radial expansion of the tubular member.

Referring to FIG. 17, in an alternative embodiment, an expansion cone 1700 is used in the repair apparatus 300 that includes a front end 1700*a* and a rear end 1700*b*, includes a tapered portion 1705 having an outer surface 1710, a spiral circumferential groove 1715, and one or more internal flow passages 1720.

In a preferred embodiment, the circumferential groove 1715 is fluidicly coupled to the internal flow passage 1720. In this manner, during the radial expansion process, lubricating fluids are transmitted from the area ahead of the front 1700*a* of the expansion cone 1700 into the circumferential groove 1715. Thus, the trailing edge portion of the interface between the expansion cone 1700 and the tubular member 370 is provided with an increased supply of lubricant, thereby reducing the amount of force required to radially expand the tubular member. In a preferred embodiment, the lubricating fluids are injected into the internal flow passage 1720 using a fluid conduit that is coupled to the tapered end 1705 of the expansion cone 1700.

In a preferred embodiment, the expansion cone 1700 includes a plurality of spiral circumferential grooves 1715. In a preferred embodiment, the cross sectional area of the circumferential groove 1715 ranges from about $2\times10^{-4}$ in$^2$ to $5\times10^{-2}$ in$^2$ in order to optimally provide lubrication to the trailing edge portion of the interface between the expansion cone 1700 and the tubular member 370 during the radial expansion process. In a preferred embodiment, the expansion cone 1700 includes circumferential grooves 1715 that are concentrated about the axial midpoint of the tapered portion 1705 in order to optimally provide lubrication to the trailing edge portion of the interface between the expansion cone 1700 and the tubular member 370 during the radial expansion process. In a preferred embodiment, the circumferential grooves 1715 are equally spaced along the trailing edge portion of the expansion cone 1700 in order to optimally provide lubrication to the trailing edge portion of the interface between the expansion cone 1700 and the tubular member 370 during the radial expansion process.

In a preferred embodiment, the expansion cone 1700 includes a plurality of flow passages 1720 coupled to each of the circumferential grooves 1715. In a preferred embodiment, the cross-sectional area of the flow passages 1720 ranges from about $2\times10^{-4}$ in$^2$ to $5\times10^{-2}$ in$^2$ in order to optimally provide lubrication to the trailing edge portion of the interface between the expansion cone 1700 and the tubular member 370 during the radial expansion process. In a preferred embodiment, the cross sectional area of the circumferential groove 1715 is greater than the cross sectional area of the flow passage 1720 in order to minimize resistance to fluid flow.

Figure 18:
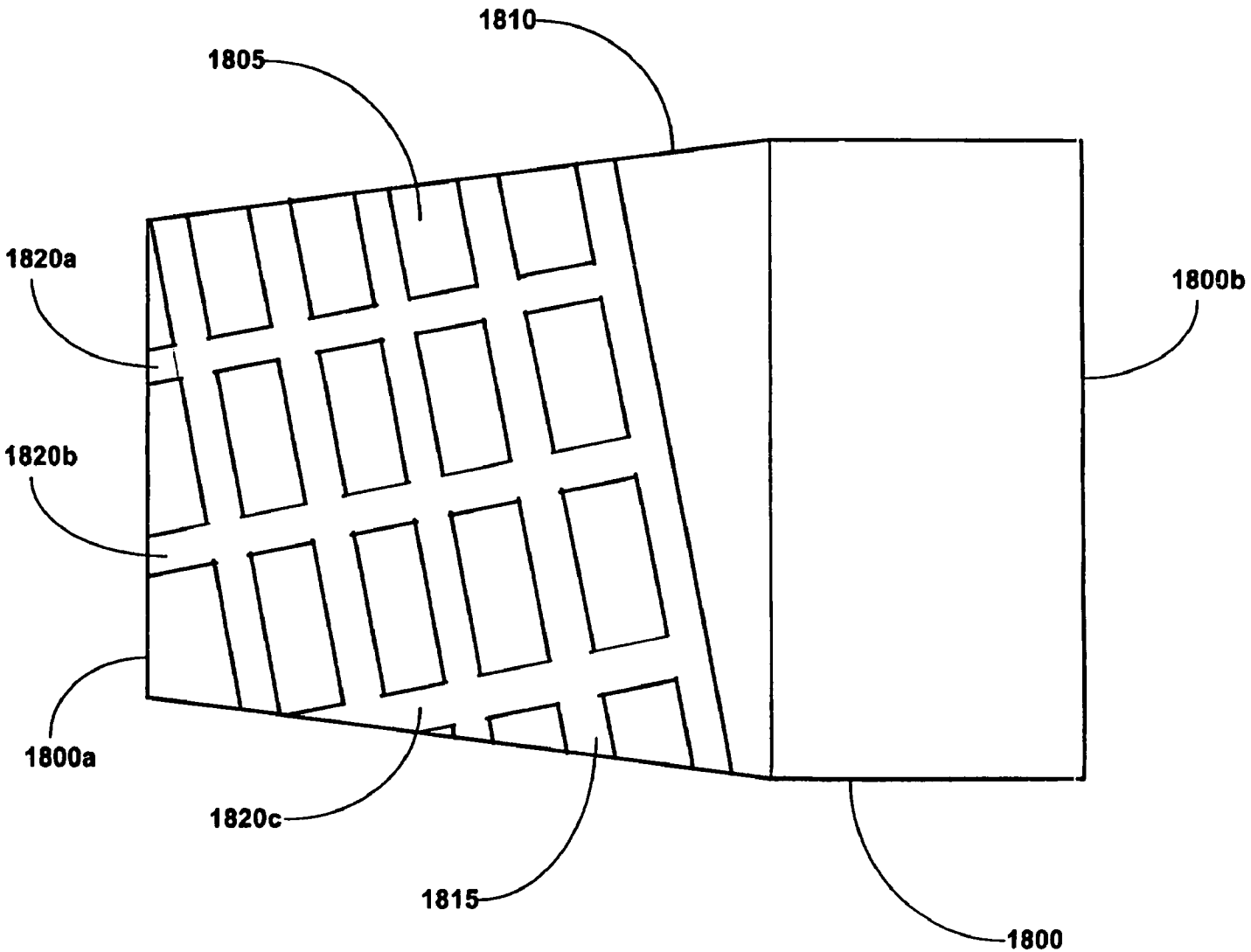
FIG. 18 is an illustration of another embodiment of an expansion cone including a system for lubricating the interface between the expansion cone and a tubular member during the radial expansion of the tubular member.

Referring to FIG. 18, in an alternative embodiment, an expansion cone 1800 is used in the repair apparatus 300 that includes a front end 1800*a* and a rear end 1800*b*, includes a tapered portion 1805 having an outer surface 1810, a spiral circumferential groove 1815, and one or more axial grooves 1820*a*, 1820*b* and 1820*c*.

In a preferred embodiment, the circumferential groove 1815 is fluidicly coupled to the axial grooves 1820. In this manner, during the radial expansion process, lubricating fluids are transmitted from the area ahead of the front 1800*a* of the expansion cone 1800 into the circumferential groove 1815. Thus, the trailing edge portion of the interface between the expansion cone 1800 and a tubular member is provided with an increased supply of lubricant, thereby reducing the amount of force required to radially expand the tubular member 370. In a preferred embodiment, the lubricating fluids are injected into the axial grooves 1820 using a fluid conduit that is coupled to the tapered end 1805 of the expansion cone 1800.

In a preferred embodiment, the expansion cone 1800 includes a plurality of spiral circumferential grooves 1815. In a preferred embodiment, the cross sectional area of the circumferential grooves 1815 range from about $2\times10^{-4}$ in$^2$ to $5\times10^{-2}$ in$^2$ in order to optimally provide lubrication to the trailing edge portion of the interface between the expansion cone 1800 and the tubular member 370 during the radial expansion process. In a preferred embodiment, the expansion cone 1800 includes circumferential grooves 1815 concentrated about the axial midpoint of the tapered portion 1805 in order to optimally provide lubrication to the trailing edge portion of the interface between the expansion cone 1800 and the tubular member 370 during the radial expansion process. In a preferred embodiment, the circumferential grooves 1815 are equally spaced along the trailing edge portion of the expansion cone 1800 in order to optimally provide lubrication to the trailing edge portion of the interface between the expansion cone 1800 and the tubular member 370 during the radial expansion process.

In a preferred embodiment, the expansion cone 1800 includes a plurality of axial grooves 1820 coupled to each of the circumferential grooves 1815. In a preferred embodiment, the cross sectional area of the axial grooves 1820 range from about $2\times10^{-4}$ in$^2$ to $5\times10^{-2}$ in$^2$ in order to optimally provide lubrication to the trailing edge portion of the interface between the expansion cone 1800 and the tubular member 370 during the radial expansion process. In a preferred embodiment, the axial grooves 1820 intersect the circumferential grooves 1815 in a perpendicular manner. In a preferred embodiment, the cross sectional area of the circumferential groove 1815 is greater than the cross sectional area of the axial grooves 1820 in order to minimize resistance to fluid flow. In a preferred embodiment, the circumferential spacing of the axial grooves is greater than about 3 inches in order to optimally provide lubrication during the radial expansion process. In a preferred embodiment, the axial grooves 1820 intersect the longitudinal axis of the expansion cone at an angle greater than the angle of attack of the tapered portion 1805 in order to optimally provide lubrication during the radial expansion process.

Figure 19:
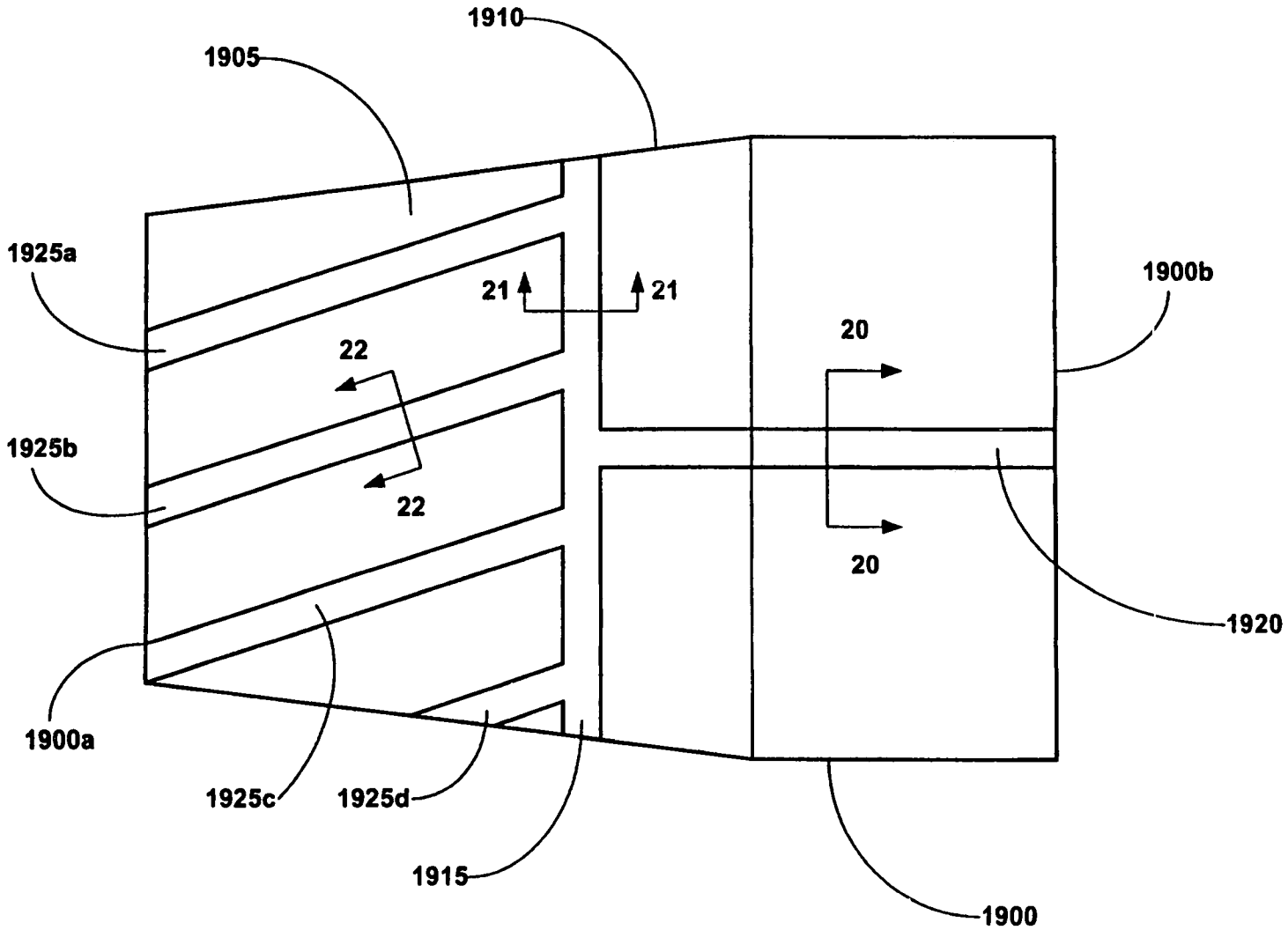
FIG. 19 is an illustration of a preferred embodiment of an expansion cone including a system for lubricating the interface between the expansion cone and a tubular member during the radial expansion of the tubular member.

Referring to FIG. 19, in an alternative embodiment, an expansion cone 1900 is used in the repair apparatus 300 that includes a front end 1900*a* and a rear end 1900*b*, includes a tapered portion 1905 having an outer surface 1910, a circumferential groove 1915, a first axial groove 1920, and one or more second axial grooves 1925*a*, 1925*b*, 1925*c* and 1925*d*.

In a preferred embodiment, the circumferential groove 1915 is fluidicly coupled to the axial grooves 1920 and 1925. In this manner, during the radial expansion process, lubricating fluids are preferably transmitted from the area behind the back 1900*b* of the expansion cone 1900 into the circumferential groove 1915. Thus, the trailing edge portion of the interface between the expansion cone 1900 and the tubular member 370 is provided with an increased supply of lubricant, thereby reducing the amount of force required to radially expand the tubular member 370. In a preferred embodiment, the lubricating fluids are injected into the first axial groove 1920 by pressurizing the region behind the back 1900*b* of the expansion cone 1900. In a preferred embodiment, the lubricant is further transmitted into the second axial grooves 1925 where the lubricant preferably cleans foreign materials from the tapered portion 1905 of the expansion cone 1900.

In a preferred embodiment, the expansion cone 1900 includes a plurality of circumferential grooves 1915. In a preferred embodiment, the cross sectional area of the circumferential groove 1915 ranges from about $2\times10^{-4}$ in$^2$ to $5\times10^{-2}$ in$^2$ in order to optimally provide lubrication to the trailing edge portion of the interface between the expansion cone 1900 and the tubular member 370 during the radial expansion process. In a preferred embodiment, the expansion cone 1900 includes circumferential grooves 1915 concentrated about the axial midpoint of the tapered portion 1905 in order to optimally provide lubrication to the trailing edge portion of the interface between the expansion cone 1900 and the tubular member 370 during the radial expansion process. In a preferred embodiment, the circumferential grooves 1915 are equally spaced along the trailing edge portion of the expansion cone 1900 in order to optimally provide lubrication to the trailing edge portion of the interface between the expansion cone 1900 and the tubular member 370 during the radial expansion process.

In a preferred embodiment, the expansion cone 1900 includes a plurality of first axial grooves 1920 coupled to each of the circumferential grooves 1915. In a preferred embodiment, the first axial grooves 1920 extend from the back 1900*b* of the expansion cone 1900 and intersect the circumferential groove 1915. In a preferred embodiment, the cross sectional area of the first axial groove 1920 ranges from about $2\times10^{-4}$ in$^2$ to $5\times10^{-2}$ in$^2$ in order to optimally provide lubrication to the trailing edge portion of the interface between the expansion cone 1900 and the tubular member 370 during the radial expansion process. In a preferred embodiment, the first axial groove 1920 intersects the circumferential groove 1915 in a perpendicular manner. In a preferred embodiment, the cross sectional area of the circumferential groove 1915 is greater than the cross sectional area of the first axial groove 1920 in order to minimize resistance to fluid flow. In a preferred embodiment, the circumferential spacing of the first axial grooves 1920 is greater than about 3 inches in order to optimally provide lubrication during the radial expansion process.

In a preferred embodiment, the expansion cone 1900 includes a plurality of second axial grooves 1925 coupled to each of the circumferential grooves 1915. In a preferred embodiment, the second axial grooves 1925 extend from the front 1900*a* of the expansion cone 1900 and intersect the circumferential groove 1915. In a preferred embodiment, the cross sectional area of the second axial grooves 1925 ranges from about $2\times10^{-4}$ in$^2$ to $5\times10^{-2}$ in$^2$ in order to optimally provide lubrication to the trailing edge portion of the interface between the expansion cone 1900 and the tubular member 370 during the radial expansion process. In a preferred embodiment, the second axial grooves 1925 intersect the circumferential groove 1915 in a perpendicular manner. In a preferred embodiment, the cross sectional area of the circumferential groove 1915 is greater than the cross sectional area of the second axial grooves 1925 in order to minimize resistance to fluid flow. In a preferred embodiment, the circumferential spacing of the second axial grooves 1925 is greater than about 3 inches in order to optimally provide lubrication during the radial expansion process. In a preferred embodiment, the second axial grooves 1925 intersect the longitudinal axis of the expansion cone 1900 at an angle greater than the angle of attack of the tapered portion 1905 in order to optimally provide lubrication during the radial expansion process.

Figure 20:
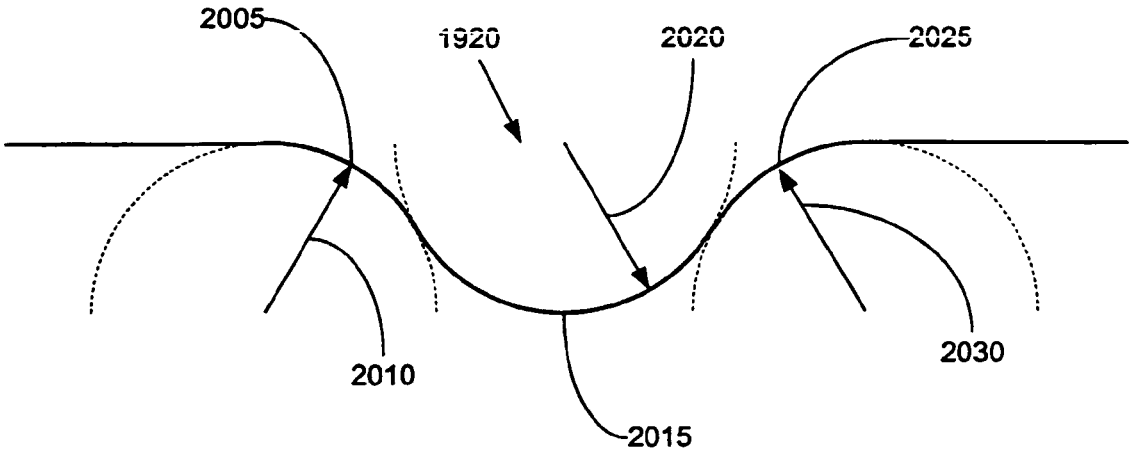
FIG. 20 is a cross-sectional illustration of the first axial groove of the expansion cone of FIG. 19.

Referring to FIG. 20, in a preferred embodiment, the first axial groove 1920 includes a first portion 2005 having a first radius of curvature 2010, a second portion 2015 having a second radius of curvature 2020, and a third portion 2025 having a third radius of curvature 2030. In a preferred embodiment, the radius of curvatures, 2010, 2020 and 2030 are substantially equal. In an exemplary embodiment, the radius of curvatures, 2010, 2020 and 2030 are all substantially equal to 0.0625 inches.

Figure 21:
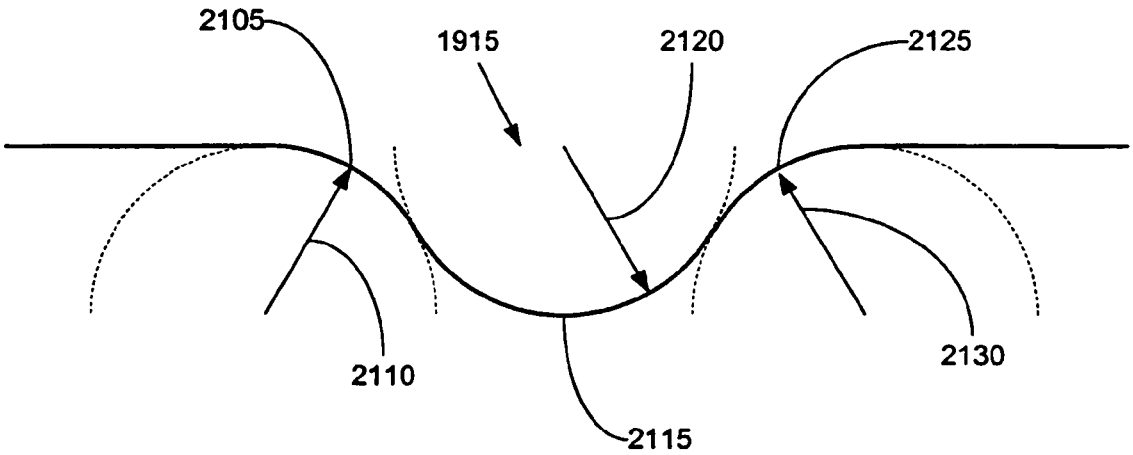
FIG. 21 is a cross-sectional illustration of the circumferential groove of the expansion cone of FIG. 19.

Referring to FIG. 21, in a preferred embodiment, the circumferential groove 1915 includes a first portion 2105 having a first radius of curvature 2110, a second portion 2115 having a second radius of curvature 2120, and a third portion 2125 having a third radius of curvature 2130. In a preferred embodiment, the radius of curvatures, 2110, 2120 and 2130 are substantially equal. In an exemplary embodiment, the radius of curvatures, 2110, 2120 and 2130 are all substantially equal to 0.125 inches.

Figure 22:
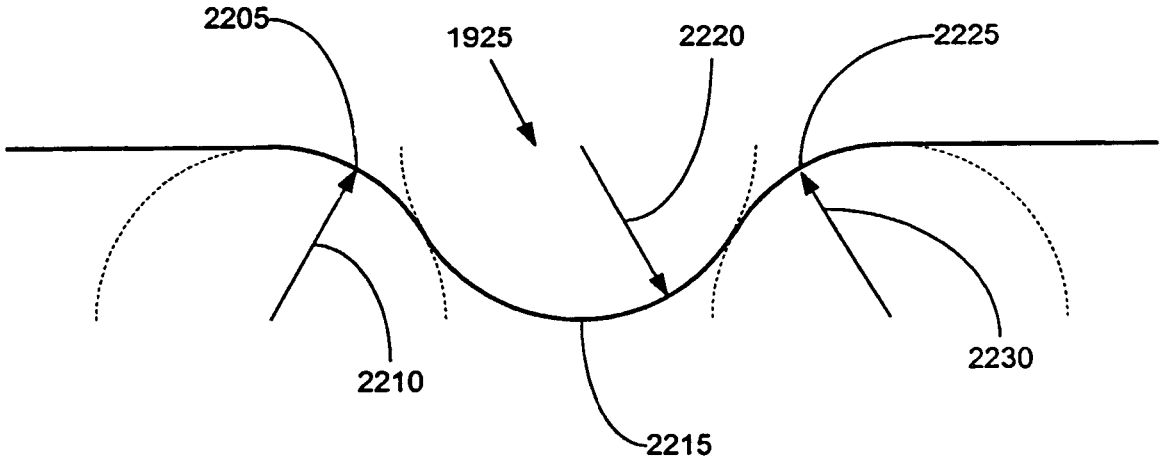
FIG. 22 is a cross-sectional illustration of one of the second axial grooves of the expansion cone of FIG. 19.

Referring to FIG. 22, in a preferred embodiment, the second axial groove 1925 includes a first portion 2205 having a first radius of curvature 2210, a second portion 2215 having a second radius of curvature 2220, and a third portion 2225 having a third radius of curvature 2230. In a preferred embodiment, the first radius of curvature 2210 is greater than the third radius of curvature 2230. In an exemplary embodiment, the first radius of curvature 2210 is equal to 0.5 inches, the second radius of curvature 2220 is equal to 0.0625 inches, and the third radius of curvature 2230 is equal to 0.125 inches.

Figure 23:
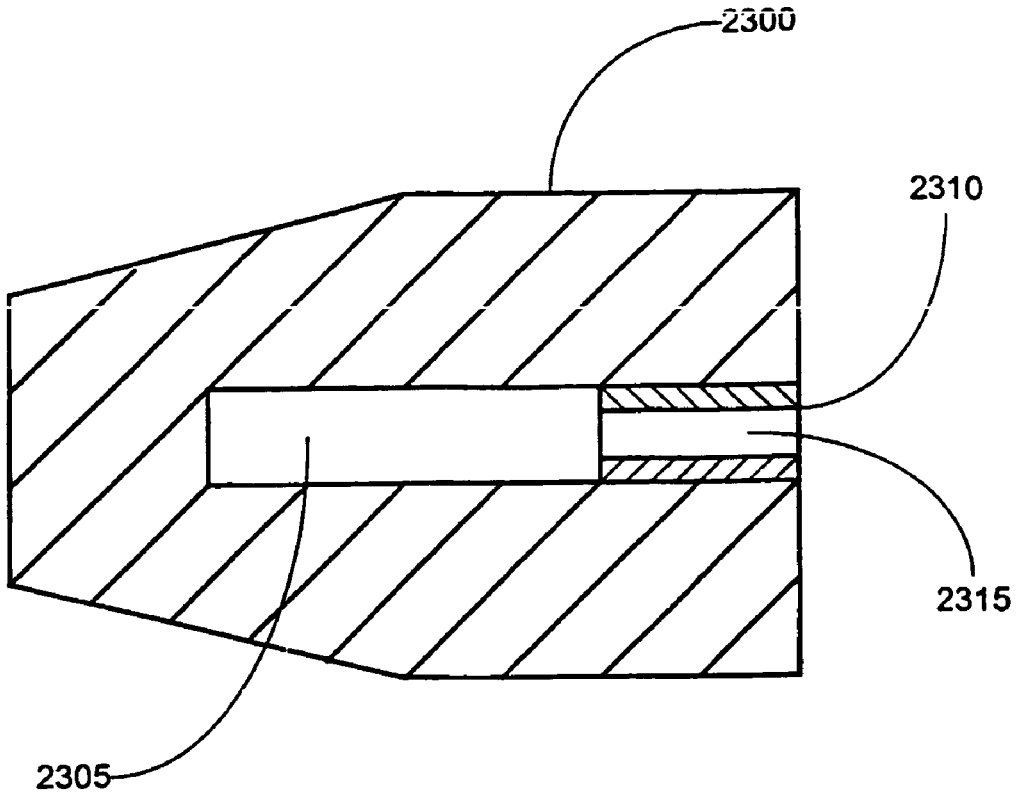
FIG. 23 is a cross sectional illustration of an embodiment of an expansion cone including internal flow passages having inserts for adjusting the flow of lubricant fluids.

Referring to FIG. 23, in an alternative embodiment, an expansion cone 2300 is used in the repair apparatus 300 that includes an internal flow passage 2305 having an insert 2310 including a flow passage 2315. In a preferred embodiment, the cross sectional area of the flow passage 2315 is less than the cross sectional area of the flow passage 2305. More generally, in a preferred embodiment, a plurality of inserts 2310 are provided, each with different sizes of flow passages 2315. In this manner, the flow passage 2305 is machined to a standard size, and the lubricant supply is varied by using different sized inserts 2310. In a preferred embodiment, the teachings of the expansion cone 2300 are incorporated into the expansion cones 1200, 1300, 1400, and 1700.

Figure 24:
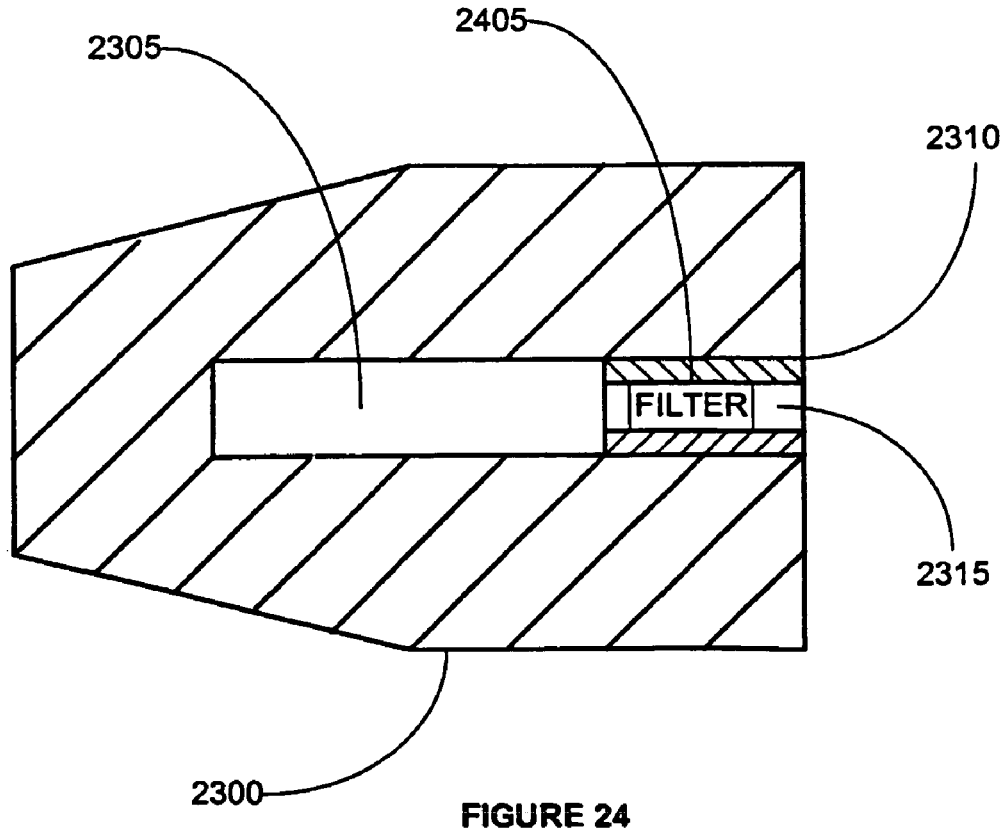
FIG. 24 is a cross sectional illustration of the expansion cone of FIG. 23 further including an insert having a filter for filtering out foreign materials from the lubricant fluids.

Referring to FIG. 24, in a preferred embodiment, the insert 2310 includes a filter 2405 for filtering particles and other foreign materials from the lubricant that passes into the flow passage 2305. In this manner, the foreign materials are prevented from clogging the flow passage 2305 and other flow passages within the expansion cone 2300.

The increased lubrication provided to the trailing edge portion of the expansion cones 1200, 1300, 1400, 1500, 1600, 1700, 1800, and 1900 greatly reduces the amount of galling or seizure caused by the interface between the expansion cones and the tubular member 370 during the radial expansion process thereby permitting larger continuous sections of tubulars to be radially expanded in a single continuous operation. Thus, use of the expansion cones 1200, 1300, 1400, 1500, 1600, 1700, 1800, and 1900 reduces the operating pressures required for radial expansion and thereby reduces the size of the pump 325. In addition, failure, bursting, and/or buckling of the tubular member 370 during the radial expansion process is significantly reduced, and the success ratio of the radial expansion process is greatly increased.

In a preferred embodiment, the lubricating fluids used with the expansion cones 1200, 1300, 1400, 1500, 1600, 1700, 1800 and 1900 for expanding the tubular member 370 have viscosities ranging from about 1 to 10,000 centipoise in order to optimize the injection of the lubricating fluids into the circumferential grooves of the expansion cones during the radial expansion process. In a preferred embodiment, the lubricating fluids used with the expansion cones 1200, 1300, 1400, 1500, 1600, 1700, 1800 and 1900 for expanding the tubular member 370 comprise various conventional lubricants available from various commercial vendors consistent with the teachings of the present disclosure in order to optimize the injection of the lubricating fluids into the circumferential grooves of the expansion cones during the radial expansion process.

Figure 25:
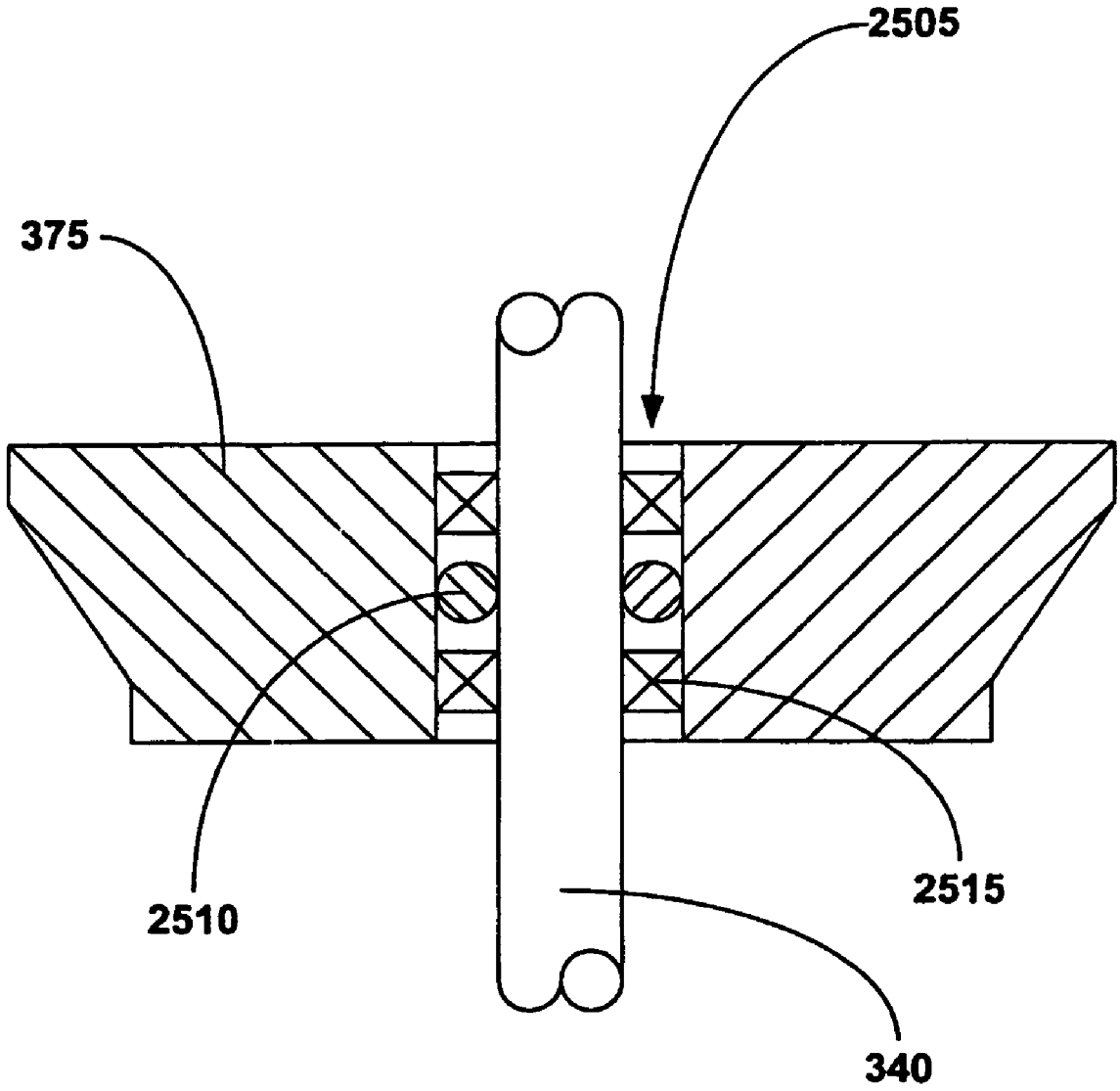
FIG. 25 is a fragmentary cross sectional illustration of an embodiment of the expansion cone of the repair apparatus of FIG. 3*a*.

In a preferred embodiment, as illustrated in FIG. 25, the expansion cone 375 further includes a central passage 2505 for receiving the support member 340 and the repair apparatus 300 further includes one or more sealing members 2510 and one or more bearing members 2515.

The sealing members 2510 are preferably adapted to fluidicly seal the dynamic interface between the central passage 2505 of the expansion cone 375 and the support member 340. The sealing members 2510 may be any number of conventional commercially available sealing members. In a preferred embodiment, the sealing members 2510 are conventional O-rings sealing members available from various commercial suppliers in order to optimally provide a fluidic seal.

The bearing members 2515 are preferably adapted to provide a sliding interface between the central passage 2505 of the expansion cone 375 and the support member 340. The bearing members 2515 may be any number of conventional commercially available bearings. In a preferred embodiment, the bearing members 2515 are wear bands available from Haliburton Energy Services in order to optimally provide a sliding interface that minimizes wear.

The sealing member 380 is coupled to the exterior surface of the expandable tubular member 375. The sealing member 380 is preferably adapted to fluidicly seal the interface between the expandable tubular member 375 and the wellbore casing 100 after the radial expansion of the expandable tubular member 375. The sealing member 380 may be any number of conventional commercially available sealing members. In a preferred embodiment, the sealing member 380 is a nitrile rubber sealing member available from Eustler, Inc. in order to optimally provide a high pressure, high load bearing seal between the expandable tubular member 375 and the casing 100.

As illustrated in FIG. 3*a*, in a preferred embodiment, during placement of the repair apparatus 300 within the wellbore casing 100, the repair apparatus 300 is supported by the support member 305. In a preferred embodiment, during placement of the repair apparatus 300 within the wellbore casing 100, fluidic materials within the wellbore casing 100 are conveyed to a location above the repair apparatus 300 using the fluid conduits 335, 345, and 355. In this manner, surge pressures during placement of the repair apparatus 300 within the wellbore casing 100 are minimized.

In a preferred embodiment, prior to placement of the repair apparatus 300 in the wellbore, the outer surfaces of the repair apparatus 300 are coated with a lubricating fluid to facilitate their placement the wellbore and reduce surge pressures. In a preferred embodiment, the lubricating fluid comprises BARO-LUB GOLD-SEAL™ brand drilling mud lubricant, available from Baroid Drilling Fluids, Inc. In this manner, the insertion of the repair apparatus 300 into the wellbore casing 100 is optimized.

In a preferred embodiment, after placement of the repair apparatus 300 within the wellbore casing 100, in step 210, the logging tool 310 is used in a conventional manner to locate the openings 115 in the wellbore casing 100.

In a preferred embodiment, once the openings 115 have been located by the logging tool 310, in step 215, the repair apparatus 300 is further positioned within the wellbore casing 100 with the sealing member 380 placed in opposition to the openings 115.

Figure 3B:
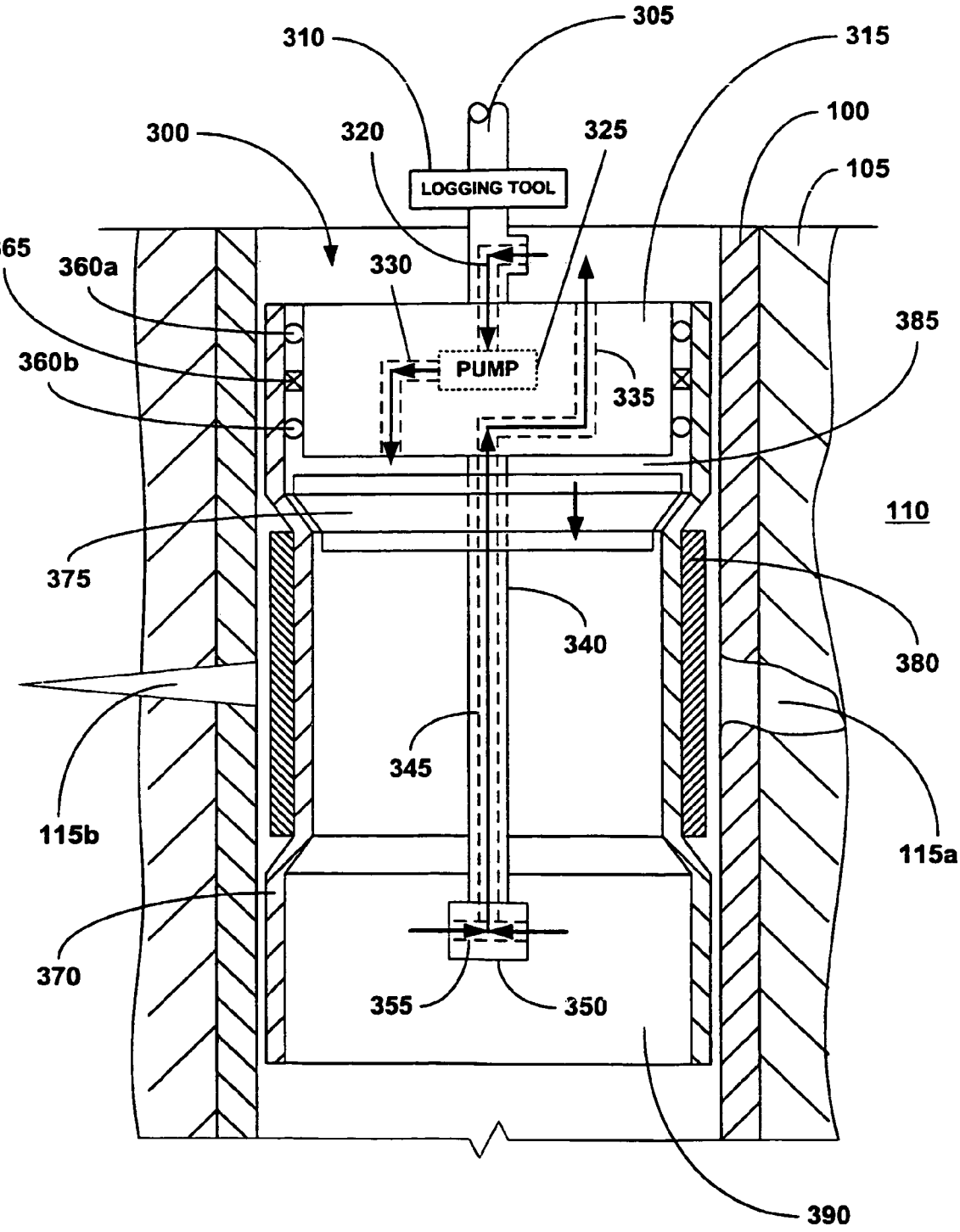
FIG. 3*b* is a fragmentary cross-sectional view of the radial expansion of the expandable tubular of the apparatus of FIG. 3*a*.
Figure 3C:
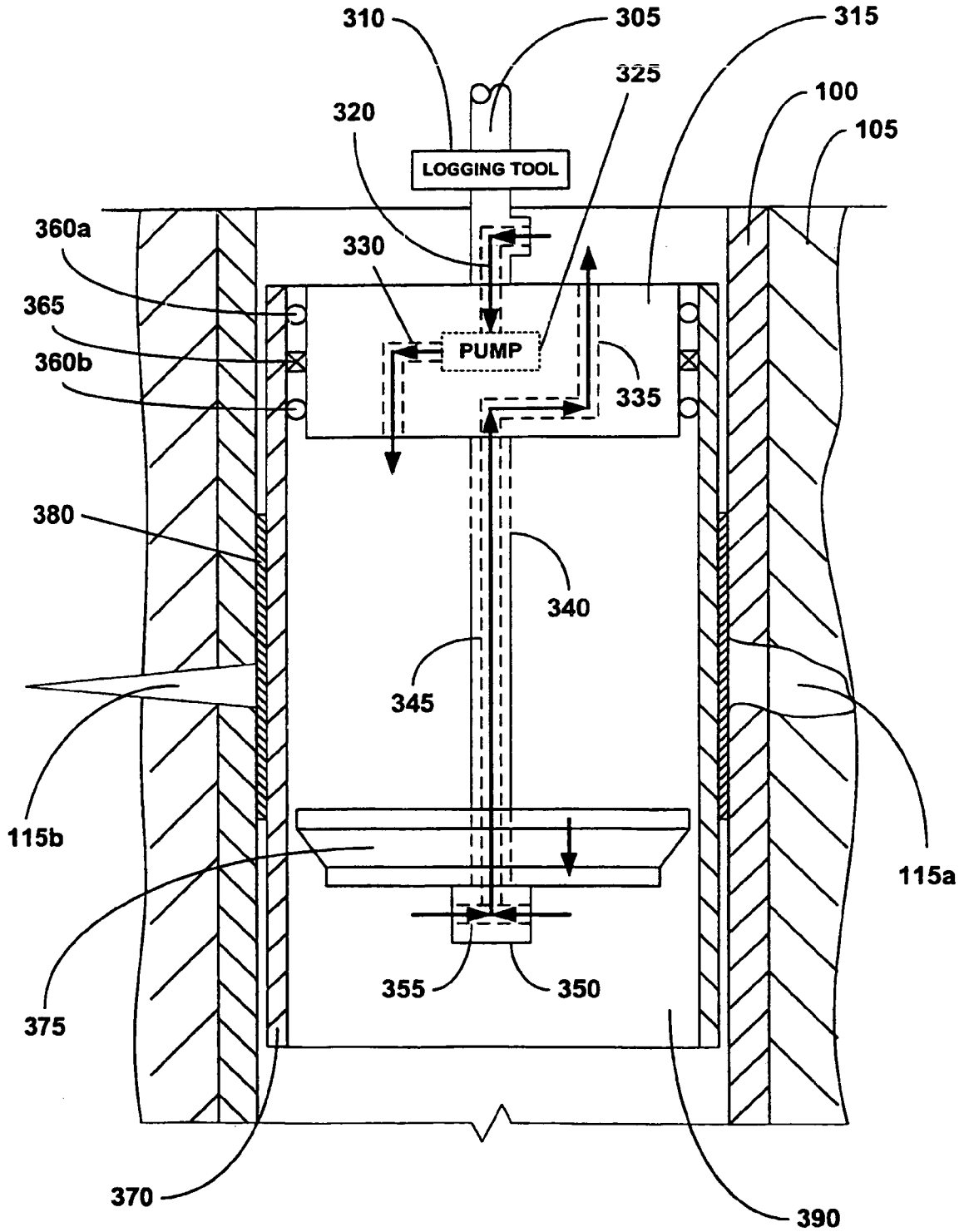
FIG. 3*c* is a fragmentary cross-sectional view of the completion of the radial expansion of the expandable tubular of the apparatus of FIG. 3*b*.

As illustrated in FIGS. 3*b* and 3*c*, in a preferred embodiment, after the repair apparatus 300 has been positioned with the sealing member 380 in opposition to the openings 115, in step 220, the tubular member 370 is radially expanded into contact with the wellbore casing 100. In a preferred embodiment, the tubular member 370 is radially expanded by displacing the expansion cone 375 in the axial direction. In a preferred embodiment, the expansion cone 375 is displaced in the axial direction by pressurizing the interior portion 385. In a preferred embodiment, the interior portion 385 is pressurized by pumping fluidic materials into the interior portion 385 using the pump 325.

In a preferred embodiment, the pump 325 pumps fluidic materials from the region above and proximate to the repair apparatus 300 into the interior portion 385 using the fluidic passages 320 and 330. In this manner, the interior portion 385 is pressurized and the expansion cone 375 is displaced in the axial direction. In this manner, the tubular member 370 is radially expanded into contact with the wellbore casing 100. In a preferred embodiment, the interior portion 385 is pressurized to operating pressures ranging from about 0 to 12,000 psi using flow rates ranging from about 0 to 500 gallons/minute. In a preferred embodiment, fluidic materials displaced by the axial movement of the expansion cone 375 are conveyed to a location above the repair apparatus 300 by the fluid conduits 335, 345, and 355. In a preferred embodiment, during the pumping of fluidic materials into the interior portion 385 by the pump 325, the tubular member 370 is maintained in a substantially stationary position.

Figure 3D:
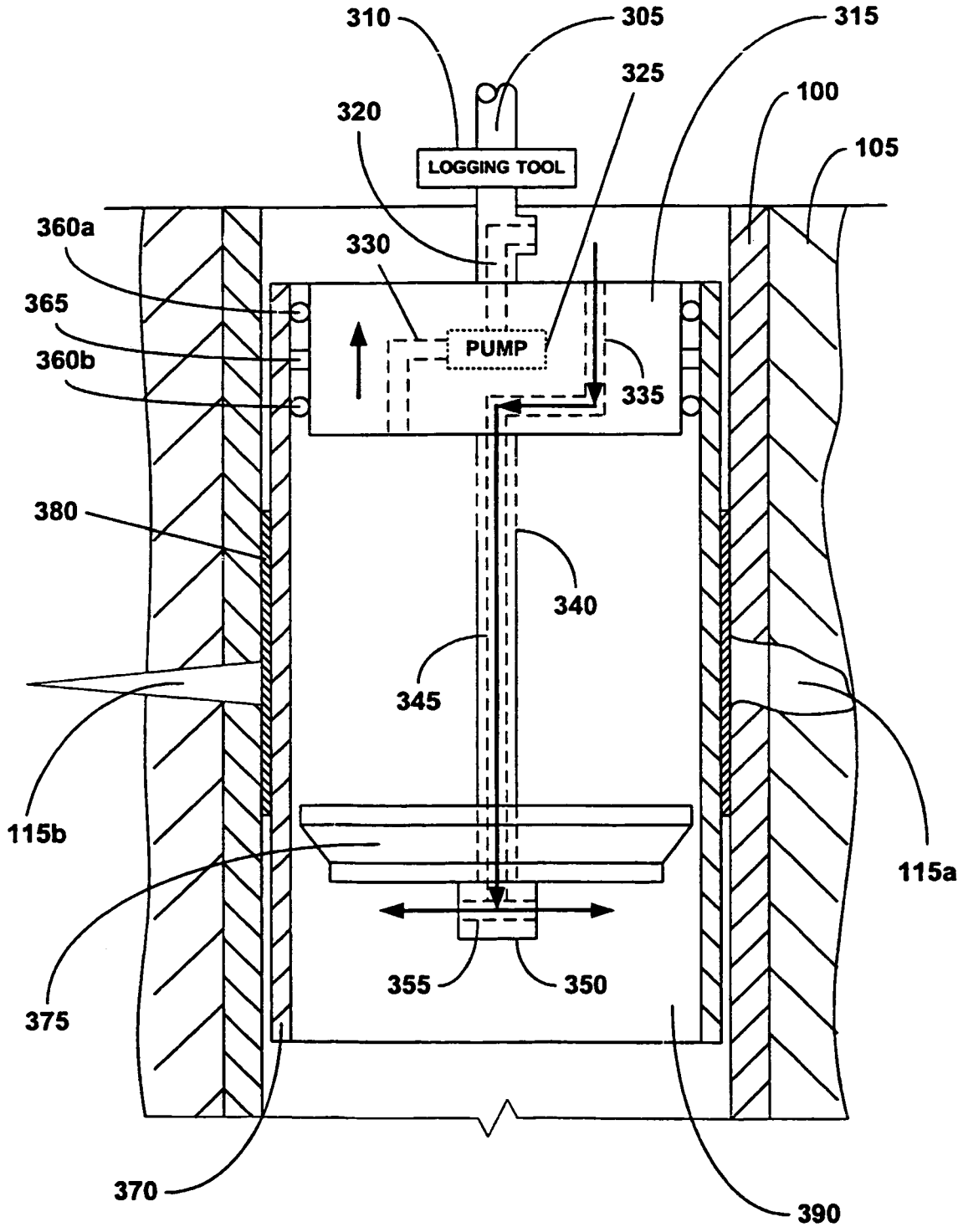
FIG. 3*d* is a fragmentary cross-sectional view of the removal of the repair apparatus from the repaired wellbore casing of FIG. 3*c*.

As illustrated in FIG. 3*d*, after the completion of the radial expansion of the tubular member 370, the locking member 365 is decoupled from the tubular member 370 and the repair apparatus 300 is removed from the wellbore casing 100. In a preferred embodiment, during the removal of the repair apparatus 300 from the wellbore casing 100, fluidic materials above the repair apparatus 300 are conveyed to a location below the repair apparatus 300 using the fluid conduits 335, 345 and 355. In this manner, the removal of the repair apparatus 300 from the wellbore casing is facilitated.

Figure 3E:
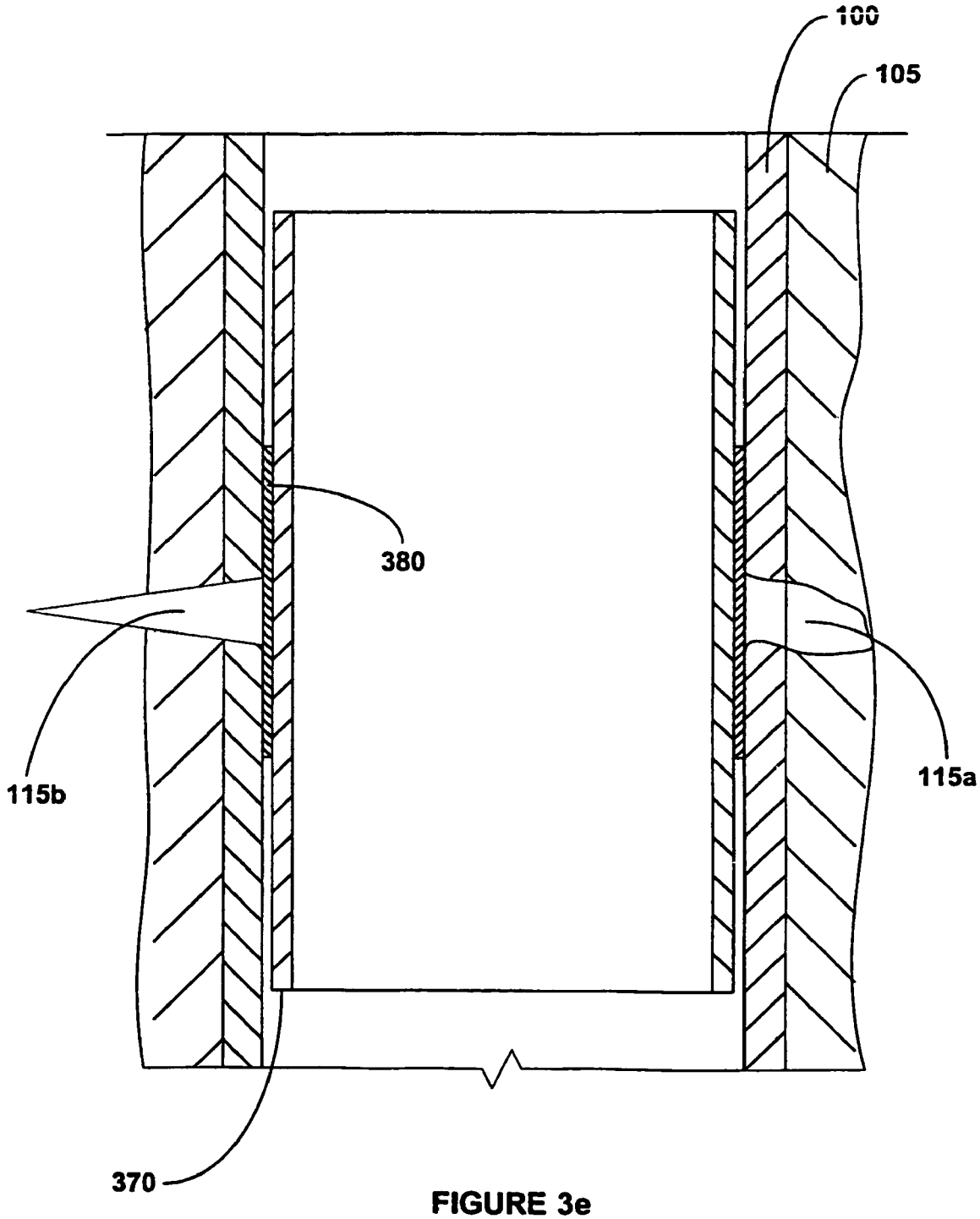
FIG. 3*e* is a fragmentary cross-sectional view of the repaired wellbore casing of FIG. 3*d*.

As illustrated in FIG. 3*e*, in a preferred embodiment, the openings 115 in the wellbore casing 100 are sealed off by the radially expanded tubular member 370 and the sealing member 380. In this manner, the repair apparatus 300 provides a compact and efficient device for repairing wellbore casings. More generally, the repair apparatus 300 is used to repair and form wellbore casings, pipelines, and structural supports.

Figure 26A:
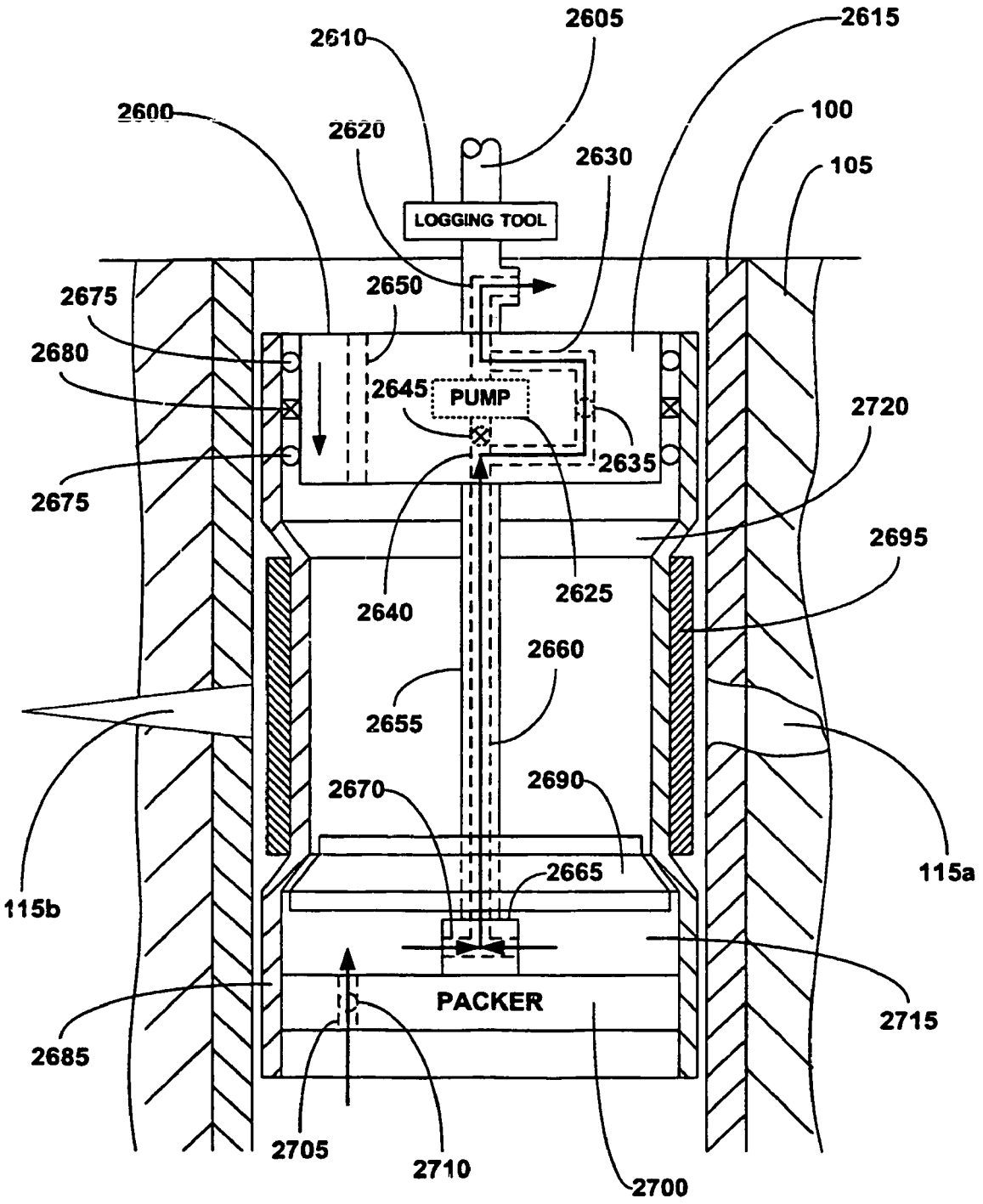
FIG. 26*a* is a fragmentary cross-sectional view of the placement of another embodiment of a repair apparatus within the wellbore casing of FIG. 1 wherein the expandable tubular member of the apparatus is positioned opposite the openings in the wellbore casing.

Referring to FIG. 26*a*, in an alternative embodiment, in step 205, a repair apparatus 2600 is positioned within the wellbore casing 100.

The repair apparatus 2600 preferably includes a first support member 2605, a logging tool 2610, a housing 2615, a first fluid conduit 2620, a pump 2625, a second fluid conduit 2630, a first valve 2635, a third fluid conduit 2640, a second valve 2645, a fourth fluid conduit 2650, a second support member 2655, a fifth fluid conduit 2660, the third support member 2665, a sixth fluid conduit 2670, sealing members 2675, a locking member 2680, an expandable tubular 2685, an expansion cone 2690, a sealing member 2695, a packer 2700, a seventh fluid conduit 2705, and a third valve 2710.

The first support member 2605 is preferably coupled to the logging tool 2610 and the housing 2615. The first support member 2605 is preferably adapted to be coupled to and supported by a conventional support member such as, for example, a wireline or a drill string. The first support member 2605 preferably has a substantially annular cross section in order to provide one or more conduits for conveying fluidic materials from the apparatus 2600. The first support member 2605 is further preferably adapted to convey electrical power and communication signals to the logging tool 2610, the pump 2625, the valves 2635, 2645, and 2710, and the packer 2700.

The logging tool 2610 is preferably coupled to the first support member 2605. The logging tool 2610 is preferably adapted to detect defects in the wellbore casing 100. The logging tool 2610 may be any number of conventional commercially available logging tools suitable for detecting defects in wellbore casings, pipelines, or structural supports. In a preferred embodiment, the logging tool 2610 is a CAST logging tool, available from Halliburton Energy Services in order to optimally provide detection of defects in the wellbore casing 100. In a preferred embodiment, the logging tool 2610 is contained within the housing 2615 in order to provide a repair apparatus 2600 that is rugged and compact.

The housing 2615 is preferably coupled to the first support member 2605, the second support member 2655, the sealing members 2675, and the locking member 2680. The housing 2615 is preferably releasably coupled to the tubular member 2685. The housing 2615 is further preferably adapted to contain and support the logging tool 2610 and the pump 2625.

The first fluid conduit 2620 is preferably fluidicly coupled to the inlet of the pump 2625, the exterior region above the housing 2615, and the second fluid conduit 2630. The first fluid conduit 2620 may be contained within the first support member 2605 and the housing 2615. The first fluid conduit 2620 is preferably adapted to convey fluidic materials such as, for example, drilling muds, water, and lubricants at operating pressures and flow rates ranging from about 0 to 12,000 psi and 0 to 500 gallons/minute in order to optimally propagate the expansion cone 2690.

The pump 2625 is fluidicly coupled to the first fluid conduit 2620 and the third fluid conduit 2640. The pump 2625 is further preferably contained within and support by the housing 2615. The pump 2625 is preferably adapted to convey fluidic materials from the first fluid conduit 2620 to the third fluid conduit 2640 at operating pressures and flow rates ranging from about 0 to 12,000 psi and 0 to 500 gallons/minute in order to optimally provide operating pressure for propagating the expansion cone 2690. The pump 2625 may be any number of conventional commercially available pumps. In a preferred embodiment, the pump 2625 is a flow control pump out section, available from Halliburton Energy Services in order to optimally provide fluid pressure for propagating the expansion cone 2690. The pump 2625 is preferably adapted to pressurize an interior portion 2715 of the expandable tubular member 2685 to operating pressures ranging from about 0 to 12,000 psi.

The second fluid conduit 2630 is fluidicly coupled to the first fluid conduit 2620 and the third fluid conduit 2640. The second fluid conduit 2630 is further preferably contained within the housing 2615. The second fluid conduit 2630 is preferably adapted to convey fluidic materials such as, for example, drilling muds, water, and lubricants at operating pressures and flow rates ranging from about 0 to 12,000 psi and 0 to 500 gallons/minute in order to optimally provide propagation of the expansion cone 2690.

The first valve 2635 is preferably adapted to controllably block the second fluid conduit 2630. In this manner, the flow of fluidic materials through the second fluid conduit 2630 is controlled. The first valve 2635 may be any number of conventional commercially available flow control valves. In a preferred embodiment, the first valve 2635 is a conventional ball valve available from various commercial suppliers.

The third fluid conduit 2640 is fluidicly coupled to the outlet of the pump 2625, the second fluid conduit 2630, and the fifth fluid conduit 2660. The third fluid conduit 2640 is further preferably contained within the housing 2615. The third fluid conduit 2640 is preferably adapted to convey fluidic materials such as, for example, drilling muds, water, and lubricants at operating pressures and flow rates ranging from about 0 to 12,000 psi and 0 to 500 gallons/minute in order to optimally provide propagation of the expansion cone 2690.

The second valve 2645 is preferably adapted to controllably block the third fluid conduit 2640. In this manner, the flow of fluidic materials through the third fluid conduit 2640 is controlled. The second valve 2645 may be any number of conventional commercially available flow control valves. In a preferred embodiment, the second valve 2645 is a conventional ball valve available from various commercial sources.

The fourth fluid conduit 2650 is fluidicly coupled to the exterior region above the housing 2615 and the interior region 2720 within the expandable tubular member 2685. The fourth fluid conduit 2650 is further preferably contained within the housing 2615. The fourth fluid conduit 2650 is preferably adapted to convey fluidic materials such as, for example, drilling muds, water, and lubricants at operating pressures and flow rates ranging from about 0 to 5,000 psi and 0 to 500 gallons/minute in order to optimally vent fluidic materials in front of the expansion cone 2690 during the radial expansion process.

The second support member 2655 is coupled to the housing 2615 and the third support member 2665. The second support member 2655 is further preferably movably and sealingly coupled to the expansion cone 2690. The second support member 2655 preferably has a substantially annular cross section in order to provide one or more conduits for conveying fluidic materials. In a preferred embodiment, the second support member 2655 is centrally positioned within the expandable tubular member 2685.

The fifth fluid conduit 2660 is fluidicly coupled to the third fluid conduit 2640 and the sixth fluid conduit 2670. The fifth fluid conduit 2660 is further preferably contained within the second support member 2655. The fifth fluid conduit 2660 is preferably adapted to convey fluidic materials such as, for example, drilling muds, water, and lubricants at operating pressures and flow rates ranging from about 0 to 12,000 psi and 0 to 500 gallons/minute in order to optimally propagate the expansion cone 2690.

The third support member 2665 is coupled to the second support member 2655. The third support member 2665 is further preferably adapted to support the expansion cone 2690. The third support member 2665 preferably has a substantially annular cross section in order to provide one or more conduits for conveying fluidic materials.

The sixth fluid conduit 2670 is fluidicly coupled to the fifth fluid conduit 2660 and the interior region 2715 of the expandable tubular member 2685 below the expansion cone 2690. The sixth fluid conduit 2670 is further preferably contained within the third support member 2665. The sixth fluid conduit 2670 is preferably adapted to convey fluidic materials such as, for example, drilling muds, water, and lubricants at operating pressures and flow rates ranging from about 0 to 12,000 psi and 0 to 500 gallons/minute in order to optimally propagate the expansion cone 2690.

The sealing members 2675 are preferably coupled to the housing 2615. The sealing members 2675 are preferably adapted to seal the interface between the exterior surface of the housing 2615 and the interior surface of the expandable tubular member 2685. In this manner, the interior portion 2730 of the expandable tubular member 2685 is fluidicly isolated from the exterior region above the housing 2615. The sealing members 2675 may be any number of conventional commercially available sealing members. In a preferred embodiment, the sealing members 2675 are conventional O-ring sealing members available from various commercial suppliers in order to optimally provide a pressure seal.

The locking member 2680 is preferably coupled to the housing 2615. The locking member 2680 is further preferably releasably coupled to the expandable tubular member 2685. In this manner, the housing 2615 is controllably coupled to the expandable tubular member 2685. In this manner, the housing 2615 is preferably released from the expandable tubular member 2685 upon the completion of the radial expansion of the expandable tubular member 2685. The locking member 2680 may be any number of conventional commercially available releasable locking members. In a preferred embodiment, the locking member 2680 is a hydraulically released slip available from various commercial vendors in order to optimally provide support during the radial expansion process.

In an alternative embodiment, the locking member 2680 is replaced by or supplemented by one or more conventional shear pins in order to provide an alternative means of controllably releasing the housing 2615 from the expandable tubular member 2685.

In another alternative embodiment, the seals 2675 and locking member 2680 are omitted.

The expandable tubular member 2685 is releasably coupled to the locking member 2680. The expandable tubular member 2685 is preferably adapted to be radially expanded by the axial displacement of the expansion cone 2690. In a preferred embodiment, the expandable tubular member 2685 is substantially identical to the expandable tubular member 370 described above with reference to the repair apparatus 300.

The expansion cone 2690 is movably coupled to the second support member 2655. The expansion cone 2690 is preferably adapted to be axially displaced upon the pressurization of the interior region 2715 of the expandable tubular member 2685. The expansion cone 2690 is further preferably adapted to radially expand the expandable tubular member 2685. In a preferred embodiment, the expansion cone 2690 is substantially identical to the expansion cone 375 described above with reference to the repair apparatus 300.

The sealing member 2695 is coupled to the exterior surface of the expandable tubular member 2685. The sealing member 2695 is preferably adapted to fluidicly seal the interface between the expandable tubular member 2685 and the wellbore casing 100 after the radial expansion of the expandable tubular member 2685. The sealing member 2695 may be any number of conventional commercially available sealing members. In a preferred embodiment, the sealing member 2695 is a nitrile rubber sealing member available from Eustler, Inc. in order to optimally provide a high pressure seal between the casing 100 and the expandable tubular member 2685.

The packer 2700 is coupled to the third support member 2665. The packer 2700 is further releasably coupled to the expandable tubular member 2685. The packer 2700 is preferably adapted to fluidicly seal the interior region 2715 of the expandable tubular member 2685. In this manner, the interior region 2715 of the expandable tubular member 2685 is pressurized. The packer 2700 may be any number of conventional commercially available packer devices. In a preferred embodiment, the packer 2700 is an EZ Drill Packer available from Halliburton Energy Services in order to optimally provide a high pressure seal below the expansion cone 2690 that can be easily removed upon the completion of the radial expansion process.

The seventh fluid conduit 2705 is fluidicly coupled to the interior region 2715 of the expandable tubular member 2685 and an exterior region below the apparatus 2600. The seventh fluid conduit 2705 is further preferably contained within the packer 2700. The seventh fluid conduit 2705 is preferably adapted to convey fluidic materials such as, for example, drilling muds, water, and lubricants at operating pressures and flow rates ranging from about 0 to 1,500 psi and 0 to 200 gallons/minute in order to optimally provide a fluid conduit that minimizes back pressure on the apparatus 2600 when the apparatus 2600 is positioned within the wellbore casing 100.

The third valve 2710 is preferably adapted to controllably block the seventh fluid conduit 2705. In this manner, the flow of fluidic materials through the seventh fluid conduit 2705 is controlled. The third valve 2710 may be any number of conventional commercially available flow control valves. In a preferred embodiment, the third valve 2710 is a EZ Drill one-way check valve available from Halliburton Energy Services in order to optimally provide one-way flow through the packer 2700 while providing a pressure seal during the radial expansion process.

As illustrated in FIG. 26*a*, in a preferred embodiment, during placement of the repair apparatus 2600 within the wellbore casing 100, the apparatus 2600 is supported by the support member 2605. In a preferred embodiment, during placement of the apparatus 2600 within the wellbore casing 100, fluidic materials within the wellbore casing 100 are conveyed to a location above the apparatus 2600 using the fluid conduits 2705, 2670, 2660, 2640, 2630, and 2620. In this manner, surge pressures during placement of the apparatus 2600 within the wellbore casing 100 are minimized.

In a preferred embodiment, prior to placement of the apparatus 2600 in the wellbore casing 100, the outer surfaces of the apparatus 2600 are coated with a lubricating fluid to facilitate their placement the wellbore and reduce surge pressures. In a preferred embodiment, the lubricating fluid comprises BARO-LUB GOLD-SEAL™ brand drilling mud lubricant, available from Baroid Drilling Fluids, Inc. In this manner, the insertion of the apparatus 2600 into the wellbore casing 100 is optimized.

In a preferred embodiment, after placement of the apparatus 2600 within the wellbore casing 100, in step 210, the logging tool 2610 is used in a conventional manner to locate the openings 115 in the wellbore casing 100.

In a preferred embodiment, once the openings 115 have been located by the logging tool 2610, in step 215, the apparatus 2600 is further positioned within the wellbore casing 100 with the sealing member 2695 placed in opposition to the openings 115.

Figure 26B:
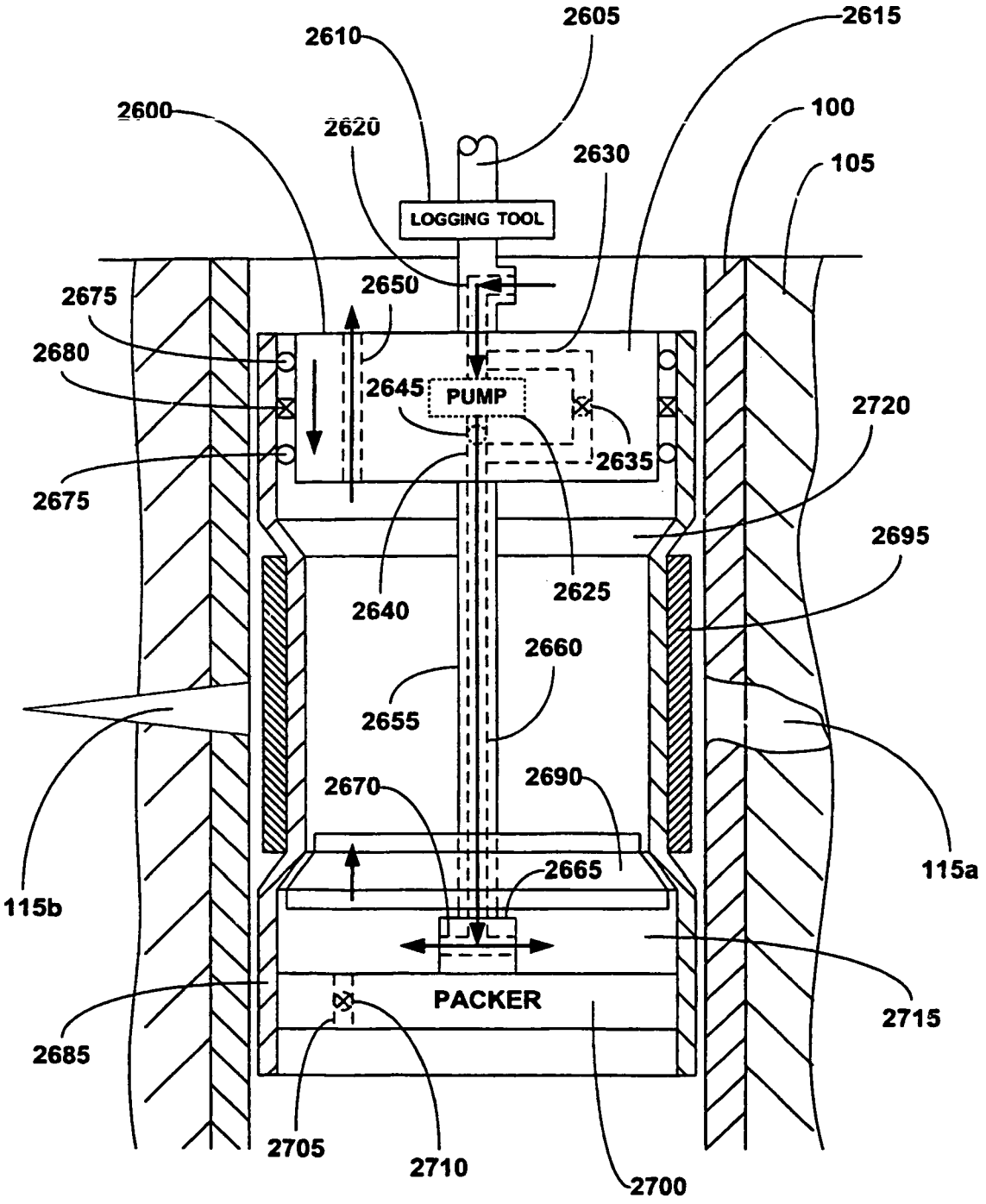
FIG. 26*b* is a fragmentary cross-sectional view of the radial expansion of the expandable tubular of the apparatus of FIG. 26*a*
Figure 26C:
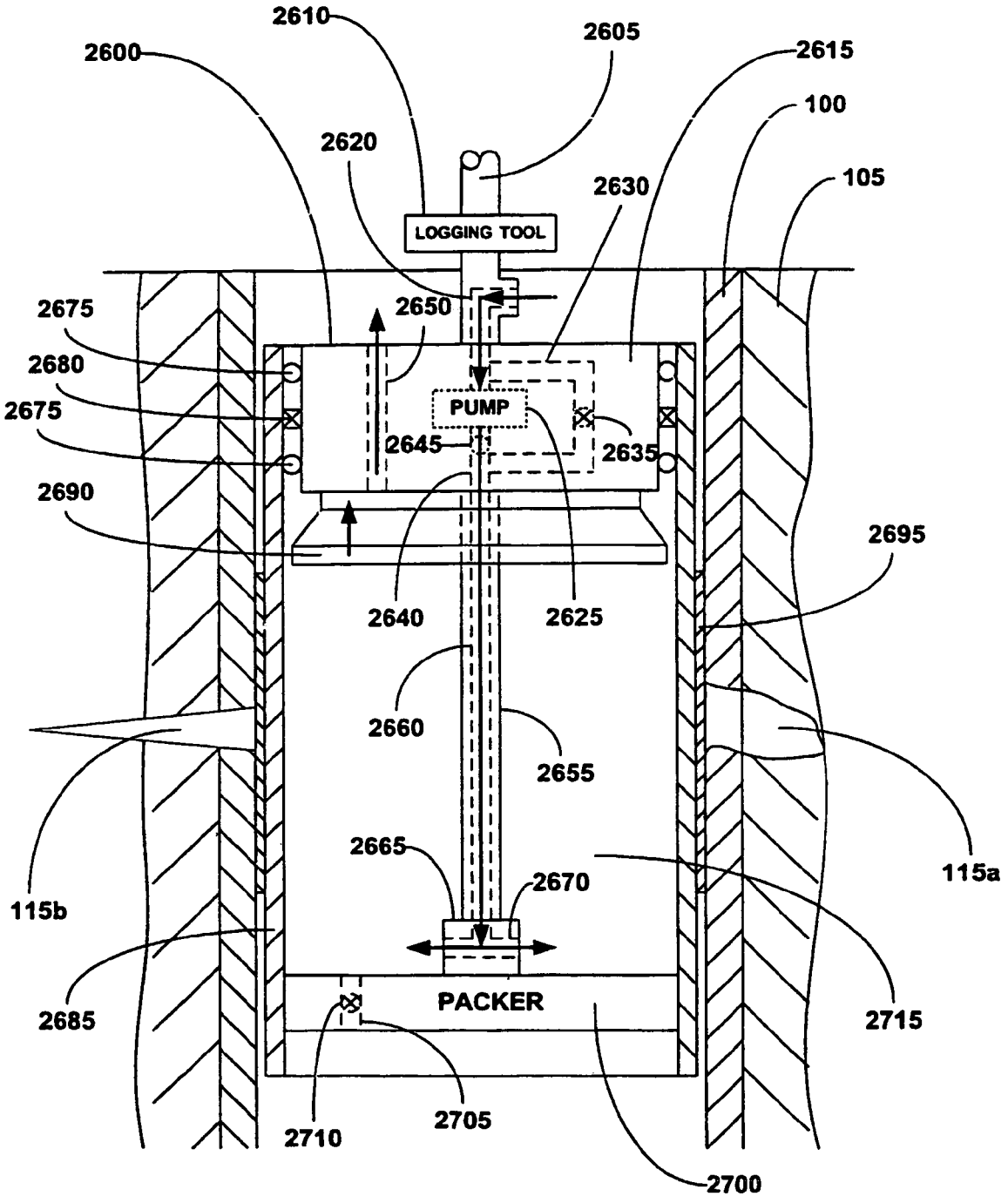
FIG. 26*c* is a fragmentary cross-sectional view of the completion of the radial expansion of the expandable tubular of the apparatus of FIG. 26*b*.

As illustrated in FIGS. 26*b* and 26*c*, in a preferred embodiment, after the apparatus 2600 has been positioned with the sealing member 2695 in opposition to the openings 115, in step 220, the tubular member 2685 is radially expanded into contact with the wellbore casing 100. In a preferred embodiment, the tubular member 2685 is radially expanded by displacing the expansion cone 2690 in the axial direction. In a preferred embodiment, the expansion cone 2690 is displaced in the axial direction by pressurizing the interior chamber 2715. In a preferred embodiment, the interior chamber 2715 is pressurized by pumping fluidic materials into the interior chamber 2715 using the pump 2625.

In a preferred embodiment, the pump 2625 pumps fluidic materials from the region above and proximate to the apparatus 2600 into the interior chamber 2715 using the fluid conduits 2620, 2640, 2660, and 2670. In this manner, the interior chamber 2715 is pressurized and the expansion cone 2690 is displaced in the axial direction. In this manner, the tubular member 2685 is radially expanded into contact with the wellbore casing 100. In a preferred embodiment, the interior chamber 2715 is pressurized to operating pressures ranging from about 0 to 12,000 psi using flow rates ranging from about 0 to 500 gallons/minute. In a preferred embodiment, fluidic materials within the interior chamber 2720 displaced by the axial movement of the expansion cone 2690 are conveyed to a location above the apparatus 2600 by the fluid conduit 2650. In a preferred embodiment, during the pumping of fluidic materials into the interior chamber 2715 by the pump 2625, the tubular member 2685 is maintained in a substantially stationary position.

Figure 26D:
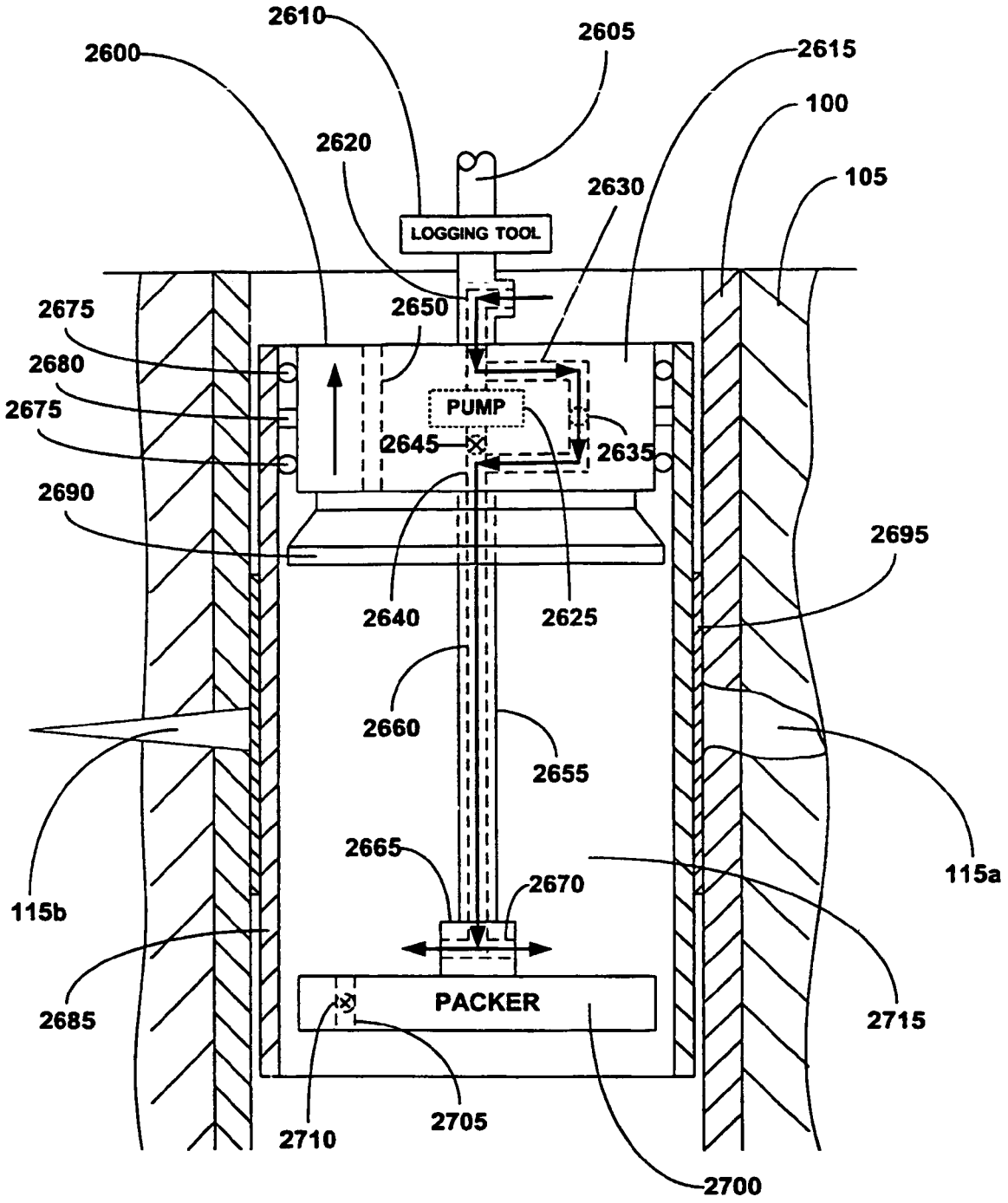
FIG. 26*d* is a fragmentary cross-sectional view of the removal of the repair apparatus from the repaired wellbore casing of FIG. 26*c*.

As illustrated in FIG. 26*d*, after the completion of the radial expansion of the tubular member 2685, the locking member 2680 and packer 2700 are decoupled from the tubular member 2685, and the apparatus 2600 is removed from the wellbore casing 100. In a preferred embodiment, during the removal of the apparatus 2600 from the wellbore casing 100, fluidic materials above the apparatus 2600 are conveyed to a location below the apparatus 2600 using the fluid conduits 2620, 2630, 2640, 2660, and 2670. In this manner, the removal of the apparatus 2600 from the wellbore casing is facilitated.

Figure 26E:
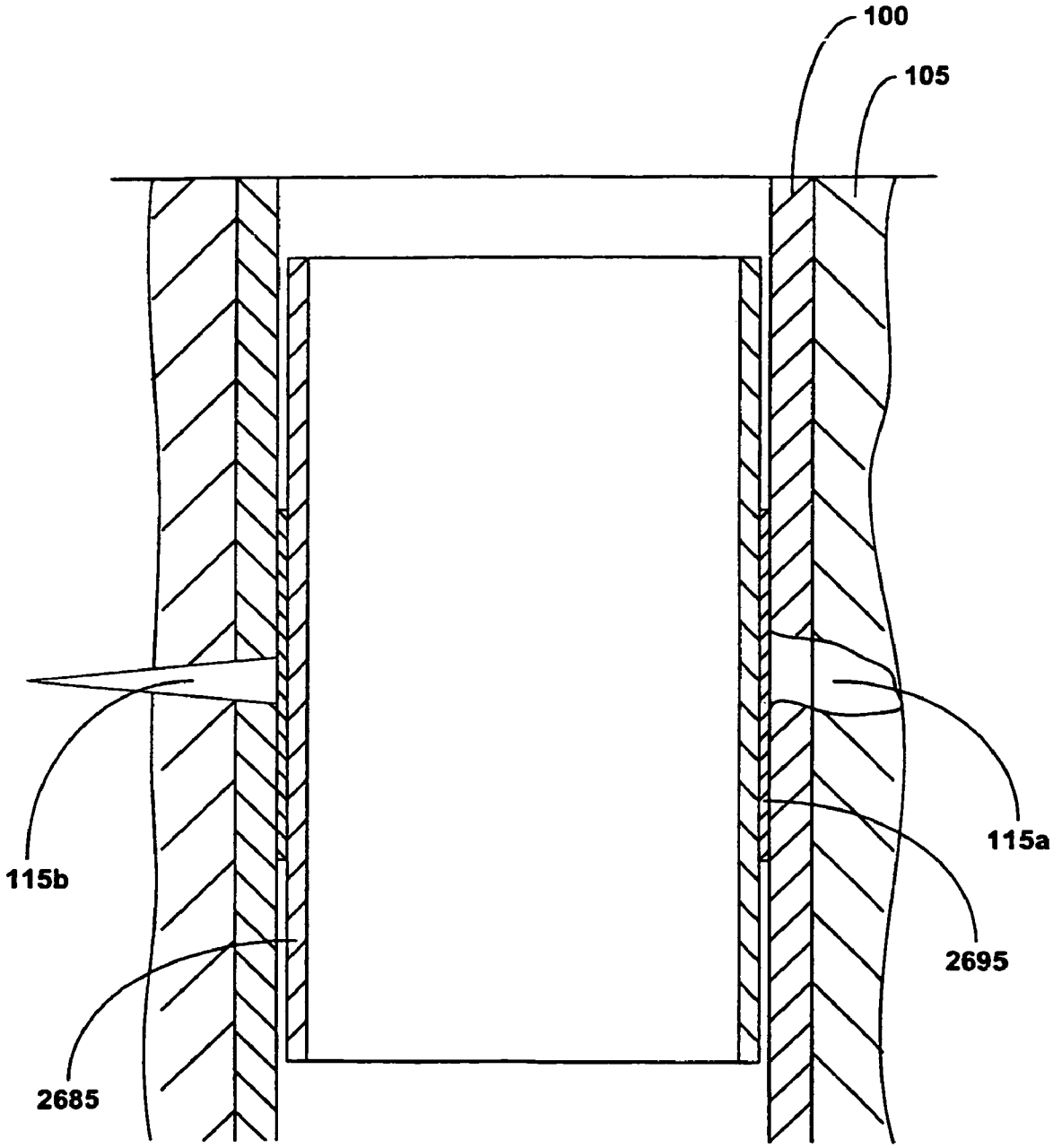
FIG. 26*e* is a fragmentary cross-sectional view of the repaired wellbore casing of FIG. 26*d*.

As illustrated in FIG. 26*e*, in a preferred embodiment, the openings 115 in the wellbore casing 100 are sealed off by the radially expanded tubular member 2685 and the sealing member 2695. In this manner, the repair apparatus 2600 provides a compact and efficient device for repairing wellbore casings. More generally, the repair apparatus 2600 is used to repair and form wellbore casings, pipelines, and structural supports.

A method of repairing an opening in a tubular member has been described that includes positioning an expandable tubular, an expansion cone, and a pump within the tubular member, positioning the expandable tubular in opposition to the opening in the tubular member, pressurizing an interior portion of the expandable tubular using the pump, and radially expanding the expandable tubular into intimate contact with the tubular member using the expansion cone. In a preferred embodiment, the method further includes locating the opening in the tubular member using an opening locator. In a preferred embodiment, the tubular member is a wellbore casing. In a preferred embodiment, the tubular member is a pipeline. In a preferred embodiment, the tubular member is a structural support. In a preferred embodiment, the method further includes lubricating the interface between the expandable tubular member and the expansion cone. In a preferred embodiment, lubricating includes coating the expandable tubular member with a lubricant. In a preferred embodiment, lubricating includes injecting a lubricating fluid into the trailing edge of the interface between the expandable tubular member and the expansion cone. In a preferred embodiment, lubricating includes coating the expandable tubular member with a first component of a lubricant and circulating a second component of the lubricant into contact with the coating on the expandable tubular member. In a preferred embodiment, the method further includes sealing off a portion of the expandable tubular member.

An apparatus for repairing a tubular member also has been described that includes a support member, an expandable tubular member removably coupled to the support member, an expansion cone movably coupled to the support member and a pump coupled to the support member adapted to pressurize a portion of the interior of the expandable tubular member. In a preferred embodiment, the expandable tubular member includes a coating of a lubricant. In a preferred embodiment, the expandable tubular member includes a coating of a first component of a lubricant. In a preferred embodiment, the expandable tubular member includes a sealing member coupled to the outer surface of the expandable tubular member. In a preferred embodiment, the expandable tubular member includes a first end having a first outer diameter, an intermediate portion coupled to the first end having an intermediate outer diameter and a second end having a second outer diameter coupled to the intermediate portion having a second outer diameter, wherein the first and second outer diameters are greater than the intermediate outer diameter. In a preferred embodiment, the first end, second end, and intermediate portion of the expandable tubular member have wall thicknesses $t_1$, $t_2$, and $t_{INT}$ and inside diameters $D_1$, $D_2$ and $D_{INT}$; and the relationship between the wall thicknesses $t_1$, $t_2$, and $t_{INT}$, the inside diameters $D_1$, $D_2$ and $D_{INT}$, the inside diameter $D_{TUBE}$ of the tubular member that the expandable tubular member will be inserted into, and the outside diameter $D_{cone}$ of the expansion cone is given by the following expression:

$$D_{TUBE} - 2 * t_1 \geq D_1 \geq \frac{1}{t_1}[(t_1 - t_{INT}) * D_{cone} + t_{INT} * D_{INT}]$$

where $t_1 = t_2$; and $D_1 = D_2$. In a preferred embodiment, the expandable tubular member includes a sealing member coupled to the outside surface of the intermediate portion. In a preferred embodiment, the expandable tubular member includes a first transition portion coupled to the first end and the intermediate portion inclined at a first angle and a second transition portion coupled to the second end and the intermediate portion inclined at a second angle, wherein the first and second angles range from about 5 to 45 degrees. In a preferred embodiment, the expansion cone includes an expansion cone surface having an angle of attack ranging from about 10 to 40 degrees. In a preferred embodiment, the expansion cone includes a first expansion cone surface having a first angle of attack and a second expansion cone surface having a second angle of attack, wherein the first angle of attack is greater than the second angle of attack. In a preferred embodiment, the expansion cone includes an expansion cone surface having a substantially parabolic profile. In a preferred embodiment the expansion cone includes an inclined surface including one or more lubricating grooves. In a preferred embodiment, the expansion cone includes one or more internal lubricating passages coupled to each of the lubricating grooves.

A method of coupling a first tubular member to a second tubular member, wherein the outside diameter of the first tubular member is less than the inside diameter of the second tubular member also has been described that includes positioning at least a portion of the first tubular member within the second tubular member, pressurizing a portion of the interior of the first tubular member by pumping fluidic materials proximate the first tubular member into the portion of the interior of the first tubular member, and displacing an expansion cone within the interior of the first tubular member. In a preferred embodiment, the second tubular member is selected from the group consisting of a wellbore casing, a pipeline, and a structural support. In a preferred embodiment, the method further includes lubricating the interface between the first tubular member and the expansion cone. In a preferred embodiment, the lubricating includes coating the first tubular member with a lubricant. In a preferred embodiment, the lubricating includes injecting a lubricating fluid into the trailing edge of the interface between the first tubular member and the expansion cone. In a preferred embodiment, the lubricating includes coating the first tubular member with a first component of a lubricant and circulating a second component of the lubricant into contact with the coating on the first tubular member. In a preferred embodiment, the method further includes sealing off a portion of the first tubular member.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

The invention claimed is:

1. A method of repairing an opening in a tubular member, comprising:

positioning an expandable tubular, an expansion cone, and a pump within the tubular member;

positioning the expandable tubular in opposition to the opening in the tubular member;

pressurizing an interior portion of the expandable tubular by operating the pump within the tubular member; and radially expanding the expandable tubular into intimate contact with the tubular member using the expansion cone.

2. The method of claim 1, further comprising:

locating the opening in the tubular member using an opening locator.

3. The method of claim 1, wherein the tubular member comprises a wellbore casing.

4. The method of claim 1, wherein the tubular member comprises a pipeline.

5. The method of claim 1, wherein the tubular member comprises a structural support.

6. The method of claim 1, further comprising:

sealing off a portion of the expandable tubular member.

7. The method of claim 1, further comprising:

lubricating the interface between the expandable tubular member and the expansion cone.

8. The method of claim 7, wherein lubricating comprises: coating the expandable tubular member with a lubricant.

9. The method of claim 7, wherein lubricating comprises: injecting a lubricating fluid into the trailing edge of the interface between the expandable tubular member and the expansion cone.

10. The method of claim 7, wherein lubricating comprises: coating the expandable tubular member with a first component of a lubricant; and circulating a second component of the lubricant into contact with the coating on the expandable tubular member.

11. An apparatus for repairing a tubular member, comprising:

a support member; an expandable tubular member removably coupled to the support member;

an expansion cone movably coupled to the support member; and a pump coupled to the support member positioned within the expandable tubular member adapted to pressurize a portion of the interior of the expandable tubular member;

wherein the expandable tubular member includes:

a first end having a first outer diameter; an intermediate portion coupled to the first end having an intermediate outer diameter; and a second end having a second outer diameter coupled to the intermediate portion having a second outer diameter;

wherein the first and second outer diameters are greater than the intermediate outer diameter.

12. The apparatus of claim 11, wherein the expandable tubular member comprises:

a coating of a lubricant.

13. The apparatus of claim 11, wherein the expandable tubular member comprises:

a coating of a first component of a lubricant.

14. The apparatus of claim 11, wherein the expandable tubular member comprises:

a sealing member coupled to the outer surface of the expandable tubular member.

15. The apparatus of claim 11, wherein the first end, second end, and intermediate portion of the expandable tubular member have wall thicknesses $t_1$, $t_2$, and $t_{INT}$ and inside diameters $D_1$, $D_2$ and $D_{INT}$; and wherein the relationship between the wall thicknesses $t_1$, $t_2$, and $t_{INT}$, the inside diameters $D_1$, $D_2$ and $D_{INT}$, the inside diameter $D_{TUBE}$ of the tubular member that the expandable tubular member will be inserted into, and the outside diameter $D_{cone}$ of the expansion cone is given by the following expression:

$$D_{TUBE} - 2 * t_1 \geq D_1 \geq \frac{1}{t_1}[(t_1 - t_{INT}) * D_{cone} + t_{INT} * D_{INT}]$$

where $t_1 = t_2$; and $D_1 = D_2$.

16. The apparatus of claim 11, wherein the expandable tubular member comprises: a sealing member coupled to the outside surface of the intermediate portion.

17. The apparatus of claim 11, wherein the expandable tubular member comprises: a first transition portion coupled to the first end and the intermediate portion inclined at a first angle; and a second transition portion coupled to the second end and the intermediate portion inclined at a second angle; wherein the first and second angles range from about 5 to 45 degrees.

18. The apparatus of claim 11, wherein the expansion cone comprises:

an expansion cone surface having an angle of attack ranging from about 10 to 40 degrees.

19. The apparatus of claim 11, wherein the expansion cone comprises:

a first expansion cone surface having a first angle of attack; and a second expansion cone surface having a second angle of attack;

wherein the first angle of attack is greater than the second angle of attack.

20. The apparatus of claim 11, wherein the expansion cone comprises:

an expansion cone surface having a substantially parabolic profile.

21. The apparatus of claim 11, wherein the expansion cone comprises:

an inclined surface including one or more lubricating grooves.

22. The apparatus of claim 21, wherein the expansion cone comprises: one or more internal lubricating passages coupled to each of the lubricating grooves.

23. A method of coupling a first tubular member to a second tubular member, wherein the outside diameter of the first tubular member is less than the inside diameter of the second tubular member, comprising:

positioning at least a portion of the first tubular member within the second tubular member;

positioning a pump within the first tubular member;

pressurizing a portion of the interior of the first tubular member by pumping fluidic materials proximate the first tubular member into the portion of the interior of the first tubular member using the pump; and displacing an expansion cone within the interior of the first tubular member.

24. The method of claim 23, wherein the second tubular member is selected from the group consisting of a wellbore casing, a pipeline, and a structural support.

25. The method of claim 23, further comprising:

sealing off a portion of the first tubular member.

26. The method of claim 23, further comprising:

lubricating the interface between the first tubular member and the expansion cone.

27. The method of claim 26, wherein lubricating comprises: coating the first tubular member with a lubricant.

28. The method of claim 26, wherein lubricating comprises: injecting a lubricating fluid into the trailing edge of the interface between the first tubular member and the expansion cone.

29. The method of claim 26, wherein lubricating comprises:

coating the first tubular member with a first component of a lubricant; and circulating a second component of the lubricant into contact with the coating on the first tubular member.

30. An apparatus for repairing an opening in a tubular member, comprising:

means for positioning an expandable tubular, and an expansion cone within the tubular member;

means for positioning the expandable tubular in opposition to the opening in the tubular member;

means for pressurizing an interior portion of the expandable tubular; and means for radially expanding the expandable tubular into intimate contact with the tubular member using the expansion cone.

31. The apparatus of claim 30, further comprising:

means for locating the opening in the tubular member.

32. The apparatus of claim 30, wherein the tubular member comprises a wellbore casing.

33. The apparatus of claim 30, wherein the tubular member comprises a structural support.

34. The apparatus of claim 30, further comprising: means for coating the expandable tubular member with a lubricant.

35. The apparatus of claim 30, further comprising: means for injecting a lubricating fluid into the trailing edge of the interface between the expandable tubular member and the expansion cone.

36. The apparatus of claim 30, further comprising: means for coating the expandable tubular member with a first component of a lubricant; and means for circulating a second component of the lubricant into contact with the coating on the expandable tubular member.

37. The apparatus of claim 30, further comprising:

means for sealing off a portion of the expandable tubular member.

38. The apparatus of claim 30, wherein the tubular member comprises a pipeline.

39. An apparatus for coupling a first tubular member to a second tubular member, wherein the outside diameter of the first tubular member is less than the inside diameter of the second tubular member, comprising:

means for positioning at least a portion of the first tubular member within the second tubular member;

means for pressurizing a portion of the interior of the first tubular member by pumping fluidic materials proximate the first tubular member into the portion of the interior of the first tubular member;

means for displacing an expansion cone within the interior of the first tubular member.

40. The apparatus of claim 39, wherein the second tubular member is selected from the group consisting of a wellbore casing, a pipeline, and a structural support.

41. The apparatus of claim 39, further comprising: means for coating the first tubular member with a lubricant.

42. The apparatus of claim 39, further comprising: means for injecting a lubricating fluid into the trailing edge of the interface between the first tubular member and the expansion cone.

43. The apparatus of claim 39, further comprising: means for coating the first tubular member with a first component of a lubricant; and means for circulating a second component of the lubricant into contact with the coating on the first tubular member.

44. The apparatus of claim 39, further comprising:

means for sealing off a portion of the first tubular member.

45. An apparatus for repairing a tubular member, comprising: a support member;

an expandable tubular member removably coupled to the support member;

an expansion cone movably coupled to the support member; and a pump positioned within the expandable tubular member coupled to the support member adapted to pressurize a portion of the interior of the expandable tubular member;

wherein the expansion cone includes an inclined surface including one or more lubricating grooves.

46. An apparatus for repairing a tubular member, comprising: a support member;

an expandable tubular member removably coupled to the support member;

an expansion cone movably coupled to the support member; and a pump positioned within the expandable tubular member coupled to the support member adapted to pressurize a portion of the interior of the expandable tubular member;

wherein the expansion cone includes an inclined surface including one or more lubricating grooves; and wherein the expansion cone includes one or more internal lubricating passages coupled to each of the lubricating grooves.

47. A method of repairing an opening in a tubular member, comprising:

positioning an expandable tubular, an expansion cone, and a pump within the tubular member;

positioning the expandable tubular in opposition to the opening in the tubular member;

injecting fluidic materials into an interior portion of the expandable tubular using the pump to pressurize the interior portion of the expandable tubular; and displacing the expansion cone relative to the expandable tubular member to radial expand the expandable tubular into intimate contact with the tubular member.

48. The method of claim 47, further comprising: locating the opening in the tubular member using an opening locator.

49. The method of claim 47, wherein the tubular member comprises a wellbore casing.

50. The method of claim 47, wherein the tubular member comprises a pipeline.

51. The method of claim 47, wherein the tubular member comprises a structural support.

52. The method of claim 47, further comprising: lubricating the interface between the expandable tubular member and the expansion cone.

53. The method of claim 52, wherein lubricating comprising: coating the expandable tubular member with a lubricant.

54. The method of claim 52, wherein lubricating comprises: injecting a lubricating fluid into the trailing edge of the interface between the expandable tubular member and the expansion cone.

55. The method of claim 52, wherein lubricating comprises: coating the expandable tubular member with a first component of a lubricant; and circulating a second component of the lubricant into contact with the coating on the expandable tubular member.

56. The method of claim 47, further comprising: sealing off a portion of the expandable tubular member.

57. An apparatus for repairing a tubular member, comprising:

a support member;

an expandable tubular member removably coupled to the support member;

a tubular expansion cone movably coupled to the support member; and a pump positioned within the expandable tubular member coupled to the support member adapted to pressurize a portion of the interior of the expandable tubular member.

58. The apparatus of claim 57, wherein the expandable tubular member comprises: a coating of a lubricant.

59. The apparatus of claim 57, wherein the expandable tubular member comprises: a coating of a first component of a lubricant.

60. The apparatus of claim 57, wherein the expandable tubular member comprises: a sealing member coupled to the outer surface of the expandable tubular member.

61. The apparatus of claim 57, wherein the expandable tubular member comprises: a first end having a first outer diameter; an intermediate portion coupled to the first end having an intermediate outer diameter; and a second end having a second outer diameter coupled to the intermediate portion having a second outer diameter; wherein the first and second outer diameters are greater than the intermediate outer diameter.

62. The apparatus of claim 61, wherein the first end, second end, and intermediate portion of the expandable tubular member have wall thicknesses $t_1$, $t_2$, and $t_{INT}$ and inside diameters $D_1$, $D_2$ and $D_{INT}$; and wherein the relationship between the wall thicknesses $t_1$, $t_2$, and $t_{INT}$, the inside diameters $D_1$, $D_2$ and $D_{INT}$, the inside diameter $D_{TUBE}$ of the tubular member that the expandable tubular member will be inserted into, and the outside diameter $D_{cone}$ of the expansion cone is given by the following expression:

$$D_{TUBE} - 2 * t_1 \geq D_1 \geq \frac{1}{t_1}[(t_1 - t_{INT}) * D_{cone} + t_{INT} * D_{INT}]$$

where $t_1 = t_2$; and $D_1 = D_2$.

63. The apparatus of claim 61, wherein the expandable tubular member comprises: a sealing member coupled to the outside surface of the intermediate portion.

64. The apparatus of claim 61, wherein the expandable tubular member comprises: a first transition portion coupled to the first end and the intermediate portion inclined at a first angle; and a second transition portion coupled to the second end and the intermediate portion inclined at a second angle; wherein the first and second angles range from about 5 to 45 degrees.

65. The apparatus of claim 57, wherein the tubular expansion cone comprises: an expansion cone surface having an angle of attack ranging from about 10 to 40 degrees.

66. The apparatus of claim 57, wherein the tubular expansion cone comprises: a first expansion cone surface having a first angle of attack; and a second expansion cone surface having a second angle of attack; wherein the first angle of attack is greater than the second angle of attack.

67. The apparatus of claim 57, wherein the tubular expansion cone comprises: an expansion cone surface having a substantially parabolic profile.

68. The apparatus of claim 57, wherein the tubular expansion cone comprises: an inclined surface including one or more lubricating grooves.

69. The apparatus of claim 68, wherein the tubular expansion cone comprises: one or more internal lubricating passages coupled to each of the lubricating grooves.

70. A method of coupling a first tubular member to a second tubular member, wherein the outside diameter of the first tubular member is less than the inside diameter of the second tubular member, comprising:

positioning at least a portion of the first tubular member within the second tubular member;

positioning a pump within the first tubular member;

pressurizing a portion of the interior of the first tubular member by pumping fluidic materials into the portion of the interior of the first tubular member by operating the pump; and displacing a tubular expansion cone within the interior of the first tubular member.

71. The method of claim 70, wherein the second tubular member is selected from the group consisting of a wellbore casing, a pipeline, and a structural support.

72. The method of claim 70, further comprising: lubricating the interface between the first tubular member and the expansion cone.

73. The method of claim 72, wherein lubricating comprises: coating the first tubular member with a lubricant.

74. The method of claim 73, wherein lubricating comprises: coating the first tubular member with a first component of a lubricant; and circulating a second component of the lubricant into contact with the coating on the first tubular member.

75. The method of claim 72, wherein lubricating comprises: injecting a lubricating fluid into the trailing edge of the interface between the first tubular member and the tubular expansion cone.

76. The method of claim 70, further comprising: sealing off a portion of the first tubular member.

77. An apparatus for repairing an opening in a tubular member, comprising:

means for positioning an expandable tubular, an expansion cone, and a pump within the tubular member;

means for positioning the expandable tubular in opposition to the opening in the tubular member;

means for injecting fluidic materials into an interior portion of the expandable tubular using the pump to pressurize the interior portion of the expandable tubular; and means for displacing the expansion cone relative to the expandable tubular member to radial expand the expandable tubular into intimate contact with the tubular member.

78. The apparatus of claim 77, further comprising: means for locating the opening in the tubular member.

79. The apparatus of claim 77, wherein the tubular member comprises a wellbore casing.

80. The apparatus of claim 77, wherein the tubular member comprises a pipeline.

81. The apparatus of claim 77, wherein the tubular member comprises a structural support.

82. The apparatus of claim 77, further comprising: means for lubricating the interface between the expandable tubular member and the expansion cone.

83. The apparatus of claim 82, further comprising: means for coating the expandable tubular member with a lubricant.

84. The apparatus of claim 82, further comprising: means for injecting a lubricating fluid into the trailing edge of the interface between the expandable tubular member and the expansion cone.

85. The apparatus of claim 82, further comprising: means for coating the expandable tubular member with a first component of a lubricant; and means for circulating a second component of the lubricant into contact with the coating on the expandable tubular member.

86. The apparatus of claim 77, further comprising: means for sealing off a portion of the expandable tubular member.

87. An apparatus for coupling a first tubular member to a second tubular member, wherein the outside diameter of the first tubular member is less than the inside diameter of the second tubular member, comprising:

means for positioning at least a portion of the first tubular member within the second tubular member;

means for pressurizing a portion of the interior of the first tubular member by pumping fluidic materials into the portion of the interior of the first tubular member; and means for displacing a tubular expansion cone within the interior of the first tubular member.

88. The apparatus of claim 87, wherein the second tubular member is selected from the group consisting of a wellbore casing, a pipeline, and a structural support.

89. The apparatus of claim 87, further comprising: means for lubricating the interface between the first tubular member and the tubular expansion cone.

90. The apparatus of claim 89, further comprising: means for coating the first tubular member with a lubricant.

91. The apparatus of claim 89, further comprising: means for injecting a lubricating fluid into the trailing edge of the interface between the first tubular member and the tubular expansion cone.

92. The apparatus of claim 89, further comprising: means for coating the first tubular member with a first component of a lubricant; and means for circulating a second component of the lubricant into contact with the coating on the first tubular member.

93. The apparatus of claim 87, further comprising: means for sealing off a portion of the first tubular member.

94. An apparatus for repairing a tubular member, comprising:

a support member; an expandable tubular member removably coupled to the support member;

an expansion cone movably coupled to the support member; and a pump coupled to the support member adapted to pressurize a portion of the interior of the expandable tubular member;

wherein the expandable tubular member comprises:

a first end having a first outer diameter;

an intermediate portion coupled to the first end having an intermediate outer diameter; and a second end having a second outer diameter coupled to the intermediate portion having a second outer diameter;

wherein the first and second outer diameters are greater than the intermediate outer diameter;

wherein the first end, second end, and intermediate portion of the expandable tubular member have wall thicknesses $t_1$, $t_2$, and $t_{INT}$ and inside diameters $D_1$, $D_2$ and $D_{INT}$; and wherein the relationship between the wall thicknesses $t_1$, $t_2$, and $t_{INT}$, the inside diameters $D_1$, $D_2$ and $D_{INT}$, the inside diameter $D_{TUBE}$ of the tubular member that the expandable tubular member will be inserted into, and the outside diameter $D_{cone}$ of the expansion cone is given by the following expression:

$$D_{TUBE} - 2 * t_1 \geq D_1 \geq \frac{1}{t_1}[(t_1 - t_{INT}) * D_{cone} + t_{INT} * D_{INT}]$$

where $t_1 = t_2$; and $D_1 = D_2$.

95. An apparatus for radially expanding and plastically deforming a tubular member into engagement with a preexisting tubular member, comprising:

a support member; an expandable tubular member operably coupled to the support member; and an expansion device coupled to the support member;

wherein the expandable tubular member comprises:

a first end having a first outer diameter;

an intermediate portion coupled to the first end having an intermediate outer diameter; and a second end having a second outer diameter coupled to the intermediate portion having a second outer diameter;

wherein the first and second outer diameters are greater than the intermediate outer diameter;

wherein the first end, second end, and intermediate portion of the expandable tubular member have wall thicknesses $t_1$, $t_2$, and $t_{INT}$ and inside diameters $D_1$, $D_2$ and $D_{INT}$; and wherein the relationship between the wall thicknesses $t_1$, $t_2$, and $t_{INT}$, the inside diameters $D_1$, $D_2$ and $D_{INT}$, the inside diameter $D_{TUBE}$ of the preexisting tubular member that the expandable tubular member will be inserted into, and the outside diameter $D_{EXPANSION\ DEVICE}$ of the expansion device is given by the following expression:

$$D_{TUBE} - 2 * t_1 \geq D_1 \geq \frac{1}{t_1}[(t_1 - t_{INT}) * D_{EXPANSION\ DEVICE} + t_{INT} * D_{INT}]$$

where $t_1 = t_2$; and $D_1 = D_2$.

96. A method of repairing a tubular member, comprising:

positioning an expandable tubular member, an expansion device, and a pump within the tubular member; and pressurizing and interior portion of the expandable tubular member using the pump; and displacing the expansion device relative to the expandable tubular member to radially expand and plastically deform the expandable tubular member into engagement with the tubular member;

wherein the expandable tubular member comprises:

a first end having a first outer diameter;

an intermediate portion coupled to the first end having an intermediate outer diameter; and a second end having a second outer diameter coupled to the intermediate portion having a second outer diameter;

wherein the first and second outer diameters are greater than the intermediate outer diameter;

wherein the first end, second end, and intermediate portion of the expandable tubular member have wall thicknesses $t_1$, $t_2$, and $t_{INT}$ and inside diameters $D_1$, $D_2$ and $D_{INT}$; and wherein the relationship between the wall thicknesses $t_1$, $t_2$, and $t_{INT}$, the inside diameters $D_1$, $D_2$ and $D_{INT}$, the inside diameter $D_{TUBE}$ of the tubular member that the expandable tubular member will be inserted into, and the outside diameter $D_{EXPANSION\ DEVICE}$ of the expansion device is given by the following expression:

$$D_{TUBE} - 2 * t_1 \geq D_1 \geq \frac{1}{t_1}[(t_1 - t_{INT}) * D_{EXPANSION\ DEVICE} + t_{INT} * D_{INT}]$$

where $t_1 = t_2$; and $D_1 = D_2$.

97. An apparatus for repairing a tubular member using an expandable tubular member, comprising:

a support member;

an expandable tubular member removably coupled to the support member;

an expansion device movably coupled to the support member and positioned within the expandable tubular member; and a pump coupled to the support member positioned proximate the expansion device adapted to pressurize a portion of the interior of the expandable tubular member.

98. An apparatus for coupling an expandable tubular member to a preexisting tubular member, comprising:

means for positioning an expandable tubular member, and an expansion device within the preexisting tubular member;

means for positioning the expandable tubular member in opposition to the preexisting tubular member;

means for pressurizing an interior portion of the expandable tubular member; and means for radially expanding the expandable tubular member into engagement with the preexisting tubular member using the expansion device;

wherein during the radial expansion of the expandable tubular member, the interior portion of the preexisting tubular member is not pressurized.

* * * * *